US006565185B1

(12) United States Patent
Endo

(10) Patent No.: US 6,565,185 B1
(45) Date of Patent: May 20, 2003

(54) NOZZLE TESTING BEFORE AND AFTER NOZZLE CLEANING

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 09/666,135

(22) Filed: Sep. 20, 2000

(30) Foreign Application Priority Data

Sep. 29, 1999 (JP) ..... 11-276281
Jul. 6, 2000 (JP) ..... 2000-204564

(51) Int. Cl.[7] ..... B41J 2/165
(52) U.S. Cl. ..... 347/23; 347/19
(58) Field of Search ..... 347/23, 19, 14, 347/22, 29, 30, 32, 33, 40, 44; 358/404, 406, 504

(56) References Cited

U.S. PATENT DOCUMENTS 4,967,204 A * 10/1990 Terasawa et al. ..... 347/23
5,428,380 A * 6/1995 Ebisawa ..... 347/35
6,293,645 B1 * 9/2001 Kim ..... 347/23
6,352,331 B1 * 3/2002 Armijo et al. ..... 347/19
6,359,701 B1 * 3/2002 Yamada et al. ..... 358/1.2

FOREIGN PATENT DOCUMENTS

| | | |
|---|---|---|
| JP | 1-130948 | 5/1989 |
| JP | 1-297253 | 11/1989 |
| JP | 6-320729 | 11/1994 |
| JP | 10-119307 | 5/1998 |
| JP | 10-217471 | 8/1998 |
| JP | 11-188853 | 7/1999 |

* cited by examiner

*Primary Examiner*—Shih-wen Hsieh
(74) *Attorney, Agent, or Firm*—Oblon, Spivak, McClelland, Maier & Neustadt, P.C.

(57) ABSTRACT

It is an object of the invention to provide a technique for reducing the likelihood that cleaning will cause nozzle clogging. In periodic automatic cleaning of a printer that is not being used, the ejecting of ink droplets from each nozzle is tested prior to the cleaning to determine whether each nozzle is an operating nozzle capable of ejecting ink droplets or a non-operating nozzle incapable of ejecting ink droplets. The nozzles are only cleaned if non-operating nozzles are detected. The testing of the nozzles is also automatically carried out after cleaning.

19 Claims, 34 Drawing Sheets

Flying droplet test method (2)

Fig.22

56

| Cleaning operation | Nozzle set | | |
|---|---|---|---|
| | First | Second | Third |
| Ink suction (S201) | × | ○ | × |
| Pinching cleaning (S203) | ○ | ○ | ○ |
| Pinching and wiping (S205) | ○ | ○ | ○ |
| Replacement of tank contents (S207) | ○ | ○ | ○ |

Processing procedure in seventh example

Nozzle array being used can be made up of just operating

Nozzle array being used cannot be made up of just operating nozzles

Printing operation without supplementation

Printing operation with supplementation

Processing procedure in second example

NOZZLE TESTING BEFORE AND AFTER NOZZLE CLEANING

BACKGROUND OF THE INVENTION

1. Field of the Invention

The present invention relates to a technique for printing images by recording dots on the surface of a printing medium by ejecting ink droplets from a plurality of nozzles, and more particularly to a printing technique that utilizes a nozzle test for testing whether or not ink droplets are ejected from each nozzle.

2. Description of the Related Art

Ink jet printers print images by ejecting ink droplets from a plurality of nozzles. Numerous nozzles are provided to the printing head of an ink jet printer, but there are instances when of some the nozzles become clogged and are unable to eject ink droplets due to an increase in the viscosity of the ink, the admixture of bubbles, or another such cause. In particular, if an ink jet printer is left for an extended period without printing anything, the viscosity of the ink can increase to the point that ink droplets can no longer be ejected from the nozzles. When a nozzle becomes clogged, dots will be missing in the image, which adversely affects image quality. In this Specification, a test of the nozzles is also referred to as a "missing dot test."

In order to clear the nozzles of clogging, a cleaning mechanism is ordinarily provided to an ink jet printer. The user can press a button on the printer and clean the nozzles whenever desired. Also, to deal with situations when the printer is left unused for extended periods as above, the printer itself is sometimes designed so that it automatically performs cleaning whenever a specific length of time has elapsed from a predetermined point in time.

However, although some measures in the cleaning sequence and in the construction of the cleaning mechanism are taken and vary rare, there are cases rarely in which a nozzle that had not been clogged before cleaning becomes clogged as a result of cleaning. In such a case, cleaning in an attempt to eliminate clogged nozzles can actually increase the likelihood of creating nozzle clogging.

SUMMARY OF THE INVENTION

Accordingly, an object of the present invention is to reduce the likelihood of generating nozzle clogging.

In order to attain at least part of the above and other objects, there is provided a printer comprising a printing head having a plurality of nozzles for ejecting ink droplets, a cleaning mechanism for cleaning the plurality of nozzles, and a test unit for testing whether each of the plurality of nozzles can eject ink droplets. When the cleaning mechanism performs cleaning for a specific inducement other than the detection by the test unit of at least a specific number of non-operating nozzles unable to eject ink droplets, automatically carrying out the testing of the nozzles by the test unit before and/or after this cleaning. The following description will be divided into two cases: when the testing is conducted before cleaning, and when the testing is conducted after cleaning.

(1) Test After Cleaning:

In one embodiment, when the cleaning mechanism performs cleaning for the specific inducement other than the detection by the test unit of non-operating nozzles unable to eject ink droplets, the testing of the nozzles can be automatically carried out by the test unit after this cleaning. This makes it possible to ascertain whether the nozzles are clogged when there is the possibility that nozzle clogging will not be cleared by cleaning. Therefore, the reduction in image quality can be ameliorated by choosing a suitable printing operation according to whether there is any clogging after cleaning.

When a non-operating nozzle is detected by the testing of the nozzles after cleaning, and a nozzle array to be used for printing can be made up of just operating nozzles, it is preferable for the printing to be carried out using a nozzle array made up of just operating nozzles. If this is done, then even if there are some non-operating nozzle, normal printing can still be carried out with just the operating nozzles.

When a non-operating nozzle is detected by a test of the nozzles after cleaning, and a nozzle array to be used for printing can be made up of not just operating nozzles but with the non-operating nozzle, it is preferable for the printing to be carried out according to a printing operation including a supplemental operation in which dots on a main scanning line to be recorded by the non-operating nozzle in the nozzle array are recorded using one of the operating nozzles. If this is done, the dots that are supposed to be recorded by the non-operating nozzle can be recorded by the other operating nozzles, thereby preventing a decrease in image quality.

The cleaning may include an operation in which ink is drawn out of the plurality of nozzles by suction. With cleaning such as this, there is believed to be a likelihood that some nozzles which were not clogged prior to cleaning will be clogged after cleaning, although some measures in the cleaning sequence and in the construction of the cleaning mechanism are taken. Therefore, the above-mentioned effect will be particularly great if a nozzle test is conducted after such cleaning. Furthermore, conducting a test of the nozzles after cleaning makes it possible to simplify the complex cleaning mechanism.

(2) Test Before Cleaning:

In one embodiment, when the cleaning mechanism performs cleaning for the specific inducement other than the detection by the test unit of at least a specific number of non-operating nozzles unable to eject ink droplets, the testing of the nozzles can be automatically carried out by the test unit before this cleaning.

This makes it possible to ascertain whether the nozzles are clogged before cleaning. There is also the possibility that nozzles which are not clogged will become clogged when cleaned. If the above procedure is followed, however, it can be ascertained whether the nozzles are clogged prior to cleaning, so a decision not to clean can be made according to the number of clogged nozzles, thereby lowering the potential for new clogging to occur.

The excluded inducement, "the detection of at least a specific number of non-operating nozzles," may be "the detection of one or more non-operating nozzles." The nozzle test may also be performed both before and after cleaning. Specifically, it can be performed before cleaning, after cleaning, or both.

It is preferable to cancel the cleaning if the number of non-operating nozzle detected by the testing of the nozzles before cleaning is less than a first threshold. Even in this case, however, flushing (blowing out the ink) may be performed. The phrase "if the number of non-operating nozzle is less than a first threshold" as used here encompasses "less than one," that is, "if no non-operating nozzles are detected."

The above procedure more effectively lowers the probability that the cleaning of nozzles which are not clogged will result in new clogging and non-operating nozzles. Furthermore, if the amount of ink consumed in the cleaning of the nozzles is greater than the amount of ink consumed in the testing of the nozzles, ink consumption can be kept lower than when cleaning is carried out directly by choosing whether or not to execute the cleaning as above.

The cleaning for the specific inducement preferably includes timer cleaning carried out automatically by the printer when at least a specific amount of time has elapsed since a specified event.

If a printer of the type that ejects ink droplets from nozzles is left for an extended period without printing anything, the viscosity of the ink can increase to the point that ink droplets can no longer be ejected from the nozzles. If the nozzles are automatically cleaned after a specific length of time has elapsed since printing or nozzle cleaning as above, however, this blocked ejection caused by the thickening of the ink can be effectively prevented.

Furthermore, in the above embodiment, this automatic cleaning will not be performed if the number of non-operating nozzles detected by the nozzle test before cleaning is less than a first threshold, so the likelihood that non-operating nozzles will result from the cleaning itself can also be reduced.

Further, in the above embodiment, if it is decided not to clean, then another attempt at automatically cleaning the nozzles will be made when the specified length of time has elapsed from that decision. Thus, with the above embodiment, testing is carried out at regular time intervals after the last printing, and the nozzles are cleaned according to the number of clogged nozzles. Accordingly, the nozzles of the printer are always kept in good condition, and the printer remains ready to print right away even after not having been used for an extended period.

It is also preferable for the plurality of nozzles to be divided into a plurality of nozzle sets each including one or more nozzles, and for a decision to be made whether to cancel the execution of the cleaning for each nozzle set when the cleaning mechanism is able to carry out independently the cleaning for each of the nozzle sets. With this embodiment, cleaning is carried out for those nozzle sets including non-operating nozzles, but not for those nozzle sets that do not include any non-operating nozzles, allowing the cleaning to be performed more efficiently.

Meanwhile, it is preferable to require a user to reconfirm a cleaning directive if the execution of the cleaning for the specific inducement is a result of the cleaning directive from the user, and if the number of non-operating nozzles detected by the testing of the nozzles before the cleaning is less than a first threshold.

If this is done, the user can decide whether to perform cleaning on the basis of the number of non-operating nozzles. Specifically, the user chooses whether to clean the nozzles even though the number of non-operating nozzles is less than the specified number, or not to clean the nozzles. Therefore, with this embodiment, the likelihood that cleaning will result in new clogging can be reduced on the whole, while still respecting the will of the user.

Furthermore, when the user inputs a cleaning directive prior to printing text, graphics, or the like just to be on the safe side, the time this cleaning takes can be reduced and the printing carried out more quickly if the user opts not to perform the cleaning if the number of non-operating nozzles is less than the first threshold. As to the time it takes to test the nozzles, the longer it takes to clean the nozzles, the more time that can be saved by making the above selection.

The cleaning may include an operation in which ink is drawn out of the plurality of nozzles by suction. With cleaning such as this, the likelihood that nozzles which were not clogged prior to cleaning will be clogged after cleaning is relatively high, although some measures in the cleaning sequence and in the construction of the cleaning mechanism are taken. Therefore, if a nozzle test is conducted before this cleaning, the likelihood of clogging can be effectively reduced by selecting whether or not to execute the cleaning after this test.

It is also preferable that a plurality of sequences are prepared in advance for the cleaning, and to select one of the cleaning sequences according to the number of non-operating nozzles detected by the testing of the nozzles before the cleaning. With this embodiment, the appropriate cleaning sequence can be carried out as dictated by the number of non-operating nozzles.

It is also preferable to select a first cleaning sequence having a plurality of cleaning operations, including a first cleaning operation and a second cleaning operation, when the number of non-operating nozzles detected by the testing of the nozzles before the cleaning is less than a second threshold, and to select a second cleaning sequence including the cleaning operations beginning with the second cleaning operation out of the first cleaning sequence when the number of non-operating nozzles detected by the testing of the nozzles before the cleaning is at least the second threshold. The first cleaning operation here is a cleaning operation whose ability to clear nozzle clogging is relatively low and which is carried out relatively early in the cleaning sequence. The second cleaning operation is a cleaning operation whose ability to clear nozzle clogging is relatively high and which is carried out relatively late in the cleaning sequence.

With this embodiment, when the number of non-operating nozzles is large, the first cleaning operation with its relatively low ability to clear nozzle clogging is skipped and the second cleaning operation is carried out, allowing the cleaning to be performed more efficiently.

It is preferable for each of the plurality of cleaning operations in the first cleaning sequence to be carried out when the nozzle clogging has not been cleared by a previous cleaning operation. If this is done, nozzle clogging can be cleared efficiently, without wasting time on any unnecessary cleaning operations.

The following is preferable if the plurality of nozzle sets include a first nozzle group consisting of nozzles that eject ink with which nozzle clogging is relatively easy to clear, and a second nozzle group consisting of nozzles that eject ink with which nozzle clogging is relatively difficult to clear. Specifically, a first cleaning sequence is selected when all of the non-operating nozzles detected by the testing of the nozzles before the cleaning are included in the first nozzle group. On the other hand, a second cleaning sequence is executed when the non-operating nozzles detected by the testing of the nozzles before the cleaning include the nozzle of the second nozzle group. Details of the first cleaning sequence and second cleaning sequence are as given above.

With this embodiment, if there are nozzles that eject ink with which nozzle clogging is difficult to clear are among the non-operating nozzles, then the first cleaning operation with its relatively low ability to clear nozzle clogging is skipped and the second cleaning operation is carried out, allowing the cleaning to be performed more efficiently.

If the plurality of nozzles are divided into a plurality of nozzle sets each including one or more nozzles, and the cleaning mechanism is able to carry out each of the plurality of cleaning operations independently for each of the nozzle sets, it is preferable to determine the cleaning sequence carried out for each nozzle set. With this embodiment, appropriate cleaning can be carried out for easy nozzle set according to the extent of nozzle clogging.

The present invention can be realized through various embodiments such as those given below.

(1) A method for controlling a printer, and a printing method (2) A printing controller, and a printer (3) A computer program for realizing the above devices and methods (4) A recording medium on which is recorded a computer program for realizing the above devices and methods (5) A data signal embodied in a carrier wave and including a computer program for realizing the above devices and methods These and other objects, features, aspects, and advantages of the present invention will become more apparent from the following detailed description of the preferred embodiments with the accompanying drawings.

BRIEF DESCRIPTION OF THE DRAWINGS

FIG. 22 is a block diagram of the data in a main memory in an embodiment in which the cleaning sequence is determined for each nozzle set;

DESCRIPTION OF THE PREFERRED EMBODIMENTS

Embodiments of the present invention will now be described as follows.

A. Structure of the Devices

B. Structure and Principle of the Missing Dot Test Unit

C. Structure and Operation of the Cleaning Mechanism

D. Clogging and Nozzle Cleaning

E. Processing Procedure in the First Example

F. Processing Procedure in the Second Example

G. Processing Procedure in the Third Example

H. Processing Procedure in the Fourth Example

I. Fifth Example

J. Sixth Example

K. Processing Procedure in the Seventh Example

L. Processing Procedure in the Eighth Example

M. Other

The first to sixth examples are examples of embodiments in which the nozzle testing is carried out before cleaning, whereas the seventh and eighth examples are examples of embodiments in which the nozzle testing is carried out after cleaning.

A. Structure of the Devices

Figure 1:
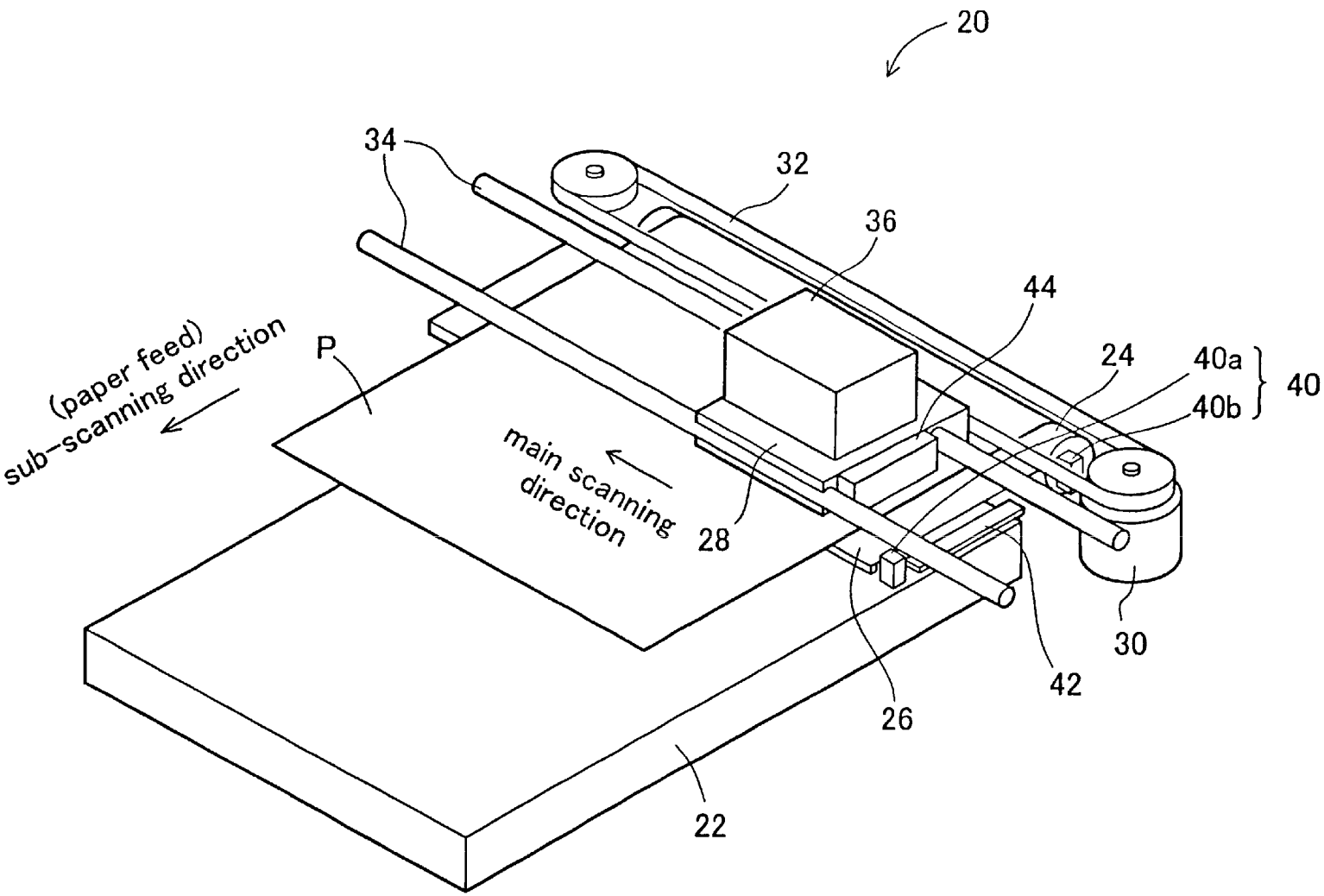
FIG. 1 is a simplified perspective view of the main structure of a color ink jet printer 20 serving as an example of the present invention.

FIG. 1 is a simplified perspective view of the main structure of a color ink jet printer 20 serving as an example of the present invention. This printer 20 comprises a paper stacker 22, a paper feed roller 24 driven by a step motor (not shown), a platen 26, a carriage 28, a step motor 30, a tow belt 32 driven by the step motor 30 to move the carriage 28, and guide rails 34 for the carriage 28. The carriage 28 carries a printing head 36 equipped with numerous nozzles.

A first missing dot test unit 40 and a second missing dot test unit 42 are provided at the standby position of the carriage 28 on the right side in FIG. 1. The first missing dot test unit 40 comprises a light emitter 40*a* and a light receiver 40*b*, and conducts a test for missing dots by utilizing these elements 40*a* and 40*b* to examine the flight of the ink droplets. The second missing dot test unit 42 tests for missing dots by examining whether or not a diaphragm provided to the surface thereof is vibrated by the ink droplets. The specific tests conducted with these missing dot test units will be discussed later.

Printing paper P is supplied from the paper stacker 22 by the paper feed roller 24, and is fed over the surface of the platen 26 in the sub-scanning direction. The carriage 28 is towed by the tow belt 32, which is driven by the step motor 30, and moves along the guide rails 34 in the main scanning direction. The main scanning direction is perpendicular to the sub-scanning direction.

Figure 2:
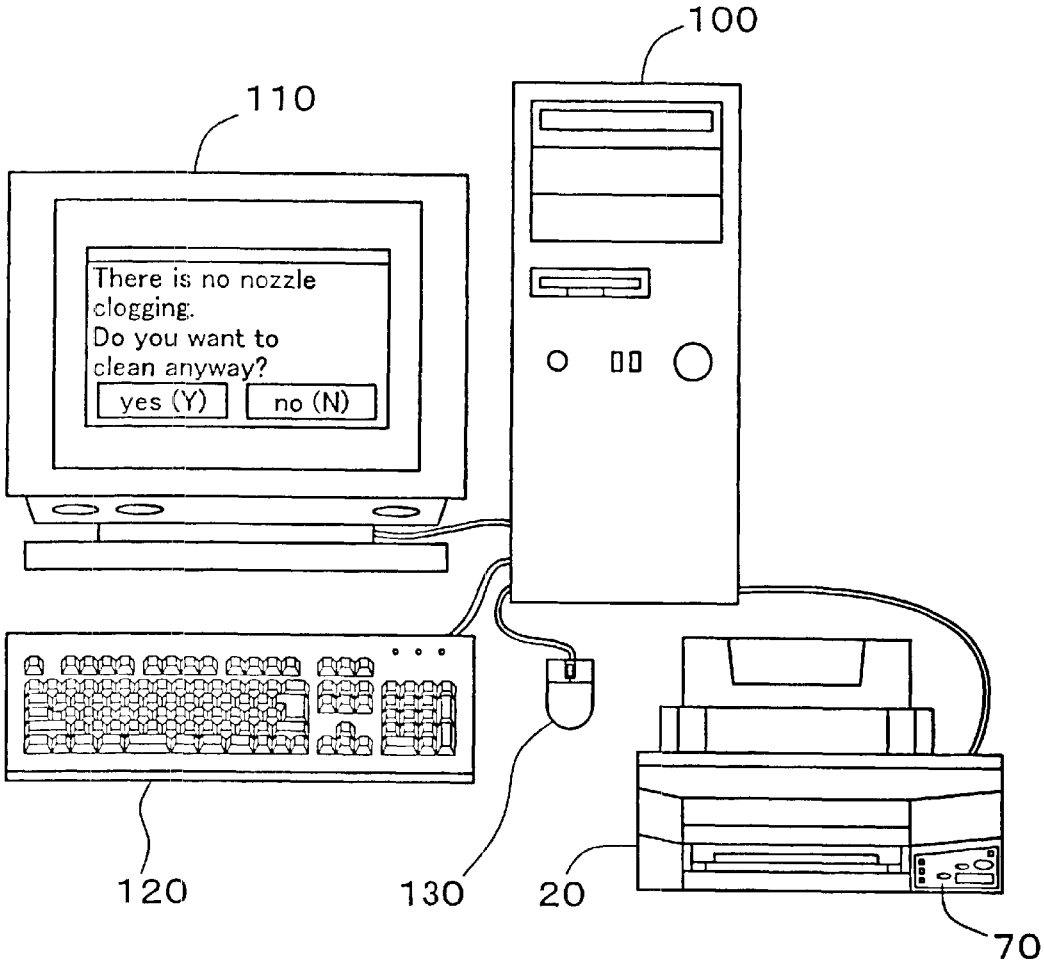
FIG. 2 is a diagram illustrating the overall structure of a computer system including the printer 20.

FIG. 2 is a diagram illustrating the overall structure of a computer system including the printer 20. This computer system comprises the printer 20, a host computer 100 to which the printer 20 is connected, a liquid crystal display (display device) 110 connected to the host computer 100, a keyboard (input device) 120 also connected to the host computer 100, and a mouse (input device) 130.

Figure 3:
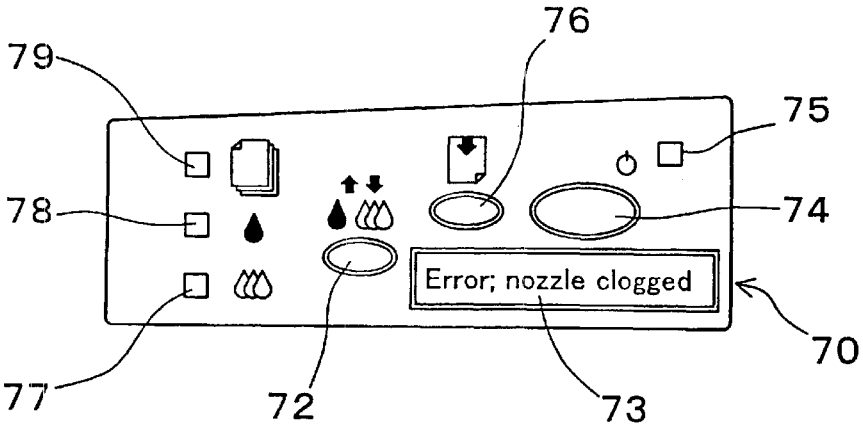
FIG. 3 is a front view of the control panel of the printer 20.

FIG. 3 is a front view of the control panel 70 of the printer 20. As shown in FIG. 2, this control panel 70 is provided at the lower right of the printer 20 (in this front view), and comprises a cleaning directive button 72 that serves as a cleaning directive input section for inputting cleaning directives, a liquid crystal window 73 that serves as an information presentation section for displaying the state of the printer, a power switch 74, a power lamp 75 that comes on when the power is turned on, a paper feed/discharge switch 76 that is operated to feed or discharge paper, a check paper lamp 79 that comes on when there is something wrong with the paper, and ink out lamps 77 and 78 that come on when the ink runs out in the cartridge. The first ink out lamp 77 comes on when the color ink runs out, and the second ink out lamp 78 comes on when the black ink runs out.

The cleaning directive button 72 is operated when the user decides on his own to clean the nozzles. When this cleaning directive button 72 is pressed, a nozzle cleaning operation is performed by a cleaning mechanism 200 as discussed below.

When the user decides on his own to clean the nozzles, in addition to giving this directive by means of the cleaning directive button 72 on the printer 20 as above, the directive for cleaning can also be sent to the printer 20 via a printer driver in the host computer 100 by means of the keyboard 120 and the mouse 130.

Figure 4:
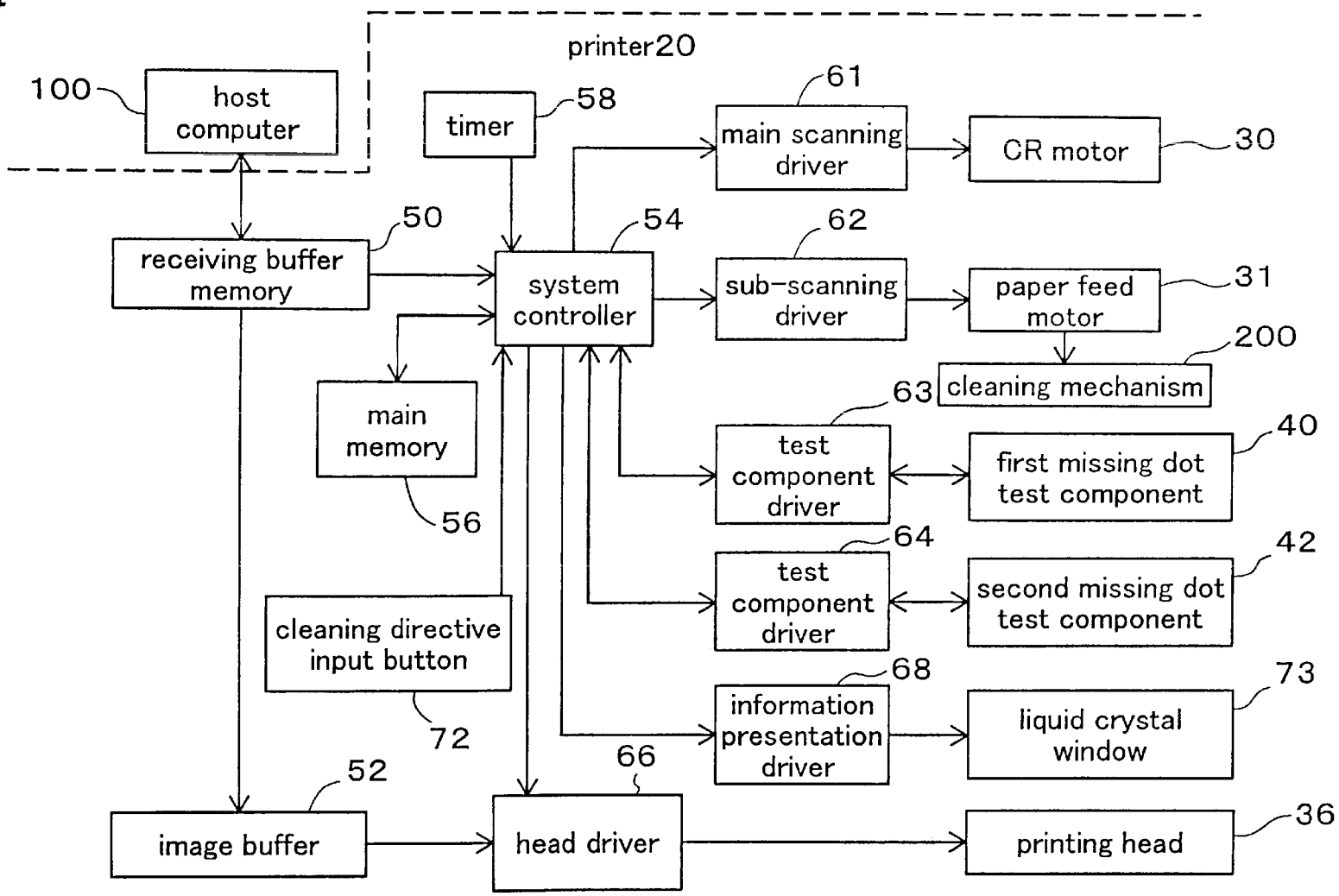
FIG. 4 is a block diagram of the electrical configuration of the printer 20.

FIG. 4 is a block diagram of the electrical configuration of the printer 20. The printer 20 comprises a receiving buffer memory 50 for receiving signals supplied from the host computer 100, an image buffer 52 for storing printing data, a system controller 54 for controlling the overall operation of the printer 20, a main memory 56, and a timer 58.

To the system controller 54 are connected a main scanning driver 61 for driving the step motor 30, a sub-scanning driver 62 for driving a paper feed motor 31 (not shown in FIG. 1), test unit drivers 63 and 64 for driving the two missing dot test units 40 and 42, respectively, a head driver 66 for driving the printing head 36, and an information presentation driver 68 for driving the liquid crystal window 73.

The above-mentioned cleaning directive button 72 is also connected to the system controller 54.

The power switch 74, power lamp 75, paper feed/discharge switch 76, check paper lamp 79, ink out lamps 77 and 78, and so on of the control panel 70 are not shown in FIG. 4. The paper feed motor 31 is also used as a motor for operating the cleaning mechanism 200 (discussed below).

The printer driver (not shown) of the host computer 100 determines the various parameters specifying the printing operation on the basis of the print mode designated by the user (high-speed print mode, high-image-quality print mode, etc.). This printer driver also produces print data for printing in this print mode on the basis of these parameters, and transfers this data to the printer 20. The transferred print data is temporarily stored in the receiving buffer memory 50. Inside the printer 20, the system controller 54 reads the required information out of the print data from the receiving buffer memory 50, and sends a control signal to the various drivers on the basis of this print data.

The image buffer 52 stores print data for a plurality of color components obtained by splitting up the print data received by the receiving buffer memory 50 into color components. The head driver 66 reads the print data for the various color components from the image buffer 52 according to the control signal from the system controller 54, and correspondingly drives the nozzle arrays for the various colors provided to the printing head 36.

This printer 20 can also execute printing in an overlap print mode. This "overlap print mode" is a mode in which just intermittent pixel positions on each raster line are serviced in a single main scan, and all the pixel positions on each raster line are serviced in a plurality of main scans. For instance, when a single raster line is recorded in two main scans, just the even numbered pixel positions will be recorded in the first main scan over that raster line, and just the odd numbered pixel positions will be recorded in the second main scan. In this way all of the pixel positions on each raster line can be recorded by performing two main scans. In this Specification, the terms "pixel position" and "dot position" are used synonymously. "Main scan line" and "raster line" are also used synonymously.

The number of main scans executed in order to record all the pixel positions on a single raster line in the overlap print mode will hereinafter be referred to as the "number of scanning repetitions." An integer such as 2 or 4 is usually used for the number of scanning repetitions, and in general any real number no less than one can be selected. When the number of scanning repetitions is greater than one and less than two, this is called a "partial overlap print mode." In a partial overlap print mode, there are raster lines where all the pixel positions are recorded in just one main scan, and there are also raster lines where all the pixel positions are recorded in two main scans. The conditions applicable to an overlap print mode are discussed in detail in Japanese Laid-Open Patent Application H10-278247, the disclosure of which is incorporated herein by reference for all purposes.

In an overlap print mode, each raster line is not recorded with a single nozzle, but rather by using a plurality of nozzles. Therefore, even when there is some variance in the nozzle characteristics (such as pitch and ink ejecting characteristics), the characteristics of a particular nozzle can be prevented from affecting an entire raster line, and image quality is enhanced as a result.

The overlap printing function, test execution function, supplemental registration function, supplemental execution function, cleaning execution function, and so forth are assigned to the system controller 54. The computer program for implementing these functions to the system controller 54 is stored in the main memory 56.

B. Structure and Principle of the Missing Dot Test Unit

Figure 5:
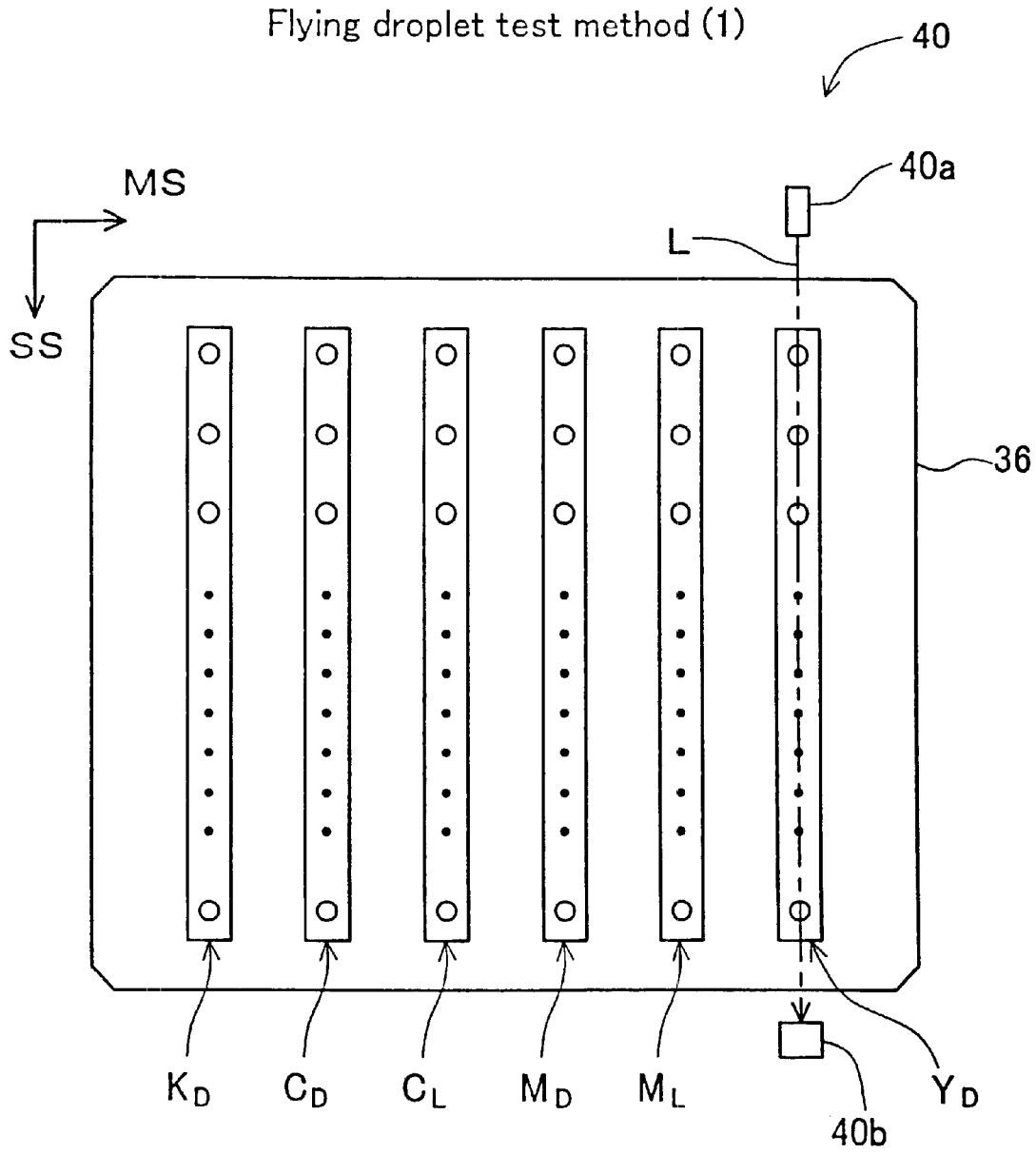
FIG. 5 is a diagram illustrating the structure of a first missing dot test unit 40 and the principle of the testing method thereof (flying droplet test method)

FIG. 5 is a diagram illustrating the structure of the first missing dot test unit 40 and the principle of the testing method thereof (flying droplet test method). FIG. 5 shows the printing head 36 viewed from the bottom, and depicts the six-color nozzle arrays of the printing head 36, and the light emitter 40*a* and light receiver 40*b* that make up the first missing dot test unit 40.

On the bottom of the printing head 36 are formed a black ink nozzle group $K_D$ for ejecting black ink, a dark cyan ink nozzle group $C_D$ for ejecting dark cyan ink, a light cyan ink nozzle group $C_L$ for ejecting light cyan ink, dark magenta nozzle group $M_D$ for ejecting dark magenta ink, a light magenta nozzle group $M_L$ for ejecting light magenta ink, and a yellow nozzle group $Y_D$ for ejecting yellow ink.

The first capital letter in the symbols indicating the various nozzle groups stands for the ink color, the subscripted "D" means that the ink has a relatively high density, and the subscripted "L" means that the ink has a relatively low density. The subscripted "D" in the yellow nozzle group $Y_D$ means that the yellow ink ejected from this nozzle group becomes gray when mixed in substantially equal amounts with dark cyan ink and dark cyan magenta. The subscripted "D" in the black ink nozzle group $K_D$ means that the black ink ejected from these nozzles is not gray, but black with a density of 100%.

The plurality of nozzles in each nozzle group are aligned in the sub-scanning direction SS. During printing, ink droplets are ejected from the various nozzles as the printing head 36 moves in the main scanning direction MS along with the carriage 28 (FIG. 1).

The light emitter 40*a* is a laser that emits a light beam L with an outside diameter of about 1 mm or less. This laser light L is emitted parallel to the sub-scanning direction SS and received by the light receiver 40*b*. As shown in FIG. 5, the first step in the missing dot test is to position the printing head 36 such that the nozzle group of one color (such as dark yellow $Y_D$) is above the optical path of the laser light L. In this state, the nozzles of dark yellow $Y_D$ are driven one at a time, in order, for a specific drive period using the head driver 66 (FIG. 4), and ink droplets are thereby successively ejected from the various nozzles. The ejected ink droplets block the beam of laser light L midway, so the receipt of the light by the light receiver 40*b* is temporarily interrupted. Therefore, if ink droplets are being ejected normally from a given nozzle, the receipt of the laser light L by the light receiver 40*b* will be temporarily interrupted, which indicates that there is no clogging of that nozzle. If the laser light L is not blocked at all within the drive period of a given nozzle, then it can be concluded that that nozzle is clogged. Since it is conceivable that the blockage of the laser light L cannot be certainly ascertained with just one ink droplet, it is preferable for a few droplets to be ejected from each nozzle.

Once testing for clogging is finished for all of the nozzles of one color, the printing head 36 is moved slightly in the main scanning direction, and a test is conducted for the nozzles of the next color (light magenta $M_L$ in the example in FIG. 5).

With this flying droplet test method, the nozzles are tested for clogging (more specifically, a test for missing dots is conducted) by detecting ink droplets in flight, so an advantage is that the testing is completed in a relatively short time.

Figure 6:
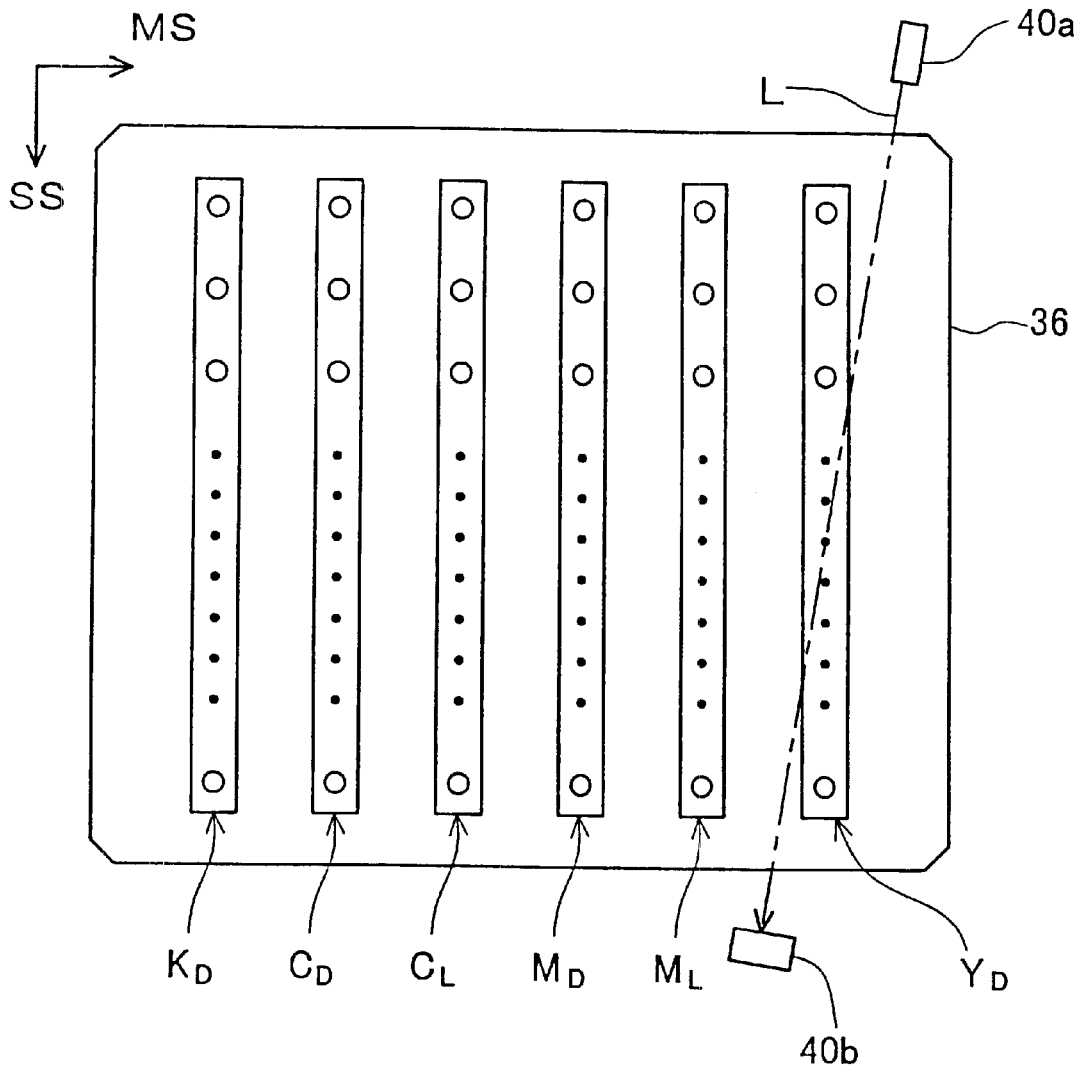
FIG. 6 is a diagram illustrating another structure of the first missing dot test unit 40.

FIG. 6 is a diagram illustrating another structure of the first missing dot test unit 40. In FIG. 6, the orientation of the light emitter 40*a* and the light receiver 40*b* is adjusted so that the direction in which the laser light L travels is somewhat oblique to the sub-scanning direction SS. This direction of travel of the laser light L is set so that when an attempt is made to detect ink droplets ejected from one nozzle with the laser light L, this laser light L will not be blocked by the ink droplets ejected from another nozzle. In other words, the optical path of the laser light L is set so that there is no interference with the path of ink droplets from a plurality of nozzles.

If the laser light L is thus emitted in a direction at an angle to the sub-scanning direction SS, it is possible to test the various nozzles for clogging by sequentially driving the nozzles one at a time and ejecting ink droplets while the printing head 36 is slowly moving in the main scanning direction. The advantage to this is that even if the ink droplets ejected from some of the nozzles should deviate somewhat from the specified position or direction, it will still be possible to test those nozzles for clogging.

Figure 7:
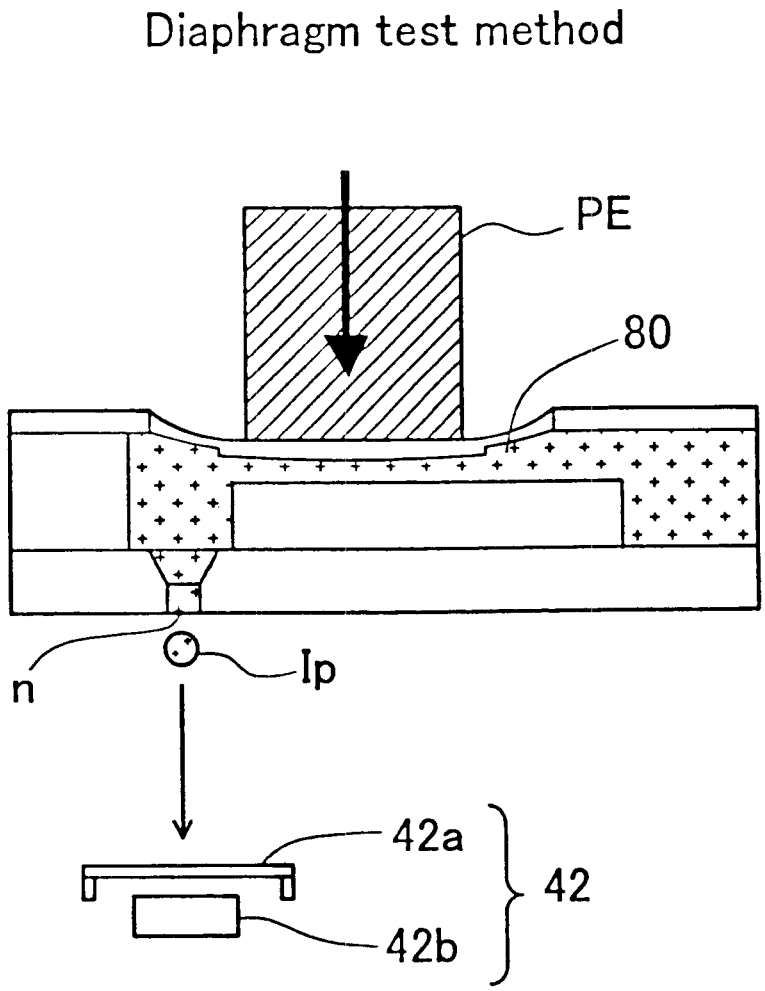
FIG. 7 is a diagram illustrating the structure of a second missing dot test unit 42 and the principle of the testing method thereof (diaphragm test method)

FIG. 7 is a diagram illustrating the structure of the second missing dot test unit 42 and the principle of the testing method thereof (diaphragm test method). FIG. 7 shows a cross section of the printing head 36 in the vicinity of one nozzle n, and a diaphragm 42*a* and a microphone 42*b* that make up the second missing dot test unit 42.

The piezo electric element PE provided to each nozzle n is disposed on an ink passage 80 through which the ink is guided to the nozzle n. When voltage is applied to the piezo electric element PE, the piezo electric element PE extends to deform the wall of the ink passage 80. As a result, the volume of the ink passage 80 is reduced according to the extension of the piezo electric element PE, and an ink droplet Ip is ejected at high speed from the tip of the nozzle n.

When the ink droplet Ip ejected from the nozzle n reaches the diaphragm 42*a*, the diaphragm 42*a* vibrates. The microphone 42*b* converts this vibration of the diaphragm 42*a* into an electrical signal. Therefore, if the output signal (vibrating sound signal) from the microphone 42*b* is detected, it means that an ink droplet Ip has reached the diaphragm 42*a* (that is, that there is no nozzle clogging).

Sets comprising the diaphragm 42*a* and the microphone 42*b* are preferably aligned in the sub-scanning direction, one set for each of the plurality of nozzles for one color. If so, it will be possible to test for clogging of all the nozzles of one color at the same time. However, if ink droplets Ip are ejected simultaneously from adjacent nozzles, there is the possibility that the adjacent diaphragms 42*a* will interfere with each other, resulting in false detection. To prevent this, it is preferable for nozzles that are to be tested at the same time to be staggered at an interval of a few nozzles.

Two missing dot test units 40 and 42 are shown in FIG. 1, but a single missing dot test unit may instead be provided to a single printer.

C. Structure and Operation of the Cleaning Mechanism

Figure 8:
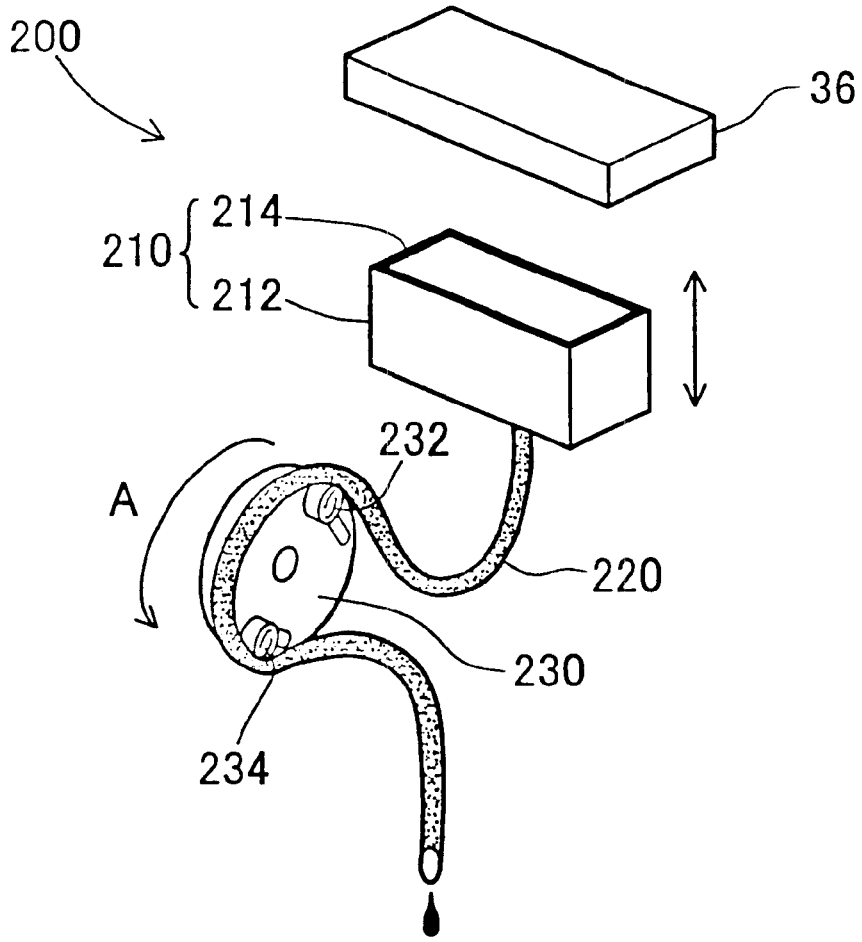
FIG. 8 is a simplified diagram illustrating the structure of a cleaning mechanism 200.

FIG. 8 is a simplified diagram illustrating the structure of the cleaning mechanism 200. The cleaning mechanism 200 comprises a head cap 210, a hose 220, and a pump roller 230. This cleaning mechanism 200 is provided at a specific cleaning location (ink suction location) in the vicinity of the first missing dot test unit 40, but is not shown in FIG. 1.

A rubber frame 214 is provided on top of a box 212 of the head cap 210. When the printing head 36 moves in the main scanning direction to a specific cleaning position during cleaning, the head cap 210 rises until the rubber frame 214 fits snugly against the lower surface of the printing head 36. As a result, an enclosed space is formed by the lower surface of the printing head 36 and the head cap 210.

The pump roller 230 has two small rollers 232 and 234 in the vicinity of its peripheral edge. The hose 220 is wound around the outside of these two small rollers 232 and 234. When the pump roller 230 is driven by the paper feed motor 31 (FIG. 4) and rotated in the direction of the arrow A, air inside the hose 220 is squeezed by the small rollers 232 and 234, which evacuates the enclosed space in the head cap 210. As a result, ink is drawn in from the nozzles of the printing head 36 and ejected to a waste ink ejecting component (not shown) via the hose 220. Once the ink present in the nozzle tips has been ejected, fresh ink is supplied from the ink cartridge side to the nozzles.

When the nozzles are thus cleaned by drawing the ink out of them, this cleaning can in fact be a source of nozzle clogging, although some measures in the cleaning sequence and in the construction of the cleaning mechanism are taken. This is believed to be attributable to various phenomena as discussed below. The first one is a phenomenon in which there is a change in air pressure in the separation of the head cap 210 from the printing head 36 after the ink has been drawn out, and as a result an air bubble finds its way into the nozzle from the head cap 210 side. The second is a phenomenon in which an air bubble present in the ink passage 80 (FIG. 7) of the printing head 36 prior to cleaning is moved by the ink suction to the vicinity of the nozzle tip. When a phenomenon such as these occurs, a nozzle that was not clogged before cleaning can become clogged as a result of the cleaning.

D. Clogging and Nozzle Cleaning

Nozzle cleaning is carried out in a variety of situations, as below.

(1) Manual cleaning by the user (2) Automatic cleaning (timer cleaning) when the printer has not been used for an extended period (3) Automatic cleaning when the nozzles are filled with ink for the first time after an ink cartridge has been replaced The above-mentioned timer cleaning (2) is executed automatically by the printer whenever ink has not been ejected for a specific length of time. The cleaning in (3) above is carried out in order to guide ink from the cartridge to the various nozzles when the ink cartridges of the printer are replaced.

In general, whenever one of the above events occurs, these types of nozzle cleaning can sometimes actually cause nozzle clogging. It is therefore preferable not to perform any unnecessary cleaning. Nevertheless, the "automatic cleaning when the nozzles are filled with ink for the first time after an ink cartridge has been replaced" in (3) above requires that ink be led from the cartridge, through the ink passage 80 (FIG. 7), to the nozzles by suction after ink cartridge replacement, and therefore must be performed every time an ink cartridge is replaced.

In view of this, except for the cleaning (suction) in (3) above, it is preferable to confirm the operating state of the nozzles by having the printer automatically conduct a test for nozzle clogging prior to cleaning as in (1) and (2).

It is also preferable to confirm the operating state of the various nozzles by having the printer automatically conduct a test for nozzle clogging after cleaning as in (1) to (3) above in order to confirm whether the cleaning of the nozzles has caused any further nozzle clogging.

It is also possible for the nozzles to be cleaned by a method that does not involve drawing the ink out of the nozzles. With a cleaning method such as this, however, the likelihood that the cleaning will cause nozzle clogging is believed to be low. Therefore, the effect of reducing the decrease in image quality due to missing dots will be particularly great in cleaning that involves drawing the ink from the nozzles if the nozzles are tested prior to cleaning and cleaning is then skipped depending on the number of non-operating nozzles. The effect of reducing the decrease in image quality due to missing dots will also be particularly great if nozzle testing is conducted after cleaning that involves drawing the ink from the nozzles.

In this Specification, "cleaning" in the strict sense refers to an operation in which ink is drawn from a nozzle by suction to the outside. In a broader sense, "cleaning" refers to various types of cleaning, including methods that do not involve drawing ink from a nozzle by suction. The present invention is applicable when cleaning in the broad sense is performed, but as mentioned above, the effect is greatest when cleaning in the strict sense is performed.

In this Specification, an event that is the inducement for commencing cleaning is called a "cleaning inducement event." In the case of the above-mentioned (1) to (3), user operation, prolonged disuse of the printer (prolonged disuse of the ink), and replacement of an ink cartridge correspond to these cleaning inducement events, respectively.

These cleaning inducement events do not necessarily mean that nozzle clogging has occurred. For instance, there are times when the user performs cleaning (1) above just to be on the safe side in order to prevent clogging of the nozzles. The present invention is characterized in that a nozzle test is automatically executed by the missing dot test unit before cleaning when the cleaning mechanism 200 is about to perform this cleaning in response to a cleaning inducement event that occurs even though nozzle clogging may not necessarily have occurred.

This makes it possible to ascertain whether nozzle clogging has occurred, that is, whether cleaning is required, in the state prior to performing this cleaning. When no nozzle clogging has occurred, as mentioned above, new nozzle clogging (caused by cleaning) can be prevented from occurring by opting not to perform cleaning.

The present invention is also characterized in that a nozzle test is automatically executed by the missing dot test unit after cleaning when the cleaning mechanism 200 has performed this cleaning in response to a cleaning inducement event that occurs even though nozzle clogging may not necessarily have occurred. This makes it possible to ascertain whether nozzle clogging has occurred as a result of the cleaning. Also, when nozzle clogging has occurred, as mentioned above, it is possible to prevent a decrease in image quality by selecting a suitable print operation.

E. Processing Procedure in the First Example

Figure 9:
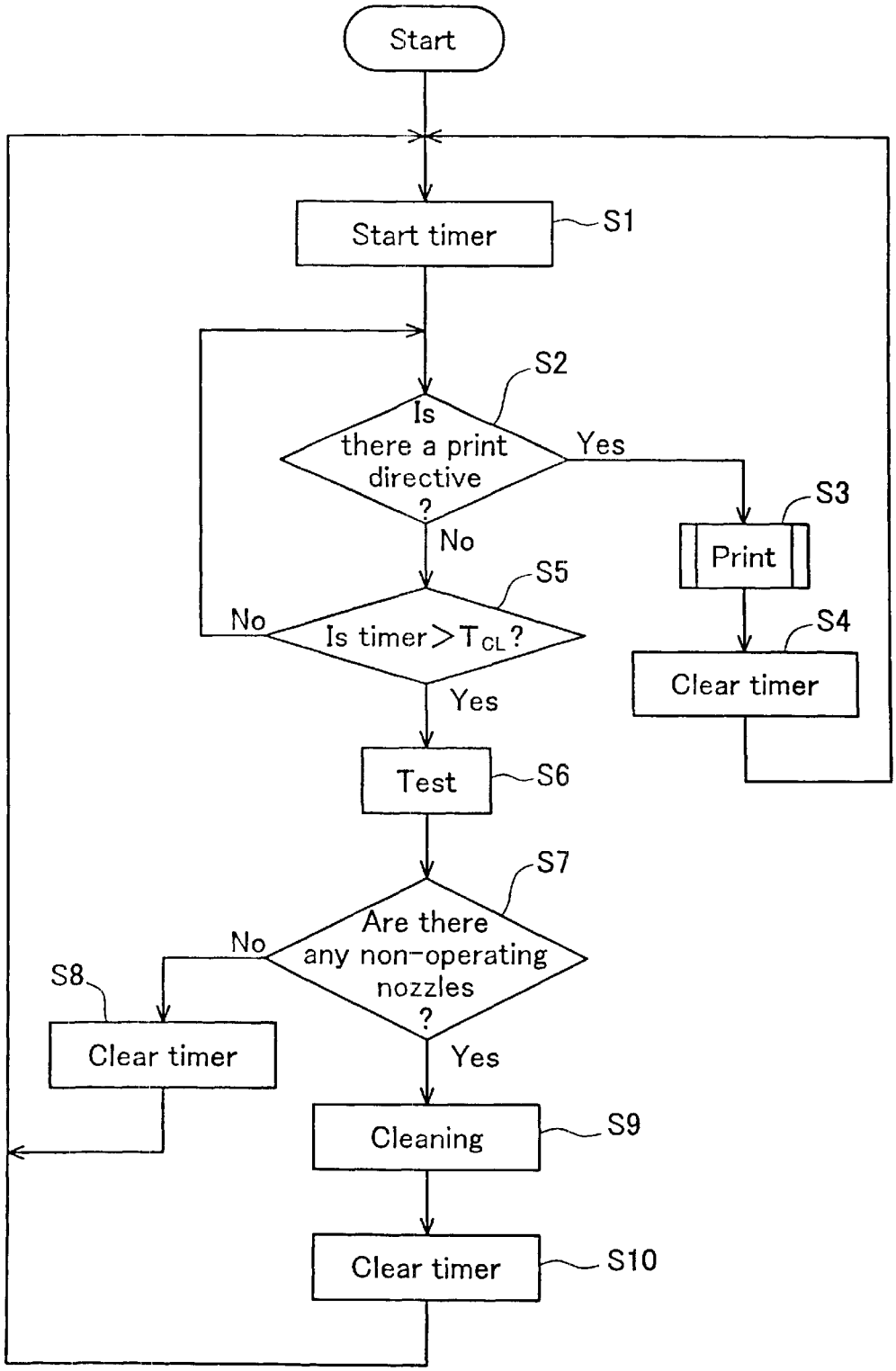
FIG. 9 is a flow chart of the processing procedure in a first example.

FIG. 9 is a flow chart of the processing procedure in a first example. When power is turned on to the printer, the printer 20 automatically executes the various steps S1 to S10 as dictated by the situation.

The measurement of the time elapsed since a specific event is begun by the timer 58 (FIG. 4) in step S1.

If there is no print directive in step S2, a decision is then made in step S5 as to whether the elapsed time measured by the timer 58 has exceeded a specific threshold $T_{CL}$, and if not, the flow returns to step S2.

Specifically, in a steady state, the printer 20 continues waiting for a print directive in the flow between steps S2 and S5. If there is a print directive in step S2, then printing is carried out in step S3, the elapsed time measured by the timer 58 is cleared in step S4, the flow goes back to step S1, and timing by the timer 58 begins again.

The point at which the timer is started after the elapsed time measured by the timer 58 is cleared in step S4 can be the point when the head cap 210 is snugged against the printing head 36 in order to prevent drying when the printer 20 has finished printing.

A test is conducted in step S6 when the elapsed time measured by the timer 58 is found to have exceeded the specific threshold $T_{CL}$ in step S5 as a result of waiting for a print directive in the flow between steps S2 and S5. The testing method is as discussed in "B. Structure and Principle of the Missing Dot Test Unit."

When it is decided in step S7 that there are no non-operating nozzles (that is, clogged nozzles), the elapsed time measured by the timer 58 is cleared in step S8, the flow returns to step S8, and timing by the timer 58 is commenced. Specifically, the "first threshold" referred to in the Claims is 1 in this first example, and cleaning is canceled if the number of non-operating nozzles is less than 1. As long as this first threshold is a small enough number that the effect on image quality will be only minimal, a number other than 1 can be used.

Nozzle cleaning is carried out in step S9 when it is decided in step S7 that there is a non-operating nozzle. The cleaning method is as discussed in "C. Structure and Operation of the Cleaning Mechanism." After this, the elapsed time measured by the timer 58 is cleared in step S10, the flow returns to step S1, and timing by the timer 58 is begun again.

Unless otherwise specified, the first missing dot test unit 40 is used in the missing dot test in step S6, but it is also possible to use the second missing dot test unit 42 instead. The threshold $T_{CL}$ for the time up to the start of cleaning can be appropriately set on the basis of how long it is expected to take for nozzle clogging to occur, for example.

Thus, in this example, the passage of time is measured in a standby state of waiting for a print directive from the host computer 100, and cleaning is automatically attempted when a specific time has elapsed. A test for nozzle clogging is conducted before this cleaning, and the cleaning is performed if a non-operating nozzle is detected. Accordingly, there will be no nozzle clogging even when printing (that is, ink ejecting) has not been performed for an extended period.

If no non-operating nozzle is detected in the testing for clogging, then cleaning is not performed, the timer is cleared, and the printer returns to a standby mode. Accordingly, it is possible to prevent new clogging of nozzles as a result of the cleaning thereof in a state in which there are no non-operating nozzles.

Therefore, with this example, even when no printing is performed for a prolonged period, the nozzles can be kept in good condition at all times, and a state in which the nozzles are able to print at any moment can be maintained even when the printer is left unused for an extended time.

The testing of the nozzles by timer (prior to cleaning) in this example is conducted by waiting for a time $T_{CL}$ to elapse after the previous printing in step S3, the previous cleaning of the nozzles in step S9, or the cancellation of the previous cleaning of the nozzles in steps S7 and S8, but can also be conducted in response to another inducement. Specifically, testing of the nozzles by timer (prior to cleaning) can be performed by waiting for at least a specific amount of time to elapse from a specific event.

F. Processing Procedure in the Second Example

Figure 10:
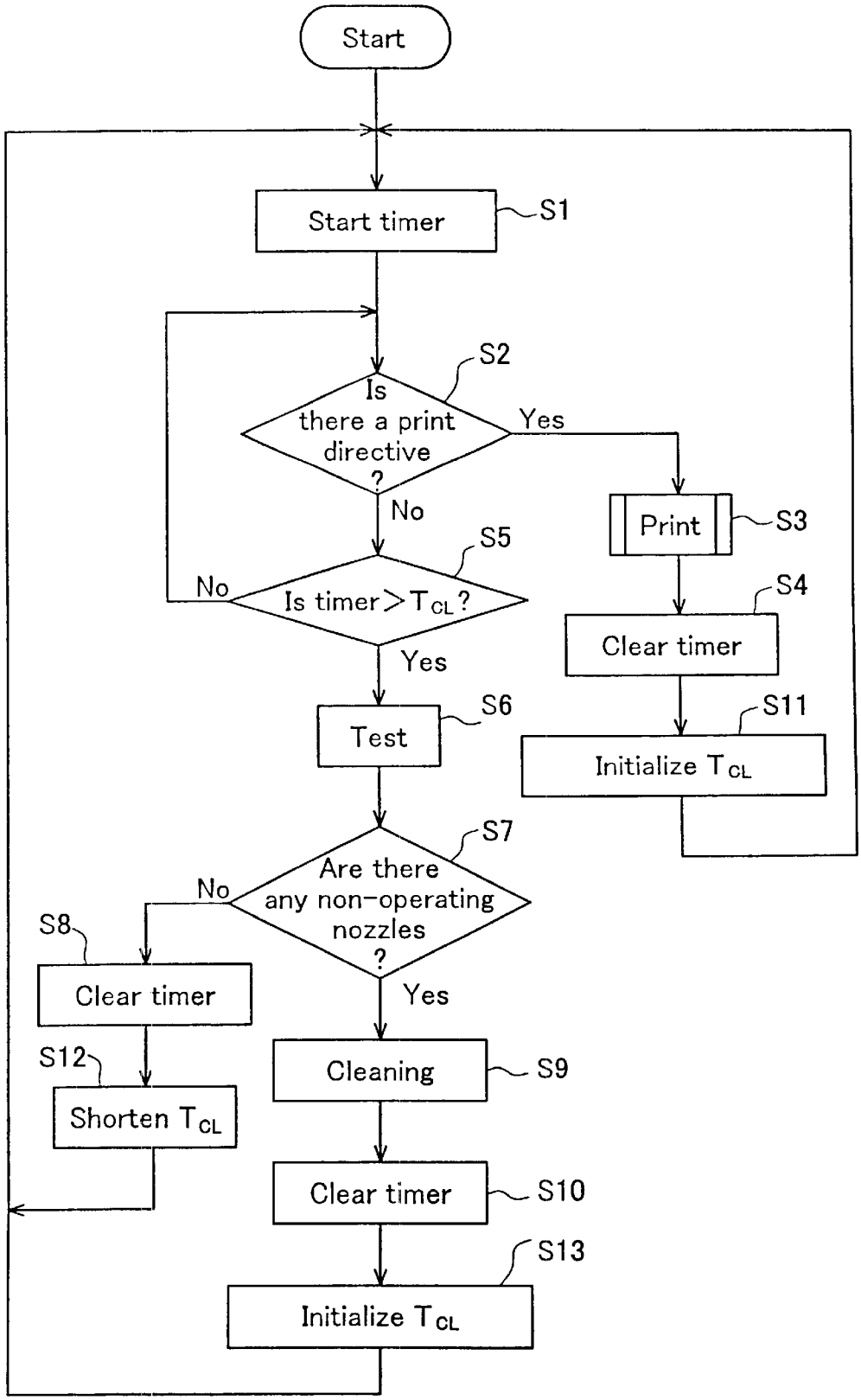
FIG. 10 is a flow chart of the processing procedure in a second example.

FIG. 10 is a flow chart of the processing procedure in a second example. In this procedure, step S12 is added after step S8, step S11 after step S4, and step S13 after step S10 in the procedure in FIG. 9 described above.

In the second example, rather than merely clearing the timer in step S8 when no non-operating nozzles are detected in the nozzle test before cleaning in steps S6 and S7 and cleaning is not performed, the threshold $T_{CL}$ for the elapsed time in step S12 is shortened. Accordingly, when no non-operating nozzles are detected and cleaning is not performed, the time until the next attempt at cleaning (that is, until the nozzles are tested before cleaning in step S6) is shortened.

With this printer, it is surmised that the likelihood of nozzle clogging occurring increases over time. Therefore, if there are no non-operating nozzles and cleaning is canceled as a result of the testing of the nozzles after a specific amount of time has elapsed since printing, it is predicted that the time after this until nozzle clogging occurs (expected value) will be relatively short. Thus, when the same amount of time as before (the initial value of threshold $T_{CL}$) again elapses after cleaning has been canceled as a result of the first test after printing, the time predicted to have already elapsed since clogging occurred (expected value) will be longer than the expected value in the case of the first test.

In this example, however, the threshold $T_{CL}$ for the elapsed time after the cancellation of cleaning is shortened as mentioned above, so clogging can be eliminated soon after it occurs even when it occurs after the cancellation of cleaning. This prevents the clog from becoming worse due to the amount of elapsed time.

Methods for shortening the threshold $T_{CL}$ here include determining a lower limit and reducing the threshold $T_{CL}$ by a specific amount of time, and, again, determining a lower limit and multiplying the threshold $T_{CL}$ by a specific number less than 1.

Meanwhile, the threshold $T_{CL}$ returns to its initial value in step S11 when printing is executed in step S3 via steps S1 and S2 after the threshold $T_{CL}$ has been shortened in step S12, and in step S13 when cleaning is performed in step S9 via steps S1 to S7. Accordingly, once printing or cleaning has been carried out, the time until the next attempt at cleaning will be determined by a threshold suitably set at the outset (the initial value of $T_{CL}$). Thus, there is no unnecessary frequent testing before cleaning on the basis of the shortened threshold $T_{CL}$.

With this second example, the threshold $T_{CL}$ of the elapsed time is shortened if the testing turns up no non-operating nozzles and the cleaning is canceled, but rather than just this, the elapsed time after the replacement of an ink cartridge may be measured separately and the above-mentioned threshold $T_{CL}$ shortened according to the elapsed time since ink cartridge replacement. It is surmised that the ink deteriorates and clogging is more apt to occur as time passes after an ink cartridge replacement, and taking the above approach allows clogging to be cleared soon after it occurs even when some time has elapsed since ink cartridge replacement, and as a result the clog can be prevented from becoming worse.

G. Processing Procedure in the Third Example

Figure 11:
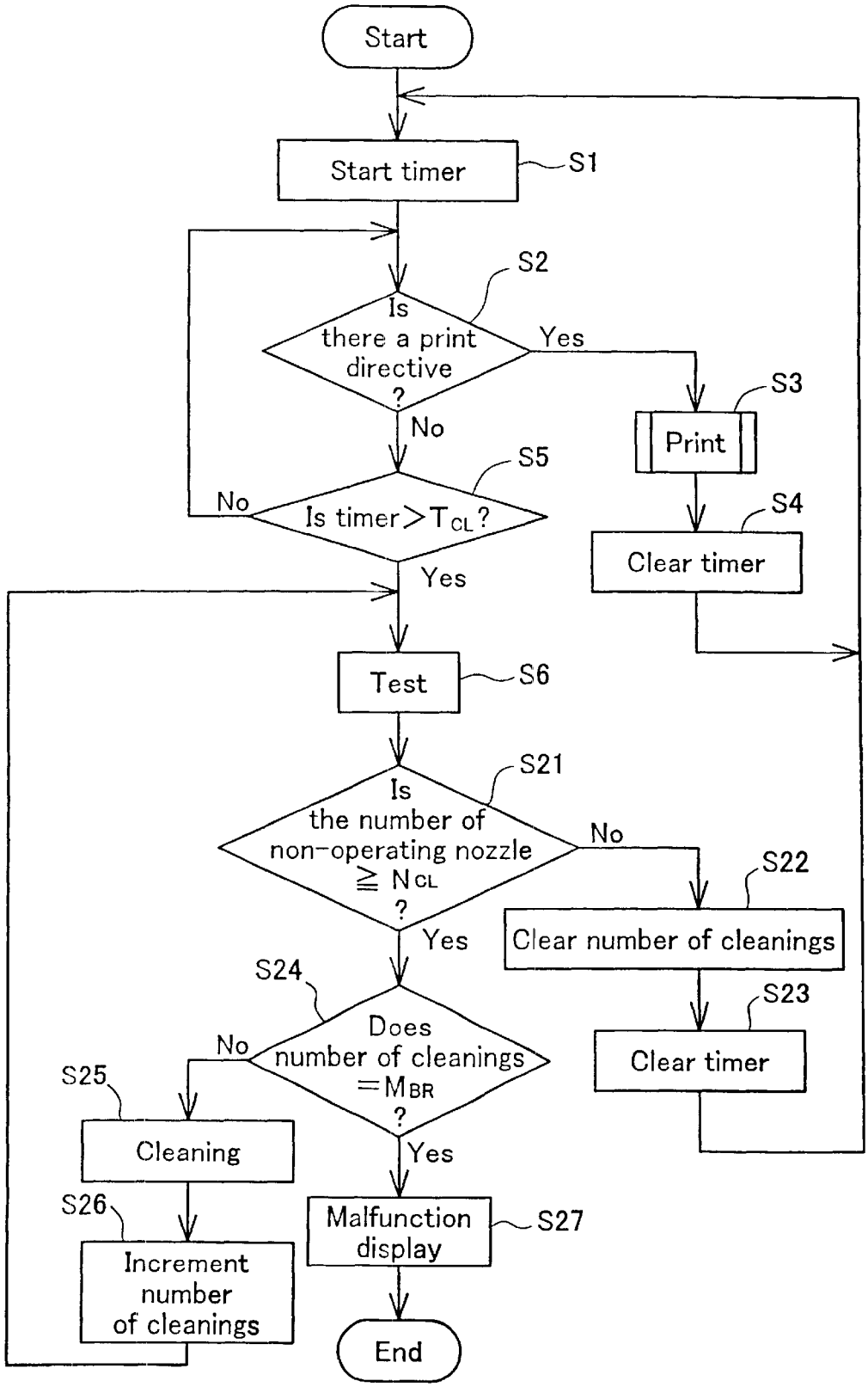
FIG. 11 is a flow chart of the processing procedure in a third example.

FIG. 11 is a flow chart of the processing procedure in a third example. In this procedure, steps S21 to S27 are provided instead of steps S7 to S10 after step S6 in the procedure in FIG. 9 described above.

With the third example, the decision as to whether to perform cleaning after the nozzle test before cleaning (step S6) depends on whether the number of non-operating nozzles is over a threshold $N_{CL}$ (step S21). Specifically, if the number of non-operating nozzles is over the threshold $N_{CL}$ in step 51, cleaning is carried out in step S25 via step S24 (under the condition that the number of cleanings is not the upper limit $M_{HR}$ as discussed below). After cleaning has been performed, the number of cleanings is incremented in step S26, the flow returns to step S6, and the nozzles are tested.

If the number of non-operating nozzles is less than the threshold $N_{CL}$ upon returning to step S6 from step S26, the number of cleanings is cleared in step S22, the timer is cleared in step S23, and the flow returns to step S1.

If the number of non-operating nozzles is equal to or greater than the threshold $N_{CL}$ upon returning to step S6 from step S26, then a decision is made in step S24 as to whether the number of cleanings is a threshold $M_{BR}$. If the number of cleanings is not the threshold $M_{BR}$ (that is, if it is less than $M_{BR}$), cleaning is again performed in step S25, and the flow returns to step S6 via step S26.

If the number of cleanings in step S24 is the threshold $M_{BR}$ (that is, if the cleaning has been repeated $M_{BR}$ times), a malfunction display is performed and the processing is concluded. This malfunction display is performed in the liquid crystal window 73 of the printer 20, as shown in FIG. 3. Specifically, in a case such as this, since the nozzles cannot be kept in good condition by cleaning, the printer 20 awaits remedy by the user while displaying a notice to this effect in the liquid crystal window 73. This malfunction display may be made to flash so as to attract the attention of the user.

In the third example, cleaning is repeated when the nozzles are tested again after being cleaned and the number of non-operating nozzles is at least a specific number. Specifically, the result of cleaning is checked, and the status is managed so that the number of non-operating nozzles is always less than this specific number. Accordingly, even when printing (that is, the ejecting of ink) has not be performed for at least a specific length of time, the nozzles are still kept in good working order at all times, and the nozzles remain ready to print right away even when the printer has not been used for an extended period.

Also in the third example, if the number of non-operating nozzles does not drop below the specific number even after repeated cleaning, the cleaning is canceled, a malfunction display is lit, and remedy by the user is awaited. Accordingly, ink is not wasted by repeating useless cleaning despite no improvement in the condition. When the user is ready to print the next time, he will see the malfunction display and be able to take appropriate measures.

Also in the third example, the decision as to whether to perform cleaning is made depending on whether the number of non-operating nozzles is less than a specific number (that is, whether the number of non-operating nozzles is at or above the threshold $N_{CL}$), and the threshold $N_{CL}$ for the number of non-operating nozzles may be "1." When $N_{CL}$ is "1," just as in the first example (FIG. 9), whether cleaning is executed or not is determined by whether there are any non-operating nozzles. Even if there are some non-operating nozzles, if these can be taken over to a certain extent by other nozzles, or if the presence of a certain number of non-operating nozzles can be tolerated, for instance, then $N_{CL}$ (the "specific number" that is the threshold) can be a value of "2" or higher. If $N_{CL}$ is a relatively large value such as five, then the number of non-operating nozzles can easily be brought to $N_{CL}$ or less by cleaning, so cleaning does not have to be performed as frequently, which saves on ink.

If there is a strong likelihood that cleaning will actually cause nozzle clogging, there is the danger that the number of non-operating nozzles will conversely be increased by cleaning in an attempt to bring the number of non-operating nozzles to $N_{CL}$ or lower. There is also the danger that as a result of repeated cleaning, a malfunction display will appear and the processing will come to an end. However, the above situation will not arise and the system will remain stable if $N_{CL}$ is set to a relatively large value when there is a strong likelihood that nozzle clogging will be caused by cleaning.

Furthermore, with the third example, a malfunction display was lit and processing canceled when the number of non-operating nozzles did not drop below the specified number even after repeated cleaning, but it is also possible to conduct tests at specific intervals even while the malfunction display is on, and to perform cleaning only when the number of non-operating nozzles increases. In this embodiment, if the number of non-operating nozzles cannot be reduced even after cleaning has been repeated the specified number of times, the repetition of cleaning is halted and subsequent increases in these non-operating nozzles are monitored.

H. Processing Procedure in the Fourth Example

Figure 12:
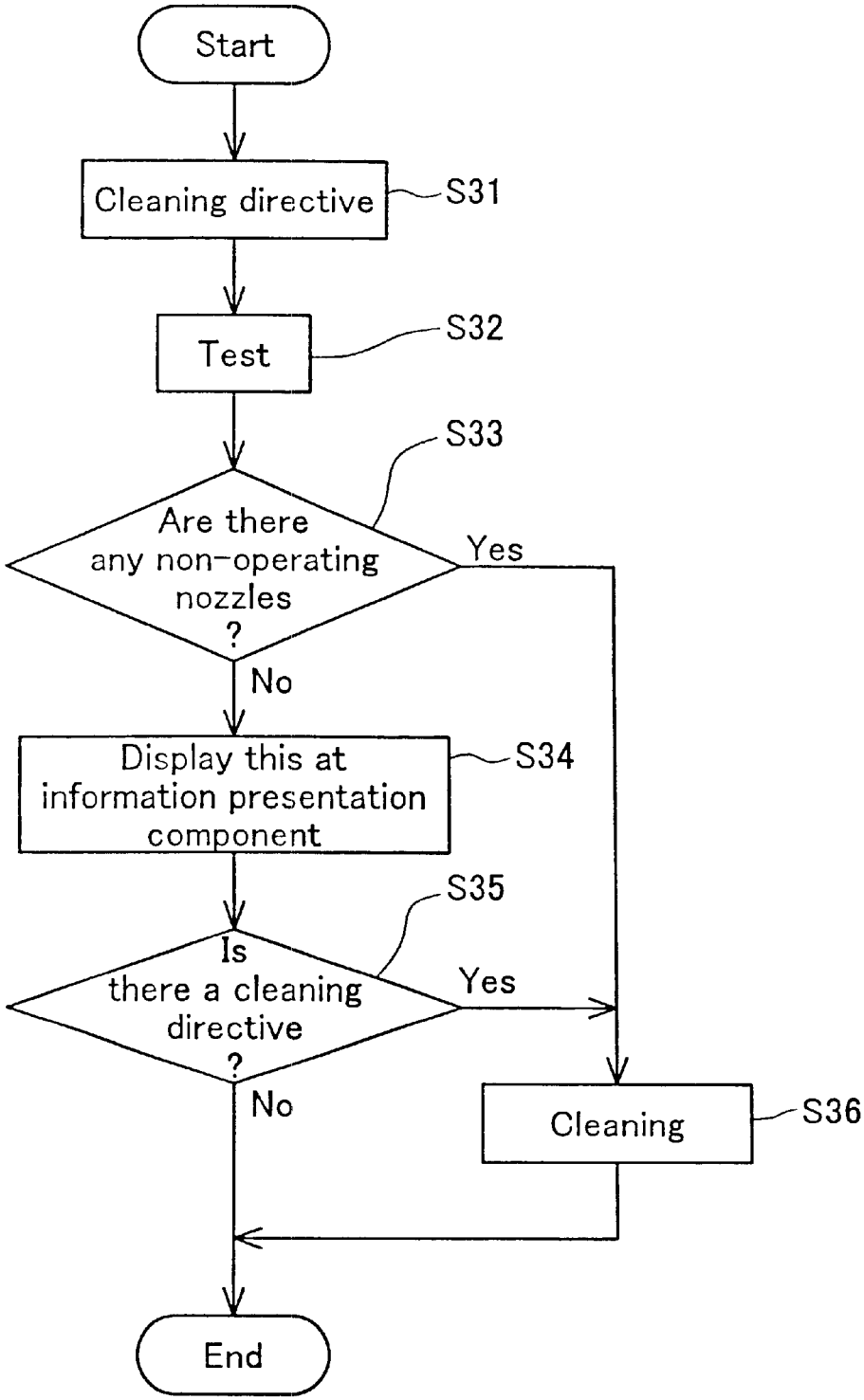
FIG. 12 is a flow chart of the processing procedure in a fourth example.

FIG. 12 is a flow chart of the processing procedure in a fourth example. In the first to third examples given above, nozzle testing was conducted prior to the automatic cleaning of the nozzles when the printer had not been used for a prolonged period, whereas in the fourth example, nozzle testing is conducted prior to cleaning when the user has inputted a cleaning directive.

In this example, the cleaning directive from the user is inputted by pressing the cleaning directive button 72 (FIGS. 3 and 4), but can instead be inputted by operating a keyboard (input device) 120, mouse (input device) 130, or the like of the host computer 100 to which the printer 20 is connected (FIG. 2).

In FIG. 12, if the user issues a cleaning directive in step S31, the printer 20 will automatically conduct a nozzle test in step S32. This nozzle test is the same as in the first to third examples. If it is decided in step S33 that there are non-operating nozzles, then cleaning is carried out in step S36 as directed by the user.

On the other hand, if it is decided in step S33 that there are no non-operating nozzles, then a display to that effect, such as "No clogging," appears in the liquid crystal window 73 (FIGS. 3 and 4). In step S35, the system waits for a specific length of time for a cleaning directive from the user, and cleaning is performed if a directive is again inputted by the user through the cleaning directive button 72 (FIGS. 3 and 4). If no cleaning directive is inputted after waiting for the specified period, or if a print directive is inputted from the host computer 100 without a cleaning directive being inputted, for instance, then processing is concluded without cleaning being performed.

In the fourth example, even when the user issues a cleaning directive, a test of the nozzles is conducted prior to the cleaning, and reconfirmation of the cleaning directive is requested of the user if there are no non-operating nozzles.

Accordingly, if the user opts not to clean the nozzles on the basis of the display, any new clogging and the attendant non-operating nozzles that would otherwise result from cleaning the nozzles in a state in which there are no non-operating nozzles can be prevented.

In this example, the method for outputting the information for reconfirming the cleaning directive was to provide a liquid crystal window to the printer itself and display the information for reconfirming the cleaning directive in this liquid crystal window, but a warning lamp may be used instead of a liquid crystal window. Specifically, any means that allows a reconfirmation of the cleaning directive to be requested of the user can be used in the printer of the present invention.

With an embodiment in which the printer itself is equipped with a liquid crystal window, as in this example, various types of information can be presented according to the results of the test, for instance. Because a liquid crystal window is able to present various types of information, it can double as an output device for presenting other information.

On the other hand, with an embodiment in which the printer is equipped with a warning lamp, the printer can have a simpler construction. Also, a warning lamp has a binary value of either on or off, and even when a single warning lamp shines in a plurality of colors, the display is still simple, with only a few types, and therefore attracts the attention of the user more directly (than an LCD or the like that presents various types of information).

The means which can require a user to reconfirm a cleaning directive can also be one that requires reconfirmation of the directive by sound, such as an amplifier or a speaker. With such an embodiment, no matter which direction the user is facing after a cleaning directive, the request for reconfirmation of the directive can be conveyed as long as the user is within hearing range of the sound.

In one possible embodiment for outputting information for the reconfirmation of the cleaning directive, the host computer to which the printer is connected outputs information for the reconfirmation of the cleaning directive, and this information is displayed via the host computer on a display means (such as a liquid crystal display or a CRT display) connected to that host computer.

For example, when the cleaning directive from the user is inputted through the keyboard 120, mouse 130, or the like of the host computer 100 (FIG. 2), the above-mentioned "display indicating that there are no non-operating nozzles" can be accomplished by the display device 110 of the host computer 100 as shown in FIG. 2. If so, then the user can select to execute cleaning or not by operating the keyboard 120, mouse 130, or other such input device on the basis of this display.

With an embodiment such as this, in which information corresponding to the testing results is inputted and outputted through the host computer, it is possible to present a greater variety of information corresponding to the testing results and in various procedural situations. Also, the user is able to issue various directives to the printer. Furthermore, the display means on the printer side can be eliminated, allowing the printer to be simpler and less expensive.

In this example, the test unit conducts a test according to all directives when a cleaning directive is issued, and requests reconfirmation of the cleaning directive if the number of non-operating nozzles is less than a specific number, but the preferences of the user may be given precedence from the outset by separately providing cleaning directives in an override mode in which there is no testing of the nozzles by the test unit or request for reconfirmation of the cleaning directive. This override mode allows the user to execute cleaning without bothering with operating the printer.

I. Fifth Example

(1) Structure of the Printer

Figure 13:
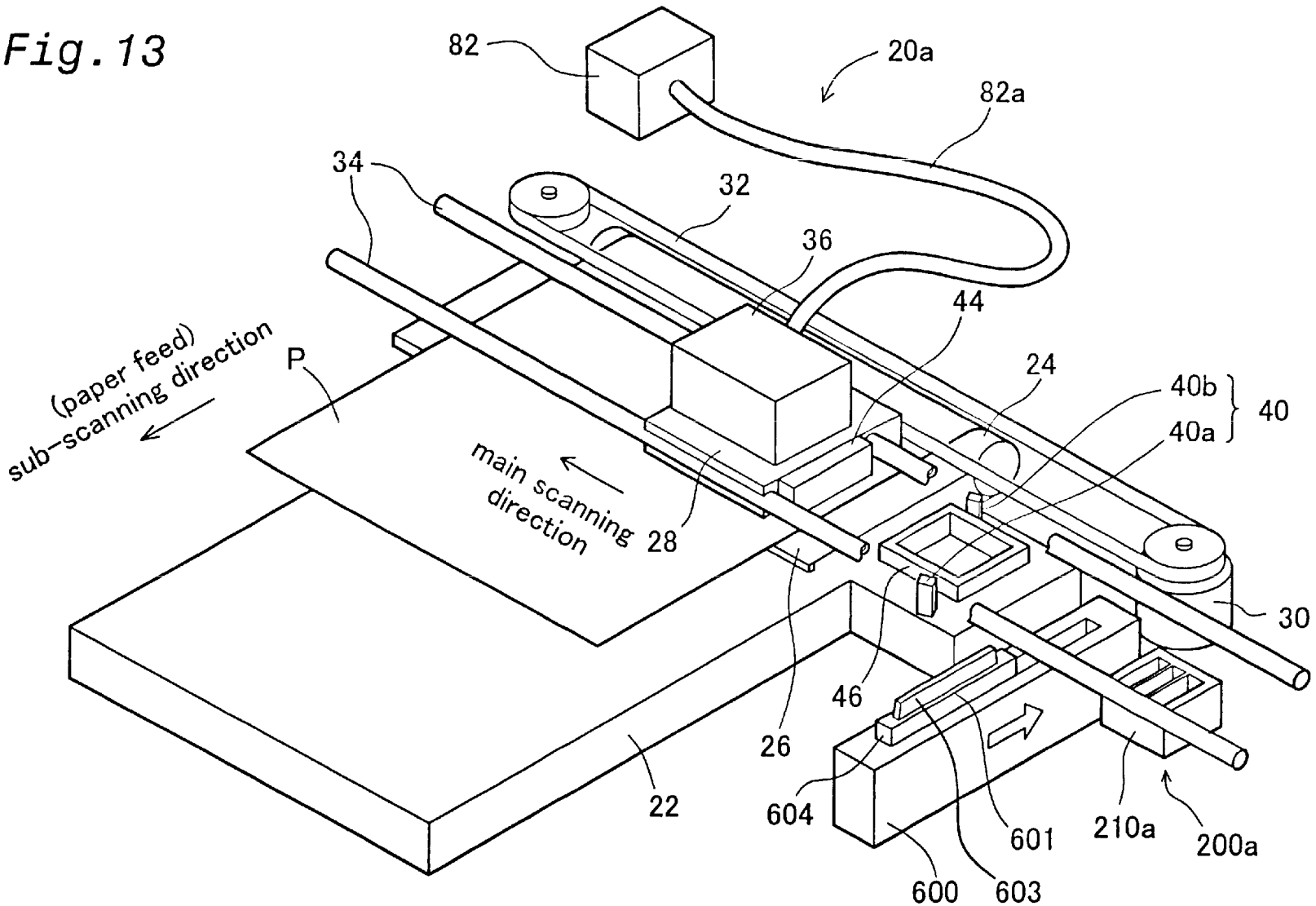
FIG. 13 is a simplified perspective view of the main structure of a color ink jet printer 20*a;*

FIG. 13 is a simplified perspective view of the main structure of a color ink jet printer 20*a* serving as an example of the present invention. This printer 20*a* comprises a waste ink receptacle 46, a relay tank 82, and a nozzle wiper mechanism 600. The second missing dot test unit 42 is not provided. The structure of a cleaning mechanism 200*a* is also different from that of the cleaning mechanism 200 in FIG. 8. Everything else is the same as with the printer 20 in the various examples given above. In FIG. 13, the only part of the cleaning mechanism 200*a* depicted is a head cap 210*a*, and the rest of the structure is not shown.

Figure 14:
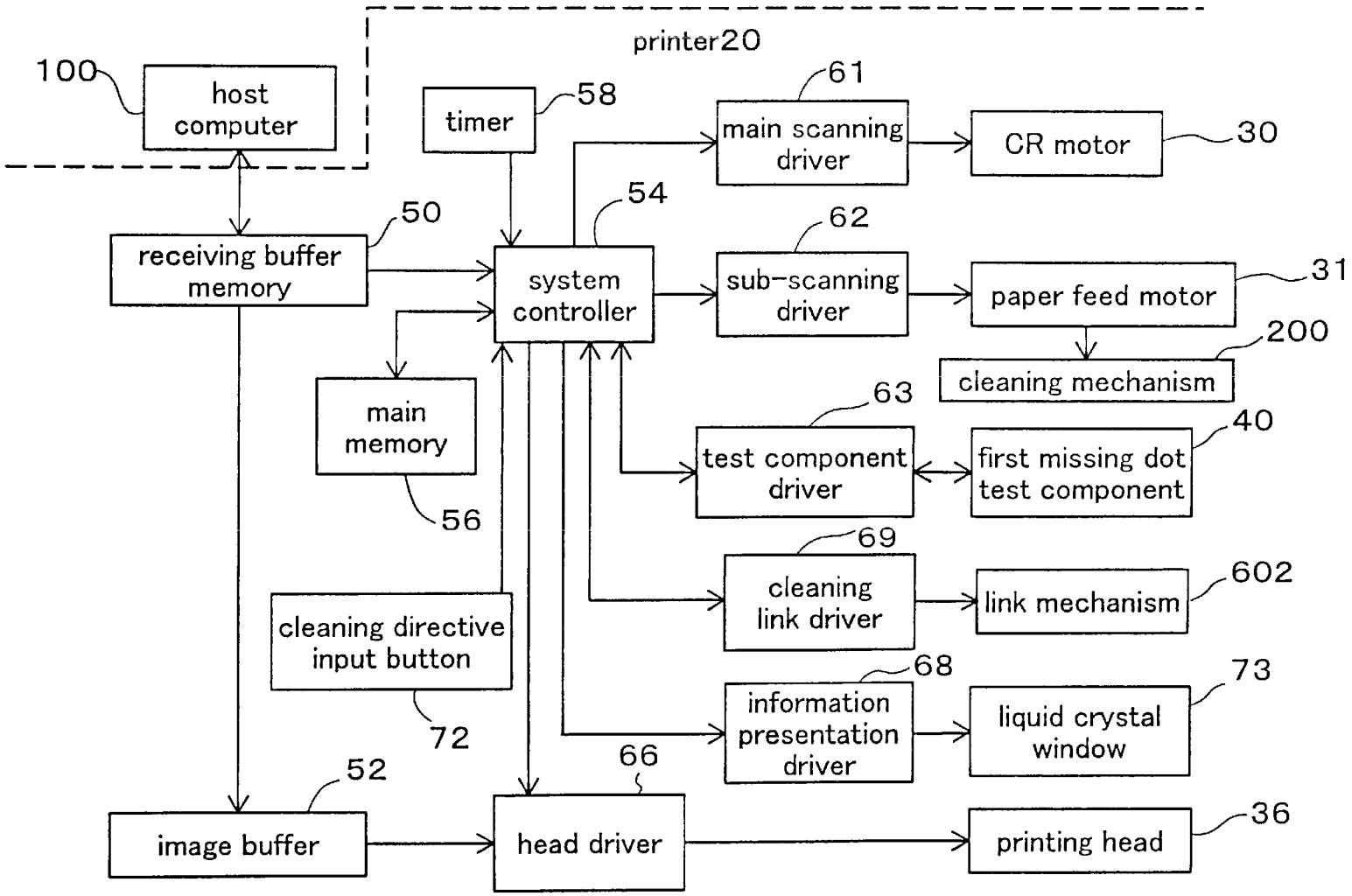
FIG. 14 is a block diagram of the electrical configuration of the printer 20*a;*

FIG. 14 is a block diagram of the electrical configuration of the printer 20*a*. The printer 20*a* is equipped with a cleaning link driver 69 that controls a link mechanism 602 of the nozzle wiper mechanism 600. The test unit driver 64 for driving the second missing dot test unit 42 is not provided. The rest of the structure is the same as that shown in FIG. 4.

The ink receptacle 46 shown in FIG. 13 receives ink droplets ejected from the nozzles in the missing dot test. The bottom of this ink receptacle 46 is lined with felt to prevent the ink droplets from splashing.

The relay tank 82 holds ink supplied from an ink tank (not shown), and supplies this ink to the various nozzles of the printing head 36. The relay tank 82 is connected to the printing head 36 by a tube 82*a*. The relay tank 82 lessens the change in ink pressure within the nozzles that occurs as a result of the printing head 36 moving in the main scanning direction, which makes it possible to print at a stable level of quality.

Figure 15:
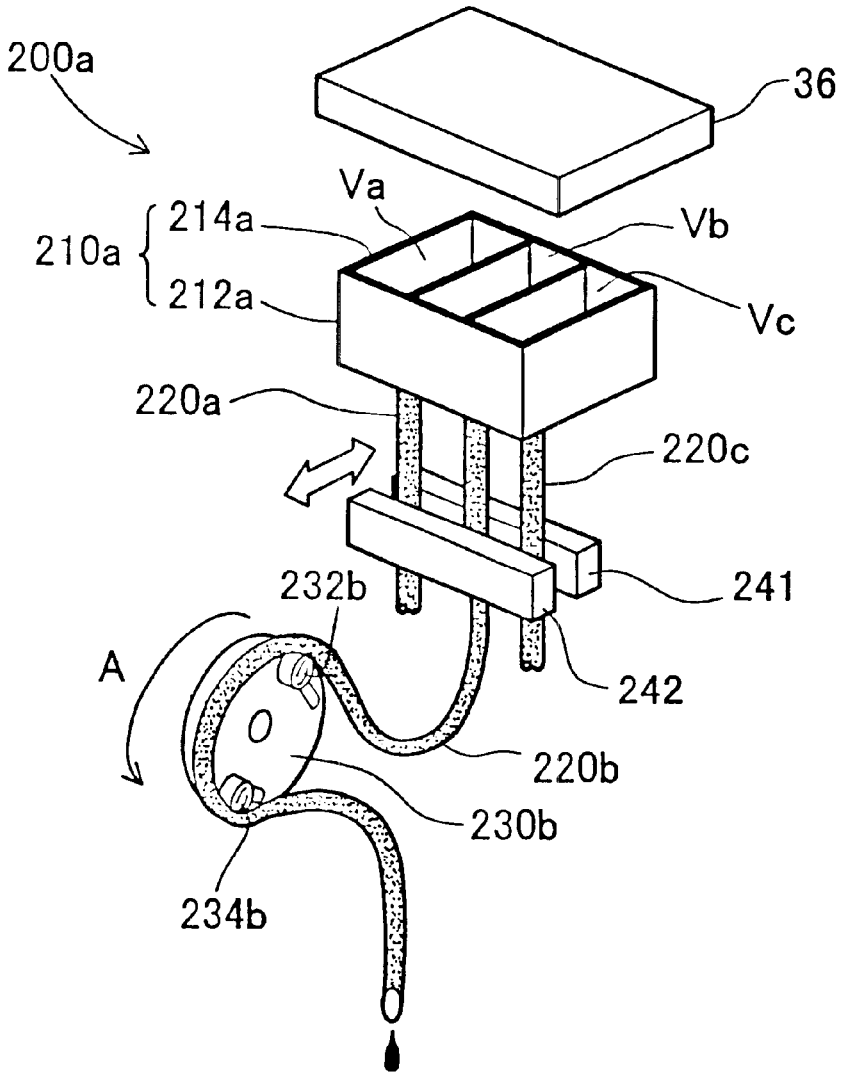
FIG. 15 is a simplified diagram illustrating the structure of a cleaning mechanism 200*a;*

FIG. 15 is a simplified diagram illustrating the structure of a cleaning mechanism 200*a*. The cleaning mechanism 200*a* comprises the head cap 210*a*, hoses 220*a*, 220*b*, and 220*c*, and pump rollers 230*a*, 230*b*, and 230*c*. In FIG. 15, the hoses 220*a* and 220*c* are only partially depicted, and the pump rollers 230*a* and 230*c* are not shown at all. As shown in FIG. 15, the space inside the head cap 210*a* is divided up into three vacuum chambers Va, Vb, and Vc. When the head cap 210*a* rises and fits snugly against the lower surface of the printing head 36, the vacuum chamber Va forms an enclosed space covering the nozzle arrays $K_D$ and $C_D$ (see FIG. 5), the vacuum chamber Vb forms an enclosed space covering the nozzle arrays $C_L$ and $M_D$, and the vacuum chamber Vc forms an enclosed space covering the nozzle arrays $M_L$ and $Y_D$.

The hoses 220*a*, 220*b*, and 220*c* are connected to the vacuum chambers Va, Vb, and Vc, respectively, of the head cap 210*a*. The structure and action of the pump roller 230*a* and the hose 220*a*, the pump roller 230*b* and the hose 220*b*, and the pump roller 230*c* and the hose 220*c* are the same as the structure and action of the pump roller 230 and the hose 220 shown in FIG. 8. With this structure, the nozzle set consisting of the nozzle arrays $K_D$ and $C_D$ the nozzle set consisting of the nozzle arrays $C_L$ and $M_D$, and the nozzle set consisting of the nozzle arrays $M_L$ and $Y_D$ each independently draw out ink by suction. Pinchers 241 and 242 are provided in front and back of the hoses 220*a*, 220*b*, and 220*c*. The pinchers 241 and 242 are provided so that they can open and close as indicated by the two-directional arrow in FIG. 15. Sandwiching the hoses 220*a*, 220*b*, and 220*c* front and back with the pinchers 241 and 242 keeps the suction produced by the pump rollers 230*a*, 230*b*, and 230*c* from reaching the vacuum chambers Va, Vb, and Vc of the head cap 210*a*.

The nozzle wiper mechanism 600 is provided at a location between the first test unit 40 and the cleaning mechanism 200*a* on the right side in FIG. 13. The nozzle wiper mechanism 600 comprises a wiper head 601 equipped with a wiper blade 603 and a wiper support 604, and a link mechanism 602 (not shown) that moves the wiper head 601 in the sub-scanning direction. In a steady state, the wiper head 601 is retracted to a position downstream in the paper feed direction from directly under the guide rails 34, and is sent directly under the guide rails 34 when the printing head is to be wiped. The retraction and advance of the wiper head 601 are both carried out by the link mechanism 602.

The wiper head 601 comprises the wiper blade 603 and the wiper support 604 that supports this wiper blade 603. The wiper blade 603 is a flat elastic body produced by sticking a felt layer to a rubber layer. As shown in FIG. 13, the wiper head 601 is disposed so that the lengthwise direction of the wiper blade 603 is parallel to the sub-scanning direction. This wiper head 601 is oriented so that the side of the wiper blade 603 with the felt layer faces the platen 26 side. This wiper head 601 is sent directly under the guide rails 34 by the link mechanism 602, and when the printing head 36 is positioned above the wiper head 601, the distal end of the wiper head 601 touches nozzle units provided to the lower surface of the printing head 36.

Figure 16A:
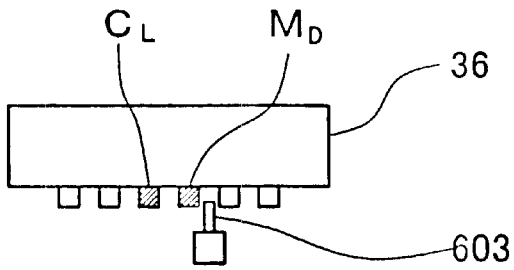
FIGS. 16(A)–(C) illustrate the operation of a printing head 36 in the wiping of nozzle groups $C_L$ and $M_D$ with a wiper blade 603.
Figure 16B:
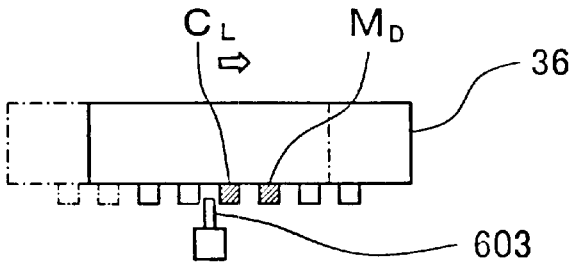

FIG. 16 is a diagram illustrating the operation of the printing head 36 in the wiping of the nozzle groups $C_L$ and $M_D$ with the wiper blade 603. When a cleaning directive is issued from the host computer 100, the system controller 54 sends a directive to the main scanning driver 61 to start the step motor 30 and bring the carriage 28 to a specific position on the nozzle wiper mechanism 600. At this point in time, the wiper head 601 is in its retracted position (see FIG. 13). After this, the system controller 54 sends the wiper head 601 from its retracted position to directly under the guide rails 34 via the cleaning link driver 69 and the link mechanism 602. As a result, the relation between the various nozzle units and the wiper blade 603 is as shown in FIG. 16 (A).

Figure 16C:
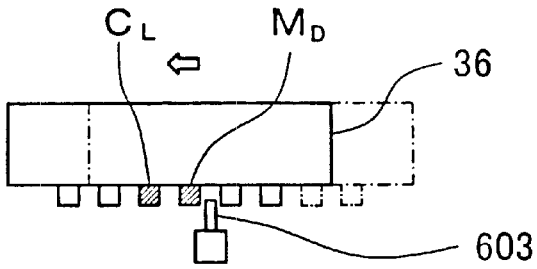

The system controller 54 then sends a directive to the main scanning driver 61 to start the step motor 30 and move the printing head 36 so that the nozzle groups $C_L$ and $M_D$ go back and forth in the main scanning direction flanking the wiper blade 603 as shown in FIG. 16 (B) and FIG. 16(C). The back and forth motion here is at a specific amplitude so that the wiper blade 603 will not hit the left and right nozzle groups $K_D$ and $C_D$, and $M_L$ and $Y_D$. As the printing head 36 passes over the wiper head 601, the distal end of the wiper blade 603 touches the nozzle groups $C_L$ and $M_D$ of the printing head 36, so the nozzle groups $C_L$ and $M_D$ are wiped at the nozzle openings by the wiper blade 603 to remove dirt and so forth. When these operations are finished, the system controller 54 stops the printing head 36, after which the wiper head 601 is retracted from directly under the guide rails 34 to its retracted position (see FIG. 13).

The description here used a case of wiping the nozzle groups $C_L$ and $M_D$ as an example, but the nozzle wiper mechanism 600 can selectively wipe any nozzle group on the printing head 36. Specifically, the printing head 36 should be disposed so that the nozzle group to be wiped will be positioned on either side of the wiper blade 603 in the main scanning direction, and the printing head 36 will be moved back and forth between specific positions on opposite sides of the wiper blade 603. It is preferable here to set the amplitude of the printing head 36 so that the wiper blade 603 will not touch any nozzle group besides the ones being wiped.

(2) Cleaning Sequence

Figure 17:
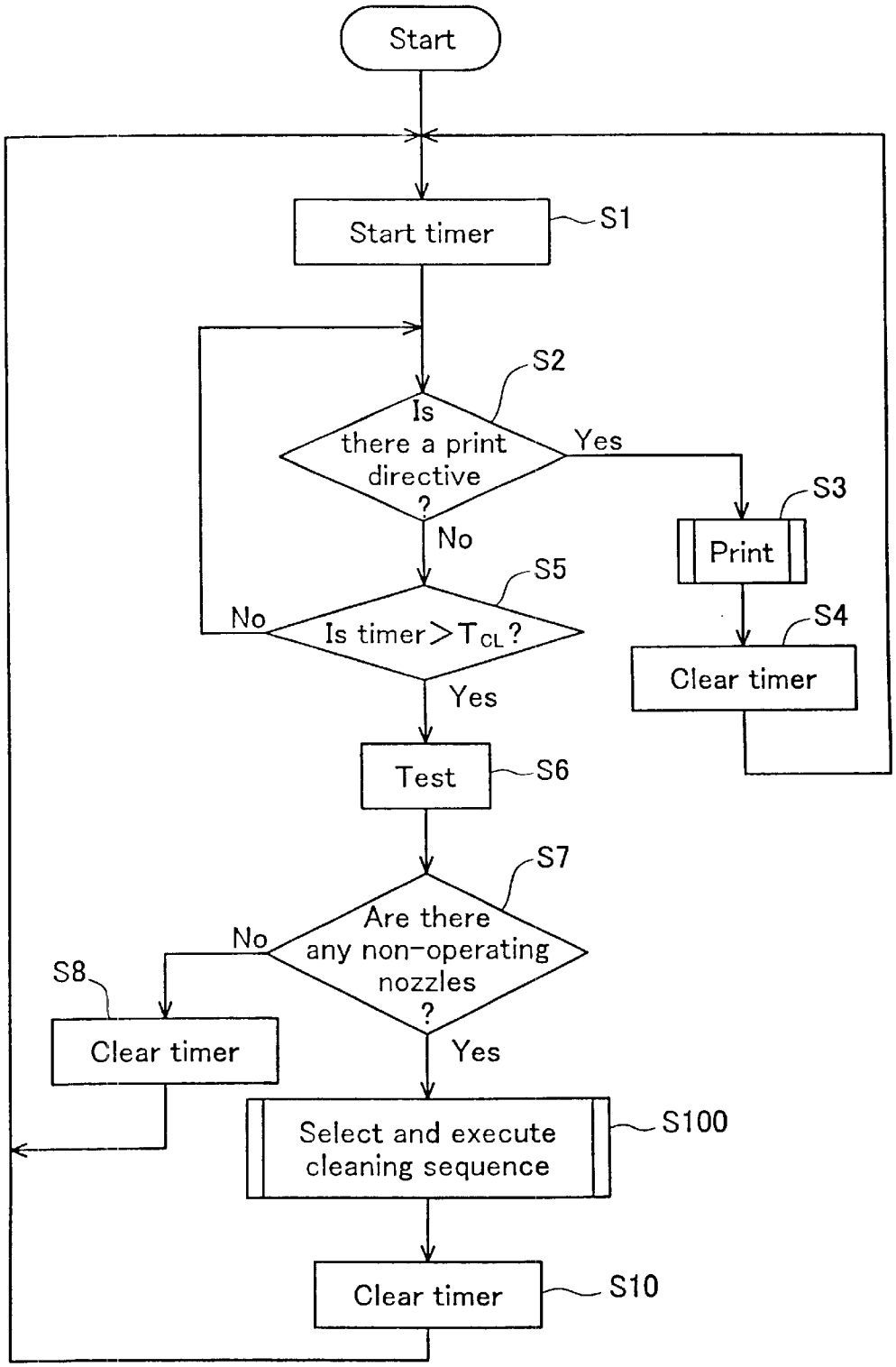
FIG. 17 is a flow chart of the processing procedure in a fifth example.

FIG. 17 is a flow chart of the print processing procedure in a fifth example. The print processing procedure in the fifth example is such that the selection and execution of the cleaning sequence of step S100 are performed instead of the cleaning of step S9 in the first example shown in FIG. 9. Specifically, in the print processing procedure in the fifth example, a cleaning sequence including a plurality of cleaning operations is executed in step S100. Everything else is the same as in the print processing procedure shown in FIG. 9.

Figure 18:
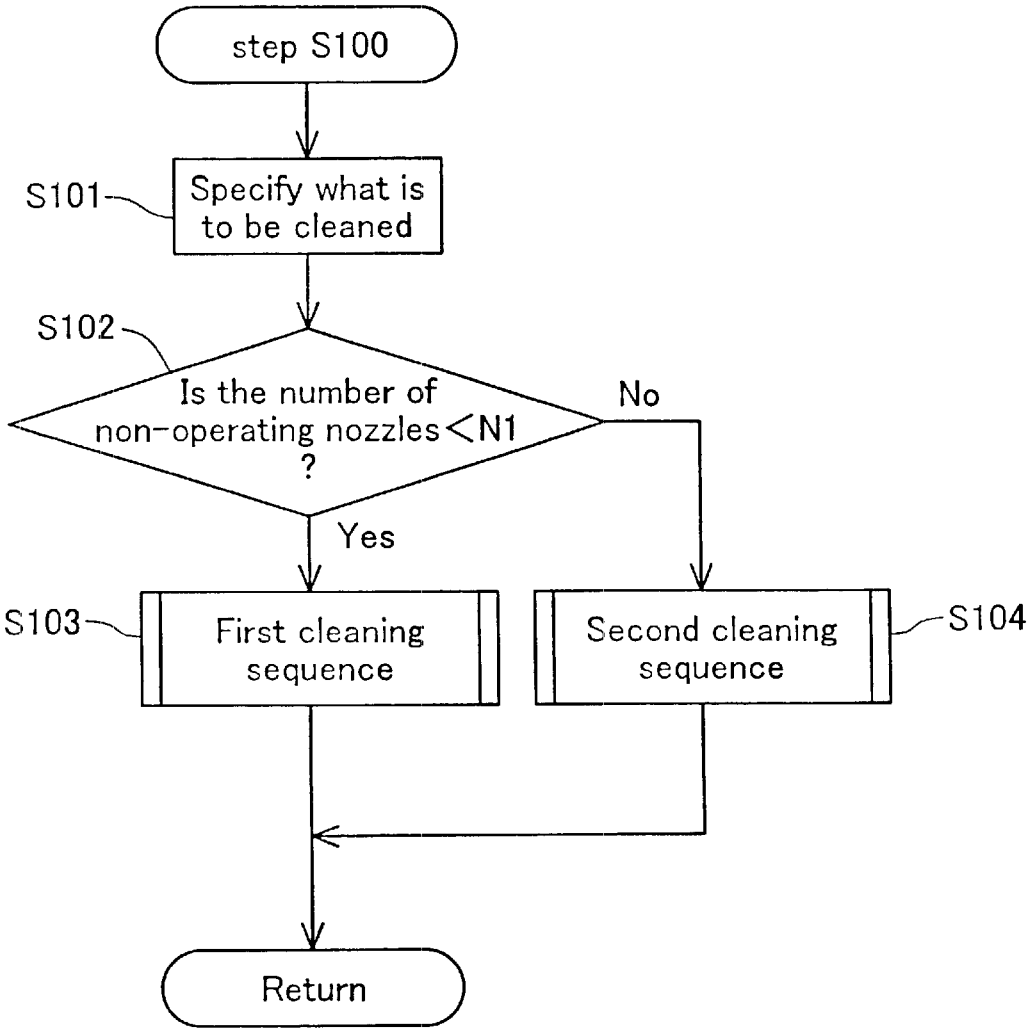
FIG. 18 is a flow chart of the sequence of cleaning in the processing procedure of the fifth example.

FIG. 18 is a flow chart of the sequence of cleaning in the print processing procedure of the fifth example. If a non-operating nozzle is detected in step S7 of FIG. 17, the system controller specifies what is to be cleaned in step S101 of FIG. 18. Specifically, what is to be cleaned is the nozzle group in which a non-operating nozzle was detected. In the fifth example, in determining this, a decision is made as to whether to clean the nozzles in units of the above-mentioned nozzle set, that is, to cancel the cleaning. There are three nozzle sets, a first nozzle set consisting of nozzle groups $K_D$ and $C_D$, a second nozzle set consisting of nozzle groups $C_L$ and $M_D$, and a third nozzle set consisting of nozzle groups $M_L$ and $Y_D$. These nozzle sets are groupings of nozzles in units for which the nozzle wiper mechanism 600 can execute the various cleaning operations individually. In the fifth example, the cleaning mechanism 200*a* performs ink suction in units of nozzle arrays $K_D$ and $C_D$, nozzle arrays $C_L$ and $M_D$, and nozzle arrays $M_L$ and $Y_D$, so the nozzle sets are arranged as above. However, if the individual cleaning operations such as ink suction and nozzle wiping can be performed independently in units of a number of nozzles smaller than the nozzle array units, for instance, then the nozzle sets can be arranged in these units.

After the nozzle set to be cleaned has been designated in step S101, the system controller 54 determines in step S102 whether the number of non-operating nozzles is less than N1. This N1 corresponds to the "second threshold" referred to in the Claims. In the fifth example, the same number of nozzles are included in each of the nozzle sets. Accordingly, determining whether the number of non-operating nozzles is less than N1 in step S102 is essentially determining whether the proportion of non-operating nozzles for each nozzle set is less than the specified threshold. If the number of nozzles included in the various nozzle sets is different, the threshold value used for evaluation may be set to "the proportion of non-operating nozzles with respect to the nozzles in each nozzle set as a whole." In a case such as this, the evaluation is performed by comparing the "product of multiplying the total number of nozzles by this threshold (proportion)) with the "actual number of non-operating nozzles" for each nozzle set.

If the number of non-operating nozzles is less than N1, the system controller 54 executes the first cleaning sequence in step S103. On the other hand, if the number of non-operating nozzles is equal to or greater than N1, the second cleaning sequence is executed in step S104.

Figure 19:
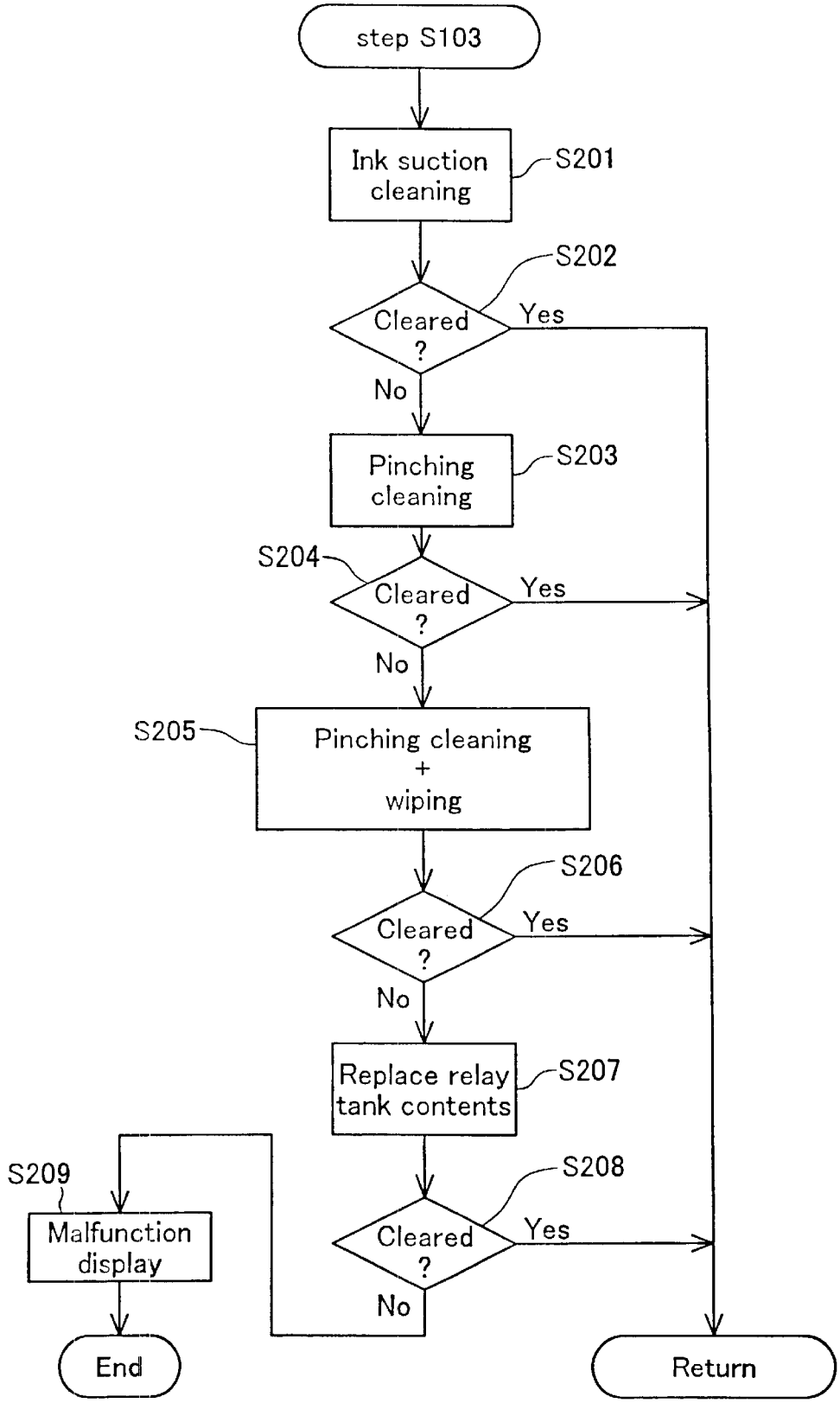
FIG. 19 is a flow chart of the first cleaning sequence.

FIG. 19 is a flow chart of the first cleaning sequence. In the first cleaning sequence in step S103 (see FIG. 18), first of all, ink suction is performed by the cleaning mechanism

200*a* in step S201. The only pump roller driven here is the one corresponding to the nozzle set that is to be cleaned in step S101 in FIG. 18. The same applies in subsequent step S203, S205, and S207 in which the pump rollers are driven. The ink suction in this step S201 corresponds to the "first cleaning operation" referred to in the Claims. After this, in step S202 a decision is made using the first missing dot test unit 40 as to whether there are any non-operating nozzles. If there are not, that is, if the nozzle clogging has been cleared, then the flow moves to step S10 in FIG. 17 and the timer is cleared. If there is a non-operating nozzle, the flow moves to step S203.

In step S203, the system controller 54 drives the pump rollers 230*a*, 230*b*, and 230*c* for a specific length of time with the pinchers 241 and 242 (see FIG. 15) closed. At this stage the suction has not been transmitted to the vacuum chambers Va, Vb, and Vc of the head cap 210*a*. After this, the pinchers 241 and 242 are released to transmit the suction produced by the pump rollers 230*a*, 230*b*, and 230*c* to the vacuum chambers Va, Vb, and Vc. Since the release of the pinchers 241 and 242 causes the suction to be suddenly transmitted to the vacuum chambers Va, Vb, and Vc, the ink suction (pinching cleaning) in this step S203 clears nozzle clogging better than the ink suction in step S201. The ink suction (pinching cleaning) in this step S203 corresponds to the "second cleaning operation" referred to in the Claims.

After this, in step S204 shown in FIG. 19, a decision is made as to whether there are any non-operating nozzles just as in step S202, and if there are no non-operating nozzles, that is, if the clogging has been cleared, the flow moves to step S10 in FIG. 17, and the timer is cleared. If there is a non-operating nozzle, the flow moves to step S205. Pinching cleaning and nozzle wiping are performed in step S205. The details of the pinching cleaning in step S205 are the same as those of the pinching cleaning in step S203. The nozzle wiping involves using the nozzle wiper mechanism 600 to wipe off the nozzles. In step S205, wiping is performed selectively, for only the nozzle groups of the nozzle set to be cleaned in step S101 of FIG. 18. In the cleaning operation of step S205, wiping is also performed in addition to the rapid ink suction produced by the pinchers 241 and 242, so nozzle clogging is cleared better than with the ink suction in step S203. After this, in step S206, a decision is made as to whether there are any non-operating nozzles just as in steps S202 and S204, and if there are none, that is, if the nozzle clogging has been cleared, the flow moves to step S10 in FIG. 17, and the timer is cleared. If there is a non-operating nozzle, the flow moves to step S207.

In step S207, the cleaning mechanism 200*a* is used to draw the ink out of the nozzles by suction. Here, ink suction is performed for a longer time than in step S201, and all of the ink in the relay tank 82 (see FIG. 13) is drawn out and replaced. Because the suction lasts longer in step S207, the cleaning operation in step S207 clears nozzle clogging better than the ink suction in steps S201 and S203 or the wiping in step S205.

After this, a decision is made in step S208 as to whether there are any non-operating nozzles just as in steps S202, S204, and S206, and if there are no non-operating nozzles, that is, if the nozzle clogging has been cleared, the flow moves to step S10 in FIG. 17, and the timer is cleared. If there is a non-operating nozzle, the flow moves to step S209. In step S209, the malfunction display of the liquid crystal window 73 (see FIG. 3) is turned on and the processing is concluded.

Figure 20:
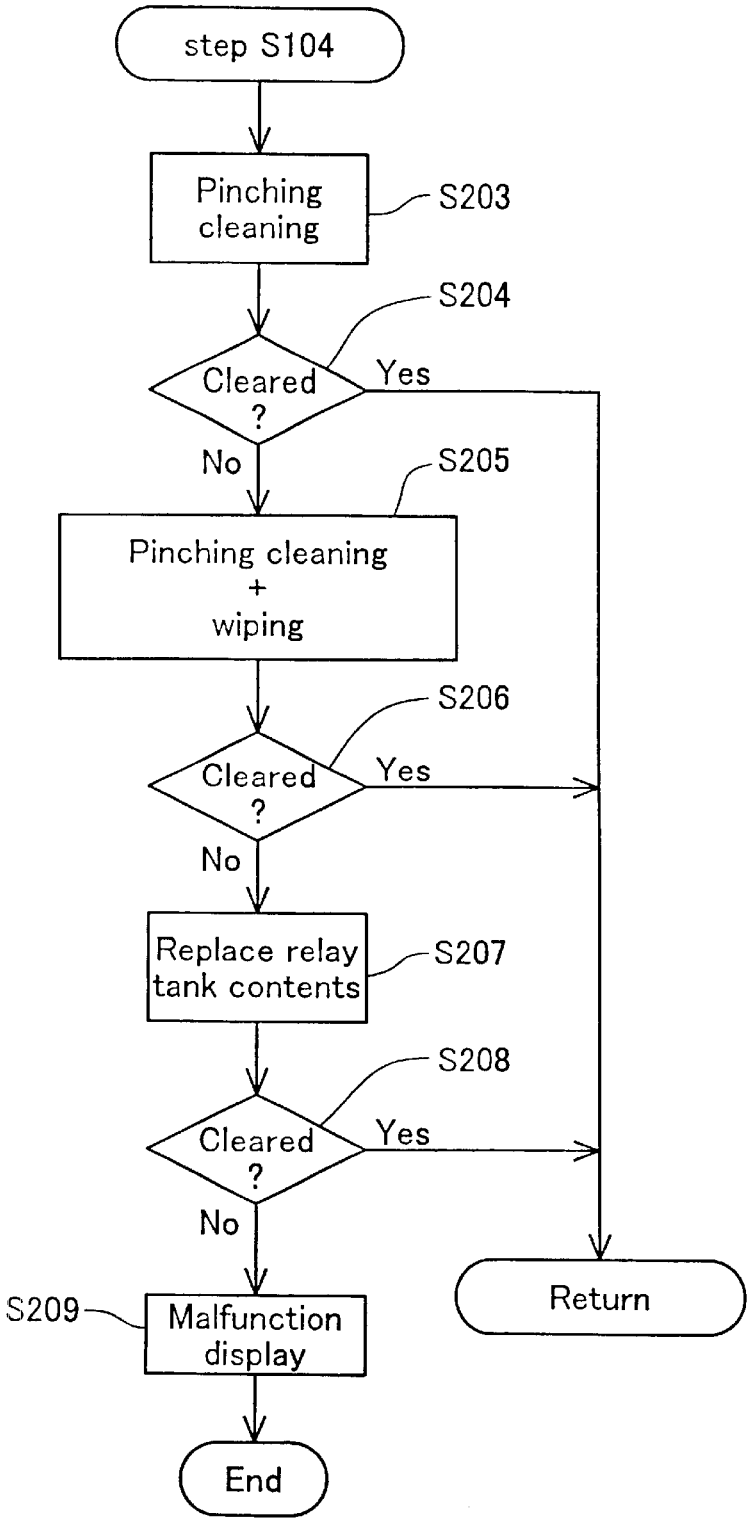
FIG. 20 is a flow chart of the second cleaning sequence.

FIG. 20 is a flow chart of the second cleaning sequence (see FIG. 18). The second cleaning sequence does not include the procedure of steps S201 and S202 in the first cleaning sequence (see FIG. 19). Also, the cleaning operation of step S203 is carried out right from the start. The details of the procedure after step S203 in the second cleaning sequence are the same as after step S203 in the first cleaning sequence. Thus, when it is determined that the number of non-operating nozzles is equal to or greater than N1 in step S102 of FIG. 18, steps S201 and S202 (see FIG. 19) are skipped, and the steps of the cleaning sequence such as S203 and S205 are carried out.

(3) Effect of the Fifth Example

In the fifth example, it is possible to carry out a cleaning operation for every nozzle set, and the nozzle set to be cleaned in step S101 is selected. No cleaning is performed for nozzle sets in which there are no non-operating nozzles. Accordingly, no ink is wasted by being drawn from the nozzles by suction.

Also, in the fifth example the cleaning of the nozzles is done in a sequence that includes a plurality of cleaning operations. A nozzle test is conducted in between each cleaning operation, and the cleaning is concluded at the point when there are no more non-operating nozzles. Thus, no time is spent or ink consumed performing unnecessary cleaning.

Furthermore, since cleaning operations with a higher likelihood of clearing the nozzle clogging are performed later, there is a greater probability that the clogging will be cleared as the sequence proceeds. Also, since the cleaning operations that consume a larger quantity of ink, such as S207, are positioned later in the sequence, no unnecessarily forceful cleaning is performed or ink wasted from the start.

If, as a result of a test, a large number of nozzles are found to be clogged, it is less likely that the clogging of all the nozzles will be cleared by ink suction alone, as in step S201. In the fifth example, if the number of non-operating nozzles is at least a specific number, then the cleaning operation of step S201 is not performed in the second cleaning sequence, and the cleaning operations that are more likely to clear the nozzle clogging in step S203 and beyond are carried out. Thus, no ink is consumed by performing cleaning that is less likely to clear all of the clogging. Also, in the fifth example, the second cleaning sequence omits the first cleaning operation (step S201) of the first cleaning sequence. The number of omitted cleaning operations is not limited to one, though, and a plurality of cleaning operations may instead be skipped and the sequence executed from a later cleaning operation, such as step S205 or S207.

J. Sixth Example (1) Cleaning Sequence

Figure 21:
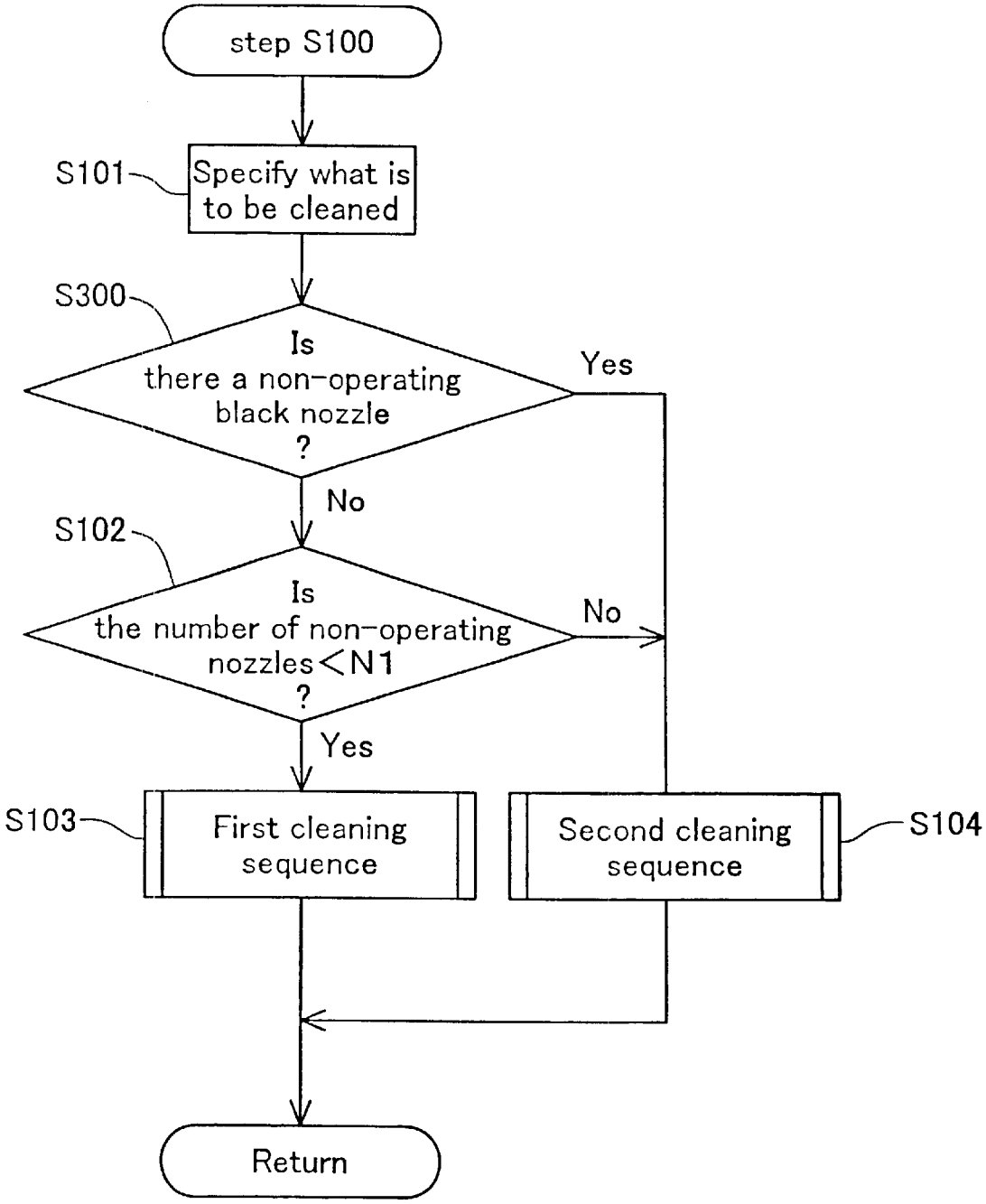
FIG. 21 is a flow chart of the sequence of cleaning in the processing procedure in a sixth example.

FIG. 21 is a flow chart of the sequence of cleaning in the processing procedure in a sixth example. In the sixth example, out of the steps in the fifth example shown in FIG. 17, only the cleaning sequence of step S100 differs in content from the fifth example, and the rest of the steps are the same as in the fifth example. In the sixth example, after the nozzle set to be cleaned has been designated in step S101, the system controller 54 determines in step S300 whether there is a black nozzle among the non-operating nozzles. If there is a black nozzle, step S104 is executed. If there is no black nozzle, then a decision is made in step S102 as to whether the number of non-operating nozzles is less than N1. The procedure in the subsequent steps S102 to S104 is the same as in the fifth example.

(2) Effect of the Sixth Example

A nozzle clogged with black ink is more difficult to clear than a nozzle clogged with an ink of another color. Thus, it is less likely that the clogging will be cleared with just ink suction (see FIG. 19) as in step S201 of the first cleaning sequence. In the sixth example, the second cleaning sequence is carried out when there is a black nozzle among the non-operating nozzles. Specifically, the cleaning operations of step S203 and beyond (see FIG. 20) are carried out without performing the cleaning operation of step S201. Thus, no ink is consumed performing cleaning with little likelihood of clearing the clog. The nozzle group $K_D$ corresponds to the "second nozzle group" referred to in the Claims, while the other nozzle group corresponds to the "first nozzle group" referred to in the Claims.

In the sixth example, if the non-operating nozzles include a nozzle from the second nozzle group, then the second cleaning sequence is executed, the first cleaning operation (step S201) of the first cleaning sequence is skipped, and the cleaning sequence is carried out from the cleaning operation of step S203, which is the second cleaning operation. The number of omitted cleaning operations is not limited to one, though, and a plurality of cleaning operations may instead be skipped and the sequence executed from a later cleaning operation, such as step S205 or S207.

(3) Variation on the Sixth Example

FIG. 22 is a block diagram of the data in a main memory in an embodiment in which the cleaning sequence is determined for each nozzle set. In the fifth and sixth examples, whether to execute the cleaning was decided for each nozzle set, but the contents of the cleaning sequence may also be determined for each nozzle set. In this case, the cleaning operations performed for each nozzle set are determined in step S101, and as shown in FIG. 22, the nozzle set to be cleaned in the cleaning operation for each step is stored in the main memory 56. The system controller 54 carries out each cleaning operation while referring to the data of FIG. 22 in each step.

In FIG. 22, a cleaning operation marked with an x is not performed for a nozzle set, and the nozzle set is subjected to the first cleaning operation marked with a O in the sequence. For instance, with the first nozzle set, the cleaning operation is performed from step S203 in FIG. 19. For the second nozzle group, the cleaning operation is performed from step S201 in FIG. 19. For the third nozzle group, the cleaning operation is again performed from step S203. In the evaluation of whether there are any non-operating nozzles, which is performed in between the cleaning operations (steps S202, S204, and S206 in FIG. 19), no subsequent cleaning operations are carried out (even if marked with a O in FIG. 22) if it is found that there are no non-operating nozzles. With this embodiment, an appropriate cleaning sequence can be carried out according to the situation with each cleaning set.

The evaluation as to whether the nozzle clogging has been cleared (steps S202, S204, and S206 in FIG. 19) is also preferably performed in cleaning set units. With this embodiment, no unnecessary cleaning operations will be performed on nozzle sets containing no non-operating nozzles.

K. Processing Procedure in the Seventh Example

K1. Processing Procedure

Figure 23:
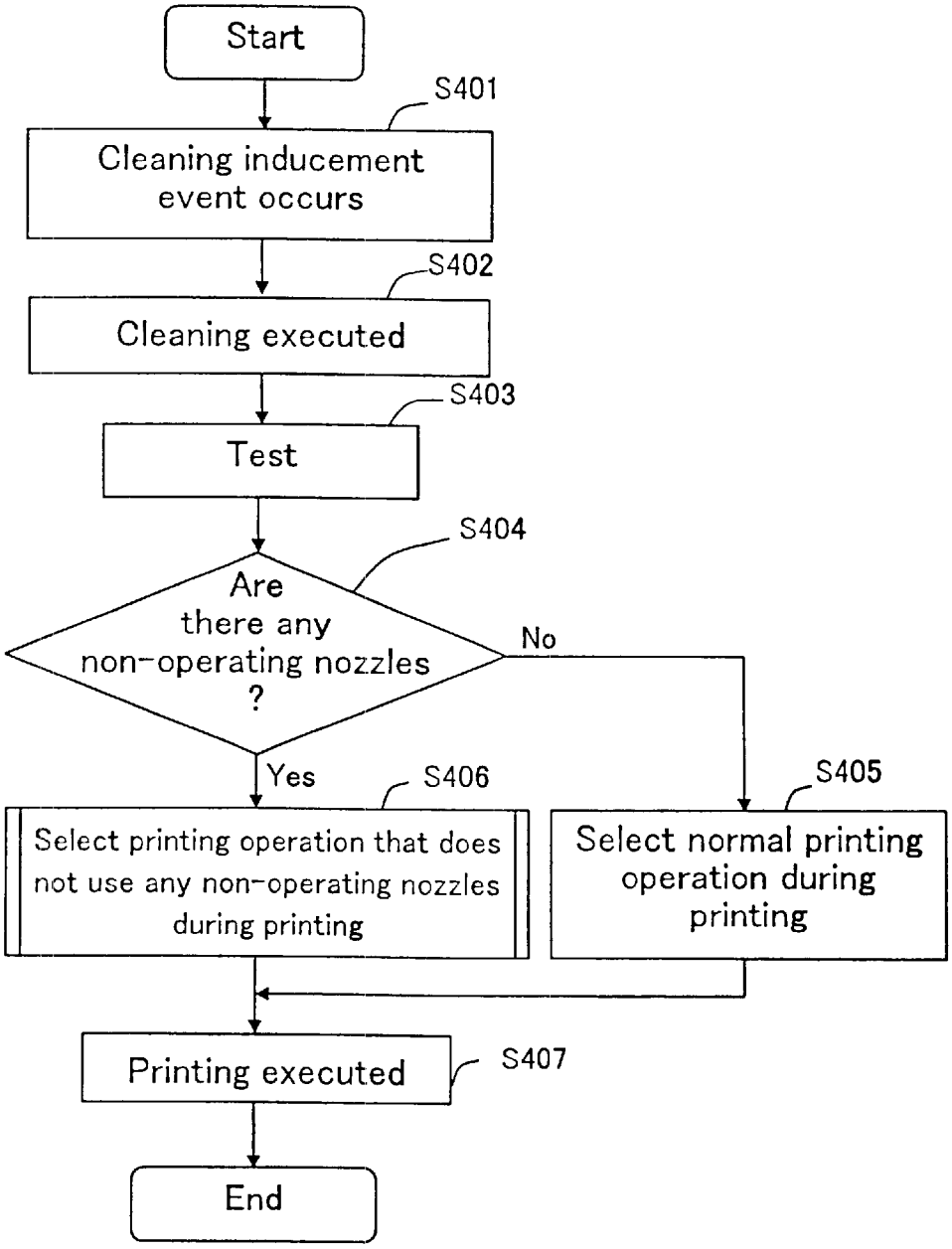
FIG. 23 is a flow chart of the processing procedure in a seventh example.

FIG. 23 is a flow chart of the processing procedure in a seventh example. This seventh example involves conducting the nozzle test after cleaning. If a cleaning inducement event occurs in step S401, the printer 20 automatically executes the processing of steps S402 to S404. As discussed above, a cleaning inducement event includes three scenarios: user operation, disuse of the printer for an extended period (no ink ejecting for an extended period), and replacement of the ink cartridge.

In step S402, nozzle cleaning is performed using the cleaning mechanism 200 (FIG. 7). In step S403, a test for nozzle clogging is conducted for all six colors using the first missing dot test unit 40. In the following description, the first missing dot test unit 40 is used unless otherwise specified, but it is also possible to use the second missing dot test unit 42 instead.

If it is decided in step S404 that there are no non-operating nozzles (that is, clogged nozzles), then the processing of step S405 is executed during subsequent printing. In step S405, a normal printing operation is selected when a print command has been received from the computer 100, and printing is performed in step S407.

On the other hand, if it is decided in step S404 that there is a non-operating nozzle, then the processing of step S406 is executed during subsequent printing. In step S406, a printing operation that does not make use of the non-operating nozzles is selected when a print command has been received from the computer 100, and printing is performed in step S407.

Figure 24:
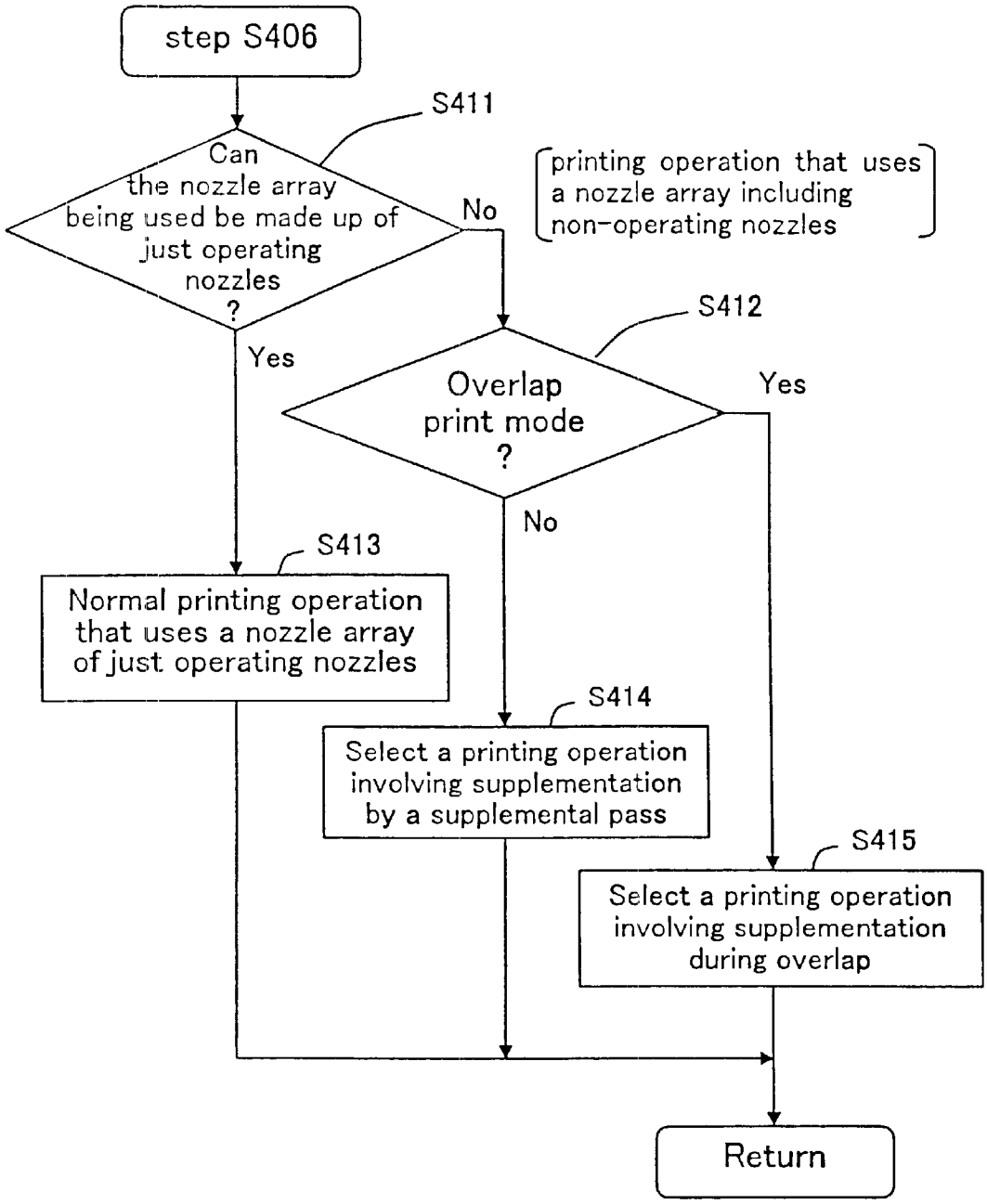
FIG. 24 is a flow chart of the detailed procedure in step S406.

FIG. 24 is a flow chart of the detailed procedure in step S406. A decision is made in step S411 as to whether the nozzle array being used is made up solely of operating nozzles. Not all of the nozzles of a nozzle group are always used during printing, and depending on the print mode, a plurality of nozzles may be selected and used from each nozzle group. The "nozzle array being used" means the nozzle array that is actually used in the printing operation out of the nozzle group for each ink.

Figure 25A:
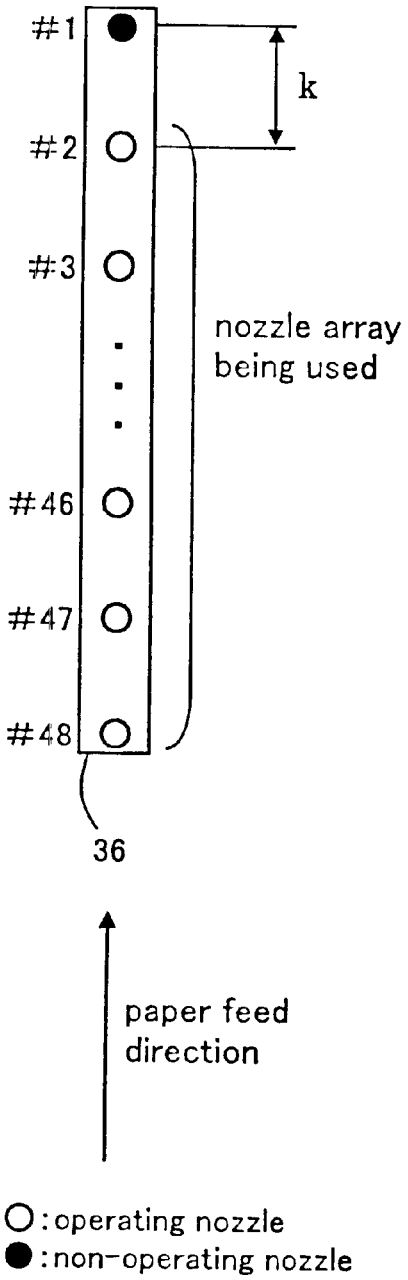
FIGS. 25(A) and 25(B) illustrate cases in which the nozzle array being used can and cannot be made up of the operating nozzles.
Figure 25B:
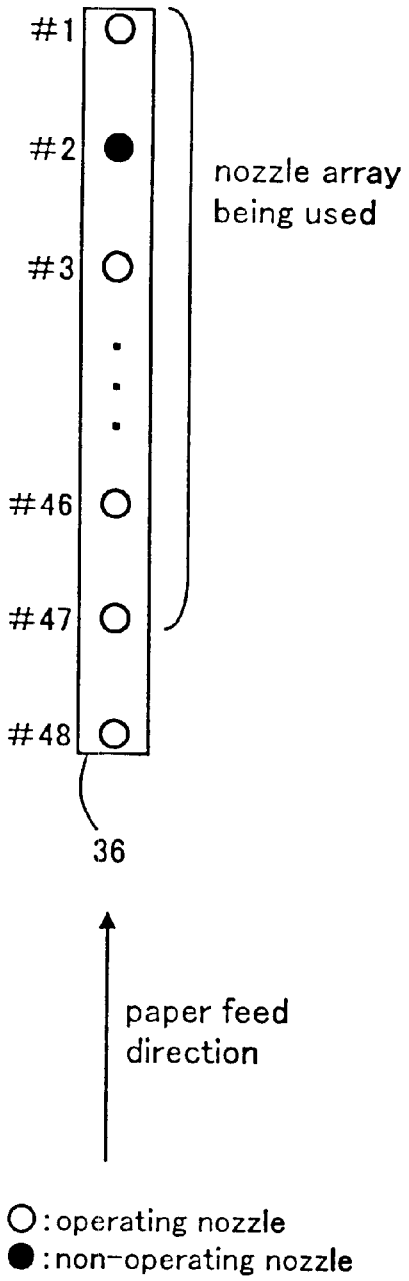

FIG. 25(A) illustrates a case in which the nozzle array being used can be made up of just operating nozzles, and FIG. 25(B) illustrates a case in which the nozzle array being used cannot be made up of just operating nozzles. Let us assume here that the nozzle group of one color of the printing head 36 has 48 nozzles, #1 to #48. The nozzle array being used is assumed to be made up of 47 nozzles arranged at a specific nozzle pitch k. The white circles indicate operating nozzles (nozzles with no clogging), while the black circles indicate non-operating nozzles (nozzles with clogging).

As shown in FIG. 25(A), when the nozzle array being used can be made up of just operating nozzles, it is determined that a normal printing operation can be performed using this nozzle array (steps S411 and S413 in FIG. 24). When a plurality of nozzle arrays for different inks are provided to the printing head 36 as in the example in FIG. 5, it is preferable if the nozzle array being used can be made up of operating nozzles in the same positions in relation to the various inks (for example, nozzles #2 to #48 in FIG. 25(A)). Put another way, when the nozzle array being used cannot be made up of operating nozzles in the same positions in relation to the various inks, it is determined that "the nozzle array being used cannot be made up of just operating nozzles."

As shown in FIG. 25(B), when the nozzle array being used cannot be made up of just operating nozzles, a printing operation is performed using this nozzle array including non-operating nozzles. In this case, a supplemental operation is performed in which pixel positions that non-operating nozzles are supposed to record are recorded using other operating nozzles, but this supplemental operation will vary depending on whether the print mode is an overlap print mode. In view of this, a decision is made in step S412 in FIG. 24 as to whether the print mode is an overlap print mode, and if it is not an overlap print mode, a printing operation involving supplementation by a supplemental pass is selected (step S414). Meanwhile, if it is an overlap print mode, a printing operation involving supplementation during overlap is selected (step S415). The details of steps S414 and S415 will be discussed below.

Thus, in this example, when nozzle cleaning is performed due to the occurrence of a cleaning inducement event, a nozzle test is automatically conducted after this cleaning. As a result, it is possible to reliably detect the nozzle clogging that is likely to occur due to cleaning. Also, when a clogged nozzle is detected by this nozzle test, a printing operation is selected so that the occurrence of missing dots due to non-operating nozzles will be prevented in the execution of subsequent printing. Therefore, even if cleaning leads to the clogging of nozzles, it is possible to reduce the deterioration in image quality that would otherwise result from this.

K2. Printing Operation Involving a Supplemental Pass

FIG. 26 consists of diagrams illustrating examples of a supplemental operation involving a supplemental pass (step S414 in FIG. 24). One main scan during a printing operation is called a "pass." In the case of two-way printing, scanning back and forth one time constitutes a single pass, and a scan of a backward path one time is also a single pass. A pass that is added for the purpose of supplementation is called a "supplemental pass."

Figure 26A:
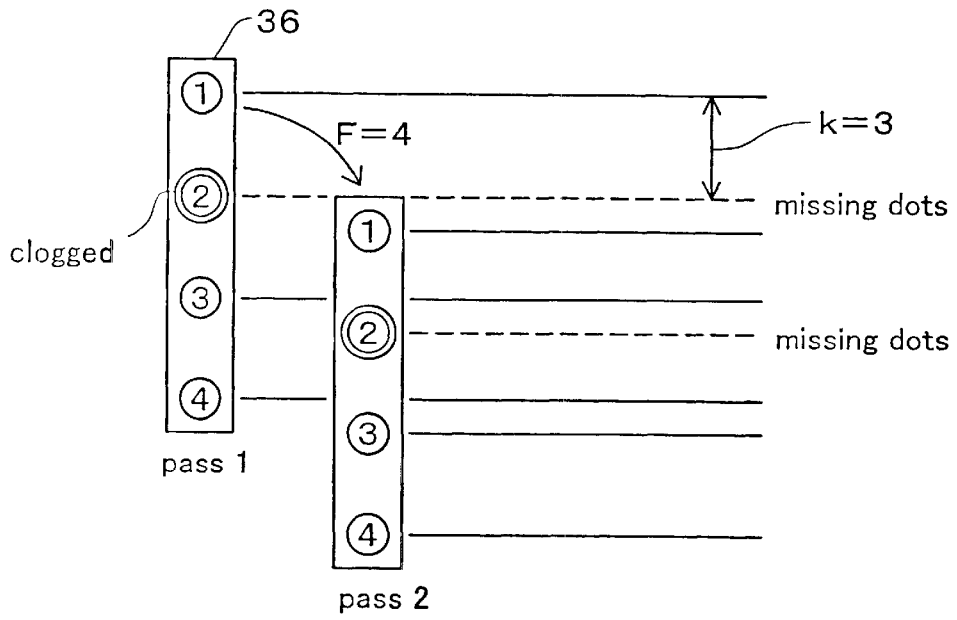
FIGS. 26(A) and 26(B) illustrate a printing operation involving a supplemental pass.

In FIG. 26, for the sake of simplicity, it is assumed that the printing head 36 has only four nozzles, and that the second nozzle is a non-operating nozzle (a nozzle that has become clogged), and the rest of the nozzles are operating nozzles (nozzles that have not become clogged). The nozzle pitch k is 3 dots, and the sub-scanning feed is assumed to be at a constant feed amount F of 4 dots. FIG. 26(A) depicts a normal printing operation when no supplementation is performed. Here, because the second nozzle is clogged, dots cannot be recorded on the raster line indicated by the dashed line in the printing of pass 1. Unless a supplemental operation is performed, the printing of each pass will be successively performed with no dots formed on this raster line.

Figure 26B:
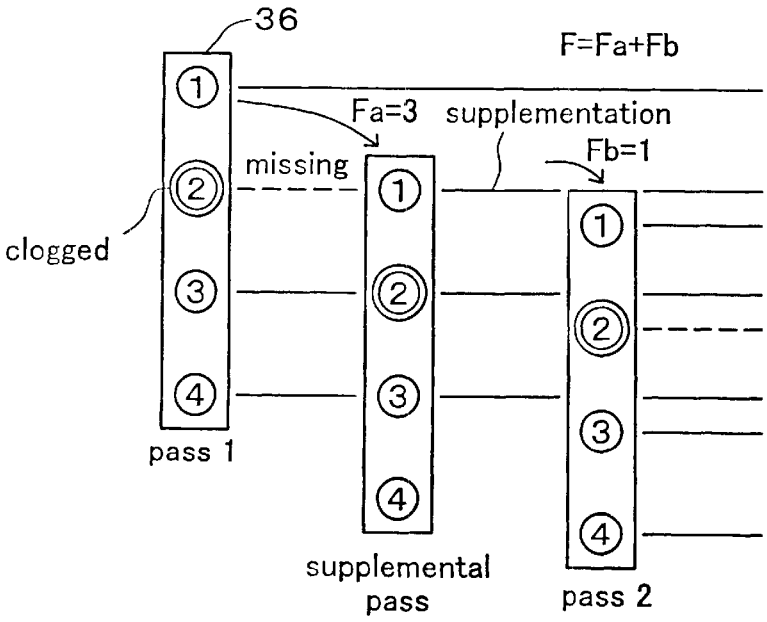

FIG. 26(B) depicts a printing operation involving supplementation by a supplemental pass. The missing dots in the printing of pass 1 occur in the same place as in FIG. 26(A). In the testing of step S403 in FIG. 23, however, it was detected that the second nozzle is a non-operating nozzle, so it is recognized that there are missing dots on the raster line indicated by the dashed line. In view of this, after pass 1, sub-scanning feed is first performed by a transient feed amount Fa to position the other operating nozzles over the raster line (indicated by dashed line) where dots were missing in pass 1. In the example in FIG. 26(B), the first nozzle is positioned over the raster line where dots are missing by setting the transient sub-scan feed amount Fa to 3 dots. One supplemental pass of printing is performed in this state, and recording on the raster line where dots are missing is performed using the first nozzle. In order to perform this supplemental operation, the print data of pass 1 is held in the image buffer 52 (FIG. 4) after the printing of pass 1 has been executed, and the above-mentioned supplemental operation is performed by utilizing the print data for the raster line where dots are missing from among this stored data.

Just the recording of dots on the raster line where dots are missing may be carried out in this supplemental pass, but the recording of dots on other raster lines may be carried out at the same time. Specifically, in the supplemental pass, the recording of dots on at least one raster line including at least the raster line where dots are missing may be carried out once more. Nevertheless, if just the dots on the raster line where dots are missing are recorded, then extra dots will not need to be printed on the raster lines that were printed normally, which is advantageous in that higher image quality can be attained. Another advantage is that this conserves ink.

When the supplemental pass is complete, sub-scanning feed is performed by a transient feed amount Fb to move the printing head 36 to the proper position for the next pass of a normal printing operation (that is, pass 2). The feed amount Fb of the sub-scanning feed performed after the supplemental pass is set so that the sum (Fa+Fb) with the first transient feed amount Fa will be equal to the feed amount F in a normal printing operation. "The feed amount F in a normal printing operation" means the correct feed amount when there are no missing dots. The feed amount F in a normal printing operation is also sometimes set to a different value for each pass. If the same feed amount as in the normal one-time sub-scanning feed can be achieved when two transient sub-scanning feeds before and after a supplemental pass are thus combined, then the printing head 36 can be properly positioned for the next pass of a normal printing operation. Therefore, there is no change in the overall printing operation, and missing dots can be easily compensated for. The above-mentioned supplemental operation is controlled by the system controller 54.

Figure 27A:
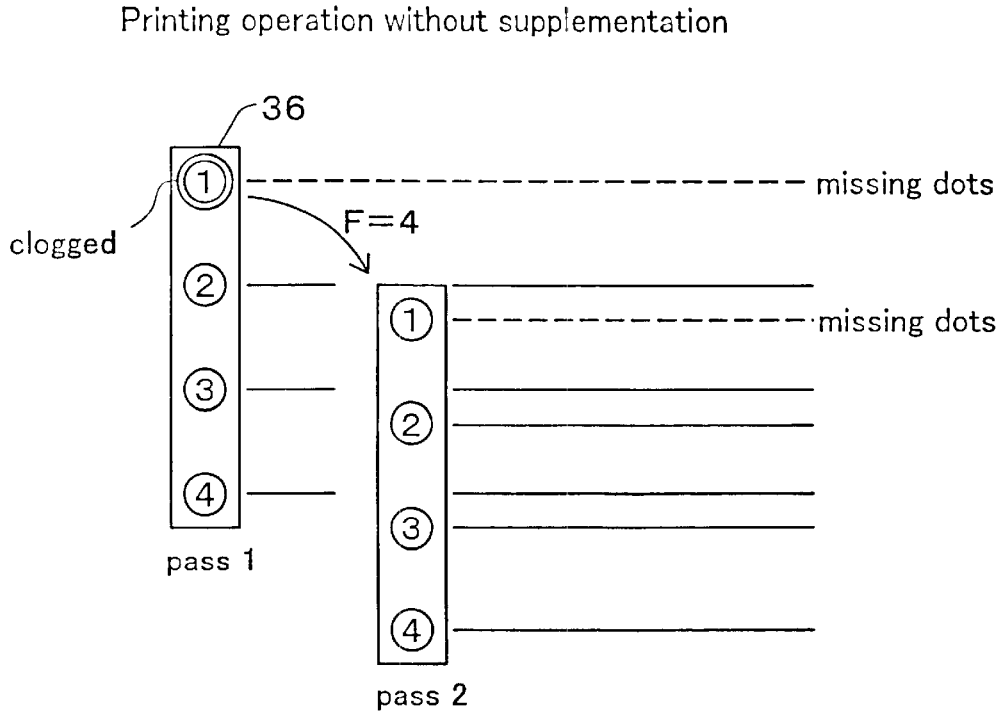
FIGS. 27(A) and 27(B) illustrate a printing operation involving a supplemental pass.
Figure 27B:
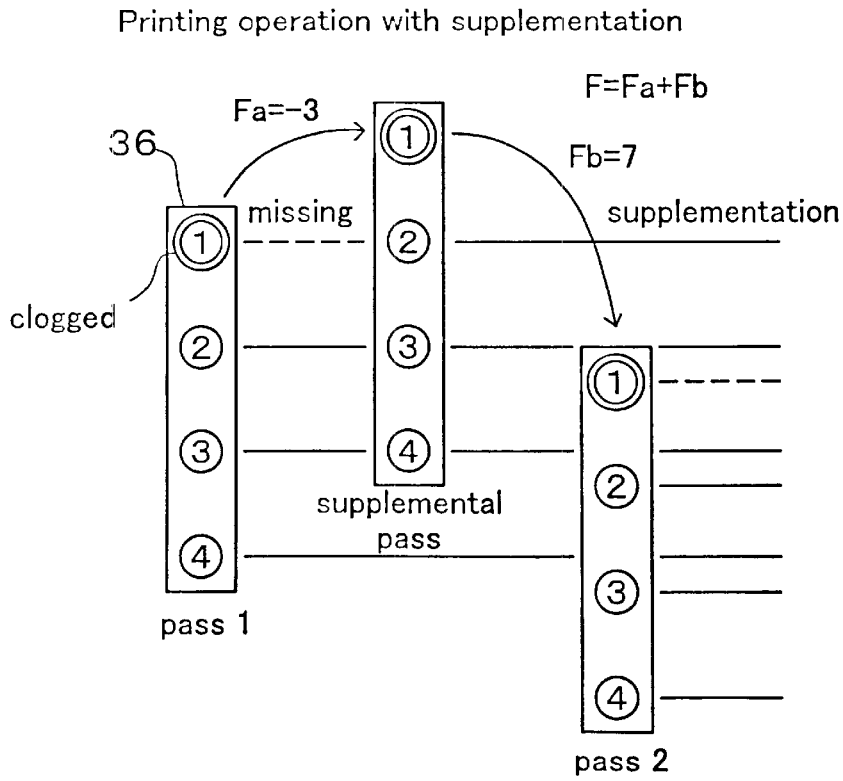

FIG. 27 consists of diagrams of a printing operation involving a supplemental pass. In FIG. 27, the first nozzle is a non-operating nozzle, and the rest of the nozzles are operating nozzles. FIG. 27(A) depicts the printing operation when there is no supplementation, and FIG. 27(B) when there is supplementation. In this example, the first nozzle, which is a non-operating nozzle, is at the very rear in the sub-scanning direction (paper feed direction), so even if a positive value is set as the first transient feed amount Fa, another operating nozzle cannot be positioned over the raster line where dots are missing. In view of this, the first transient feed amount Fa is set to a negative value (−3 dots in the example in FIG. 26(B)), and the second nozzle, which is another operating nozzle, is positioned over the raster line where dots are missing. The second transient feed amount Fb after the completion of the supplemental pass is set so that the sum (Fa+Fb) with the first transient feed amount Fa will be equal to the normal feed amount F, just as in FIG. 26.

In the case of the above-mentioned FIG. 26, it is also possible to set the first transient feed amount Fa to a negative value just as in FIG. 27. However, a sub-scanning feed in which the feed amount is negative (also called "back feed") can include a relatively large feed error through the effect of backlash of the sub-scanning feed mechanism. Because a large feed error diminishes image quality, it is preferable to employ positive values for the transient feed amounts Fa and Fb if at all possible.

Thus, when the nozzle array being used includes a non-operating nozzle, it is still possible to print a high-quality image with no missing dots by adding a supplemental pass and compensating for the missing dots by using another operating nozzle in this supplemental pass.

K3. Printing Operation Involving Supplementation during Overlap

Figure 28:
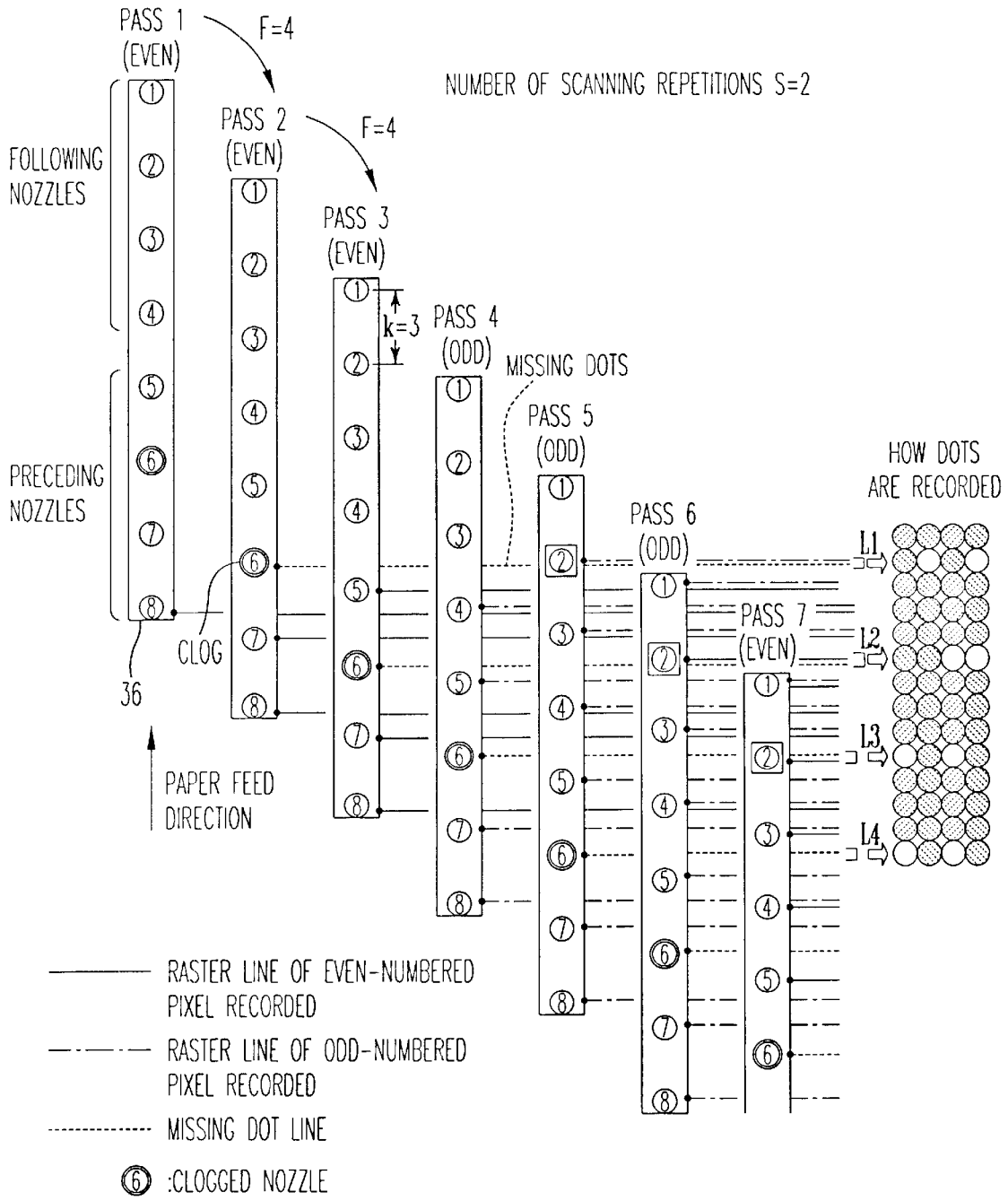
FIG. 28 is a diagram of a normal printing operation in overlap print mode.

FIG. 28 is a diagram of a normal printing operation in overlap print mode. Here, "normal printing operation" means print processing in which no supplemental processing is performed. In FIG. 28, for the sake of simplicity, we will assume that print processing is performed using eight nozzles of the printing head 36. The numbers in circles in the figure are nozzle numbers. The numbers in double circles indicate that this nozzle is a non-operating nozzle (a clogged nozzle). In this example, the sixth nozzle is a non-operating nozzle, and the rest of the nozzles are kept as operating nozzles (nozzles that are not clogged). The nozzle pitch k in the sub-scanning direction is 3 dots.

The number of scanning repetitions s in this overlap print mode is 2. As mentioned above, the "number of scanning repetitions" is the number of times a main scan is executed in order to record all the pixel positions on a single raster line. Specifically, in this example, all the pixel positions on each raster line are to be recorded in two main scans.

In the normal printing operation in FIG. 28, three passes in which even-numbered pixel positions are recorded are alternately executed with three passes in which odd-numbered pixel positions are recorded. Even-numbered pixel positions are recorded from pass 1 to pass 3, and odd-numbered pixel positions are recorded from pass 4 to pass 6. The raster line recorded by the nozzles on a pass when the even-numbered pixel positions are recorded is a solid line, while the raster line recorded by the nozzles on a pass when the odd-numbered pixel positions are recorded is a broken line. The raster line assigned to the non-operating nozzle on a pass (that is, the raster line with missing dots) is a dashed line. Therefore, a single raster line with no missing dots is achieved by two lines: one solid and one broken.

The right side in FIG. 28 indicates the recording state of the dots on each raster line. The white circles indicate missing dot pixel positions, while the circles filled in with slanted lines indicate recordable pixel positions. For instance, on the raster line L1, the sixth nozzle on pass 2 is responsible for recording the even-numbered pixel positions and the second nozzle on pass 5 is responsible for recording the odd-numbered pixel positions, but since the sixth nozzle is not operating, the even-numbered pixel positions of raster line L1 are not recorded, resulting in missing dots. Similarly with raster lines L2, L3, L4, and so forth, missing dots occur at the pixel positions where the sixth nozzle is responsible for recording.

In FIG. 28 it is assumed that only the eighth nozzle is used on pass 1. Therefore, no missing dots are caused by the sixth nozzle on pass 1.

Sub-scanning feed at a specific feed amount F of 4 dots is performed between the passes. The paper feed is carried out from the bottom to the top in FIG. 28, but for the sake of convenience, this figure is drawn as if the printing head 36 were moving in the opposite direction from the paper feed direction. The sub-scanning feed amount F does not need to be a constant value, and it is also possible to use a combination of a plurality of different values.

Figure 29A:
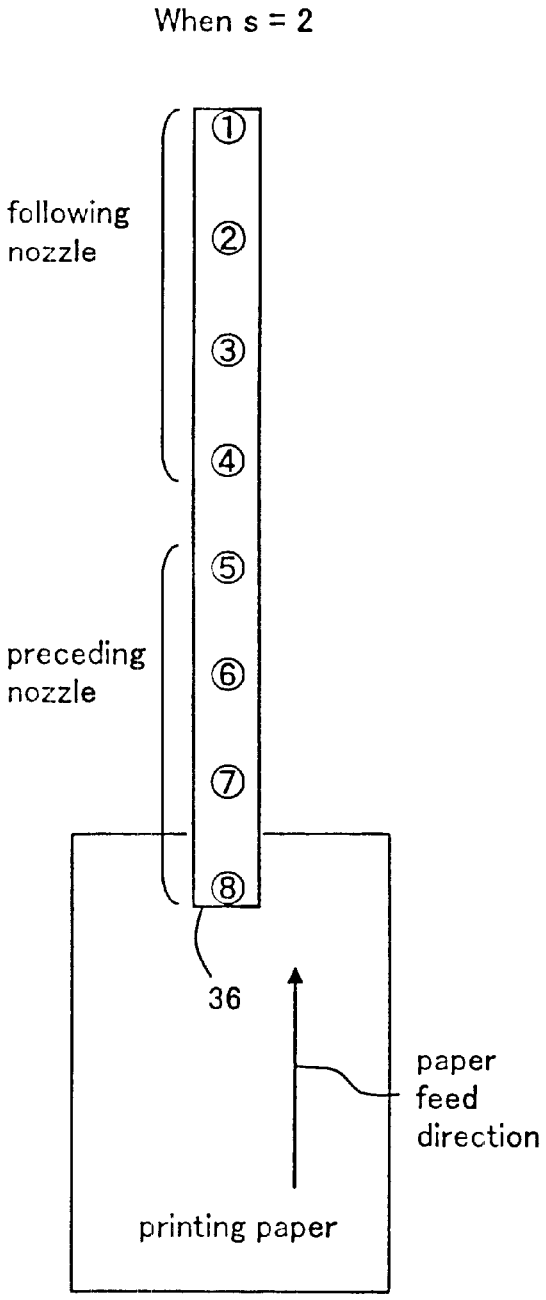
FIGS. 29(A) and 29(B) illustrate the preceding nozzles and following nozzles when the number of scan repetitions is 2 and 4.
Figure 29B:
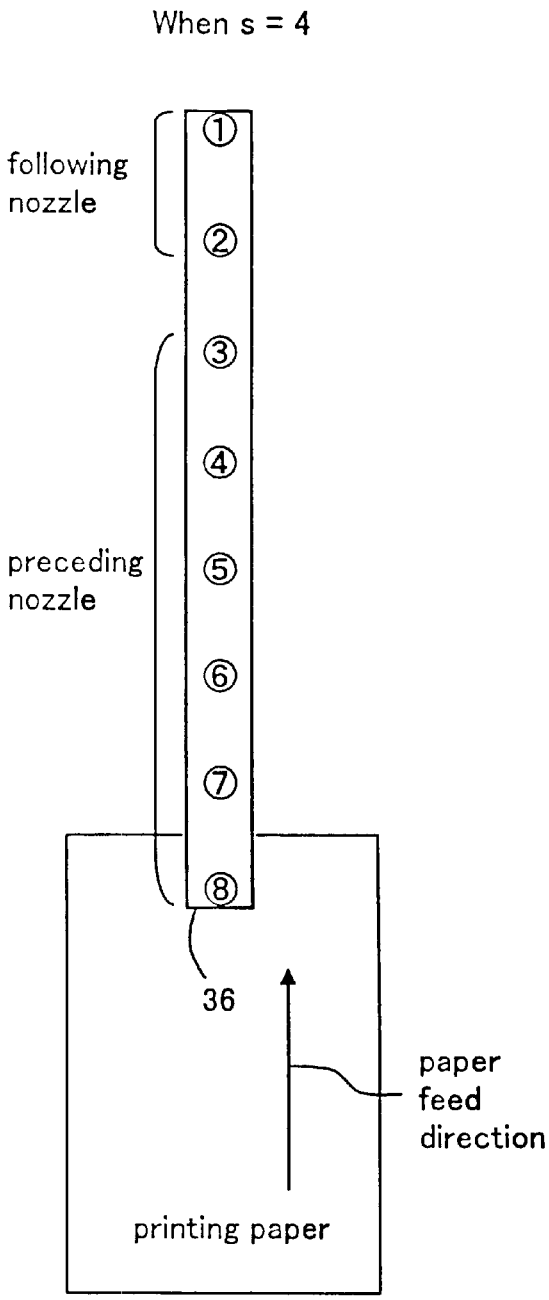

As discussed below, the specific details of the supplemental processing in overlap print mode depend on whether the non-operating nozzle is a preceding nozzle or a following nozzle. FIG. 29 consists of diagrams of the preceding nozzles and following nozzles. "Preceding nozzle" refers to a nozzle having another nozzle positioned behind it during any subsequent main scanning on the raster line on which the first nozzle performs its recording. "Following nozzle" refers to a nozzle having no other nozzle positioned behind it during any subsequent main scanning on the raster line on which the first nozzle performs its recording. In specific terms, as shown in FIG. 29(A), when the number of scanning repetitions s is 2, the fifth to eighth nozzles are preceding nozzles and the first to fourth nozzles are following nozzles. As shown in FIG. 29(B), when the number of scanning repetitions s is 4, the third to eighth nozzles are preceding nozzles, and the first and second nozzles are following nozzles.

As can be seen from the examples in FIG. 29, out of the N number (N is an integer of at least 2) nozzles used for print processing, the preceding nozzles are the $\{N\cdot(s-1)/s\}$ number of nozzles that reach the distal end of the printing paper soonest. The following nozzles are the (N/s) number of nozzles that reach the distal end of the printing paper last. The classification of preceding and following nozzles is performed for every nozzle array of each ink. For example, when there are nozzle arrays of six colors as shown in FIG. 5, the classification of preceding and following nozzles is performed for each of the six colors of ink.

Figure 30:
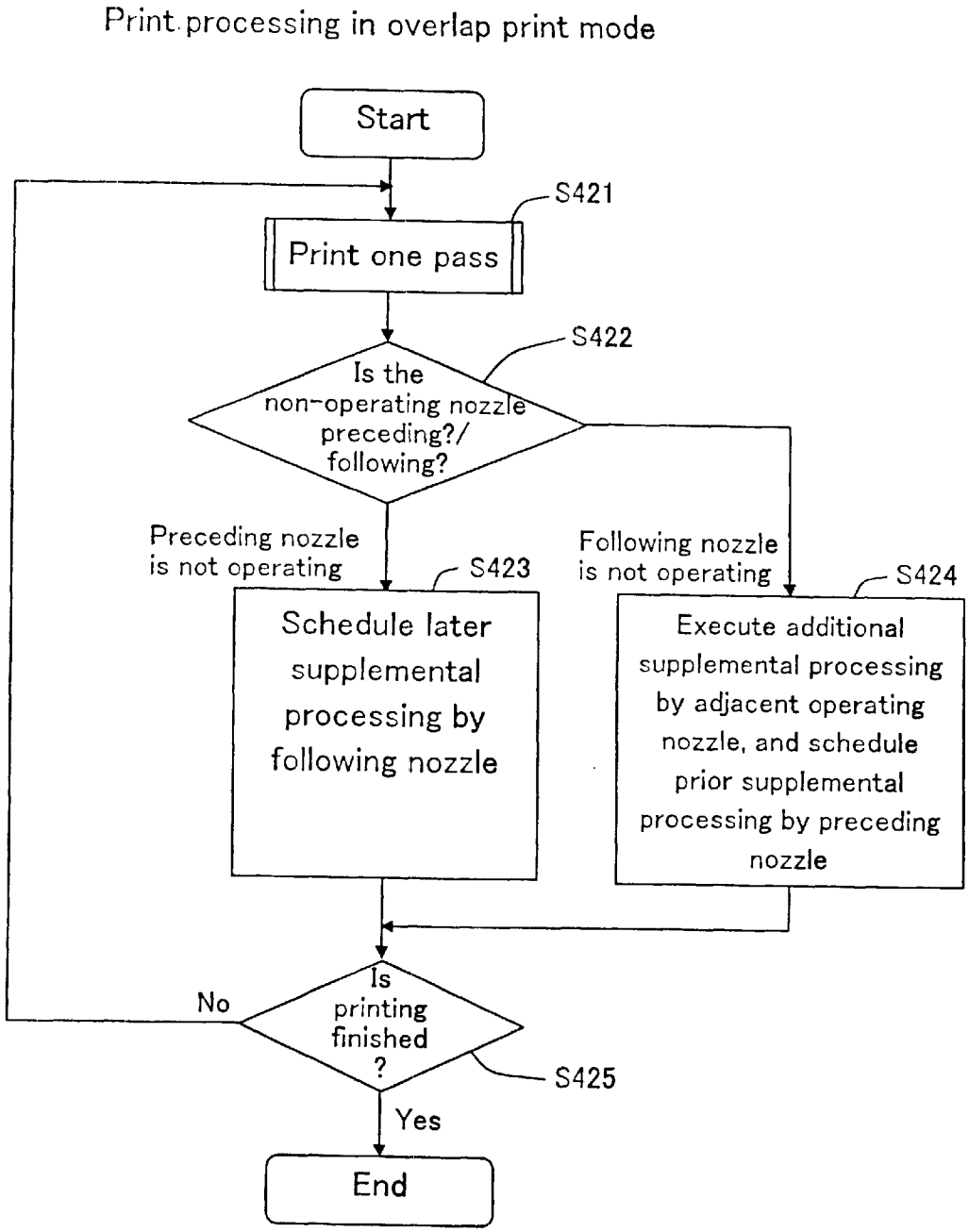
FIG. 30 is a flow chart of the procedure for print processing in overlap print mode.

FIG. 30 is a flow chart of the procedure for print processing in overlap print mode. First of all, one pass of printing is performed in step S421. The one pass of print processing in step S421 includes supplemental processing for missing dots, as will be described in detail below. Once the first pass of printing is finished, a decision is made in step S422 as to whether the non-operating nozzles are preceding or following nozzles.

If a non-operating nozzle is a preceding nozzle, then later supplemental processing by a following nozzle is scheduled in step S423. Specifically, it is registered as supplemental information in the main memory 56 (FIG. 4) that supplemental processing will not be performed right away, but a supplemental operation by a following nozzle will be performed in some subsequent pass. For instance, in the example in FIG. 28, the sixth nozzle is clogged and dots are missing at even-numbered pixel positions on the raster line L1. Because the sixth nozzle is a preceding nozzle, in the processing of step S423 after pass 2, the fact that supplementation is required for the even-numbered pixel positions on raster line L1 is registered as supplemental information. Similarly, in the processing of step S423 after pass 3, the fact that supplementation is required for the even-numbered pixel positions on raster line L2 is registered as supplemental information. The same applies to pass 4 and subsequent passes. From here on, supplemental processing performed in any pass of a normal printing operation after the detection of missing dots will be called "later supplemental processing." A raster line subjected to this later supplemental processing will be called a "later supplemented line" or just a "supplemented line," and a pixel position subjected to later supplemental processing (that is, a pixel position where a dot is missing) will be called a "later supplemented pixel position" or just a "supplemented pixel position."

The supplemental information used for later supplemental processing includes at least information indicating the position of the line to be supplemented, and information indicating the supplemented pixel position (even-numbered pixel position or odd-numbered pixel position). The print data that was supposed to be used in the recording of the supplemented pixel positions (such as print data of the even-numbered pixel positions on raster line L1) is stored in a supplemental processing buffer (not shown) in the image buffer 52 as print data for later supplemental processing, and is kept there until the later supplemental processing is executed.

If a non-operating nozzle is a following nozzle, step S424 is executed. The details of step S424 will be discussed below. Once the processing of step S423 or step S424 is finished, a decision is made in step S425 as to whether one page of printing has been completed, and if it has not, the flow returns to step S421 and another pass is executed.

Figure 31:
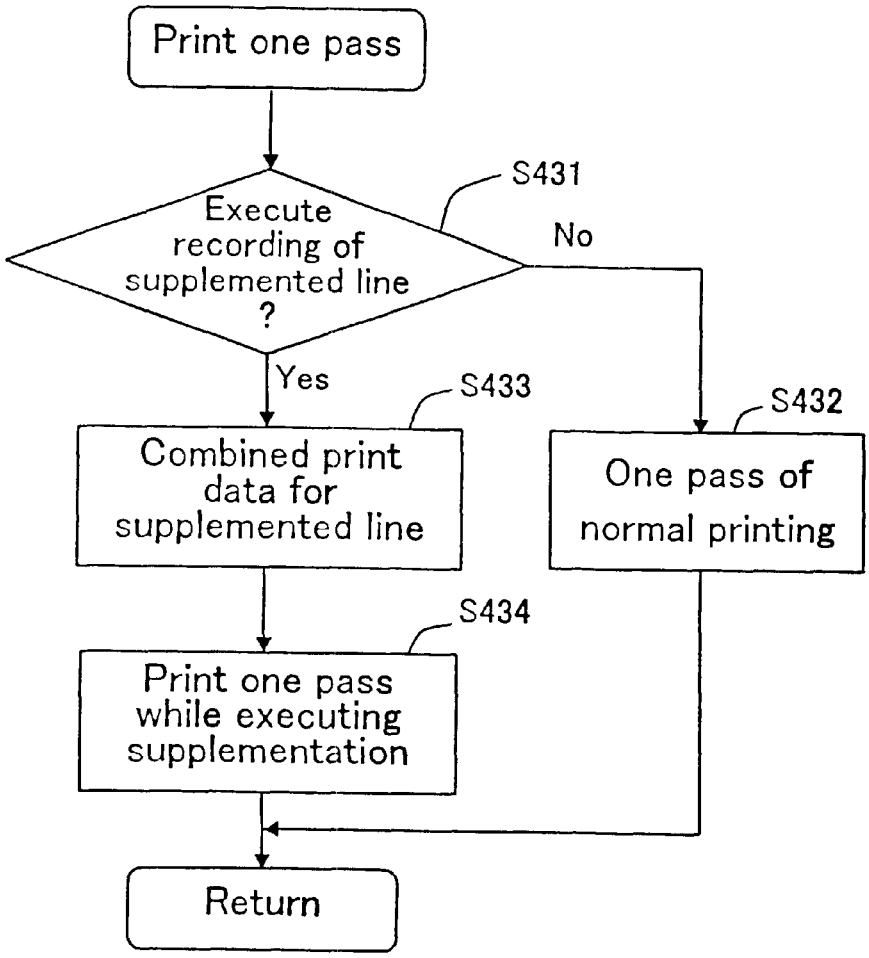
FIG. 31 is a flow chart of the detailed procedure in step S421.

FIG. 31 is a flow chart of the detailed procedure in step S421. In step S431 a decision is made as to whether recording has been executed on the supplemented line registered as supplemental information. If recording on the supplemented line is not executed, then the flow moves to step S432 and one pass of printing that is the same as a normal printing operation is executed. On the other hand, if recording on the supplemented line is executed, then the flow moves to step S433. For instance, the raster line L1 scheduled as a supplemented line in pass 2 in FIG. 28 is to be recorded by the second nozzle in pass 5. In view of this, step S433 is executed during the printing of pass 5.

In step S433, the print data for the supplemented pixel positions on the supplemented line is synthesized with the print data of a normal overlap printing operation. This "synthesis of print data" refers to processing in which the supplemental processing-use print data and the print data supplied during a normal overlap printing operation to the operating nozzles executing supplementation on the supplemented line are arranged in the order of pixel layout. For instance, in pass 5 of FIG. 28, the second nozzle is responsible for recording the odd-numbered pixel positions on raster line L1, so the print data supplied during a normal overlap printing operation to the second nozzle is just the print data related to the odd-numbered pixel positions on this raster line L1. On the other hand, the print data related to the even-numbered pixel positions on this raster line L1 is kept in the image buffer 52 (FIG. 4) as supplemental processing-use print data. In view of this, in step S433 these two types of print data are synthesized to produce print data related to all the pixel positions on the raster line L1. Print data for the other nozzles is the same as during a normal overlap printing operation. In step S434 one pass of printing is executed while this synthesized print data is used to execute missing dot supplemental processing.

Figure 32:
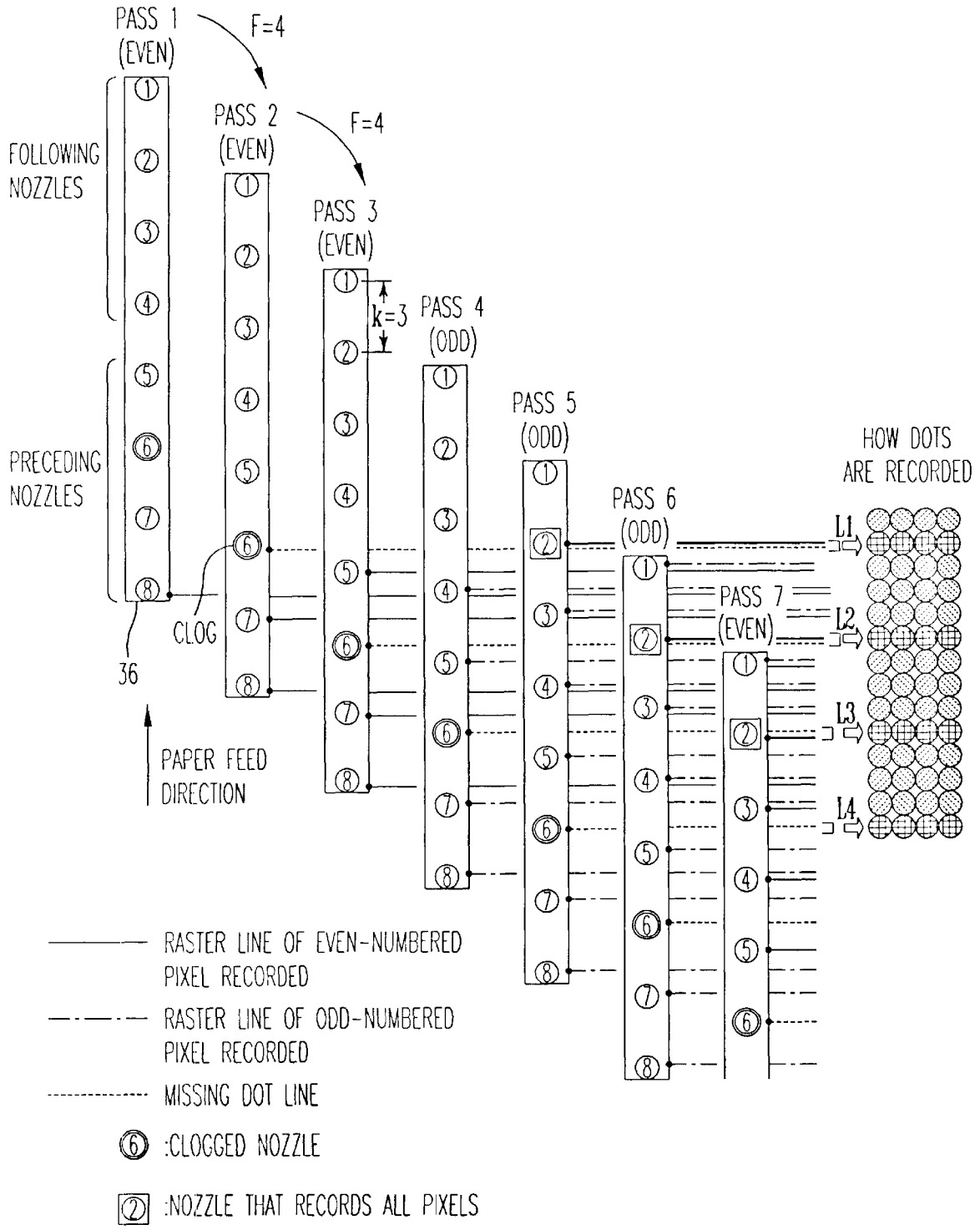
FIG. 32 is a diagram of the supplemental operation when the preceding nozzles are non-operating nozzles in overlap print mode.

FIG. 32 is a diagram of the supplemental operation when a preceding nozzle is a non-operating nozzle in overlap print mode. From pass 1 to pass 4 is the same as the normal printing operation shown in FIG. 28. In pass 5, all the pixel positions on the raster line L1 are to be recorded by the second nozzle. In pass 6, all the pixel positions on the raster line L2 are to be recorded by the second nozzle. The same applies to pass 7 and beyond. As can be seen from a comparison of FIGS. 28 and 32, if a preceding nozzle is not operating, there is no need to add a special pass for supplementation, and missing dots can be supplemented by utilizing the pass for a normal overlap printing operation.

When the number of scanning repetitions s is 2, just the odd-numbered pixel positions or just the even-numbered pixel positions on each raster line are to be recorded in the first pass, while all the pixel positions on the supplemented line are to be recorded in the later supplemental processing. Accordingly, when the later supplemental processing is performed, if the printing head 36 is moved at the same main scanning speed (carriage speed) as in a normal printing operation, it may be impossible to form dots at the proper pixel positions because of limitations to the drive characteristics of the printing head 36. If so, then when the later supplemental processing is performed, printing is executed at a lower main scanning speed than in a normal printing operation.

When the number of scanning repetitions s is 4, pixel positions are only to be recorded in a proportion of one pixel out four on each raster line, whereas in the later supplemental processing, the pixel positions are to be recorded in a proportion of two pixels out of four on the supplemented line. Here again, the printing should be executed as needed at a lower main scanning speed than in a normal printing operation. This adjustment of the main scanning speed in supplemental operation is similarly performed in the prior supplemental processing discussed below.

If, however, a non-operating nozzle is a following nozzle, then step S424 in FIG. 30 is executed as follows. In step S424, after a normal pass, additional supplemental processing is executed right away using an operating nozzle near the non-operating nozzle, and scheduling for prior supplemental processing by a preceding nozzle is registered for pixel positions in which the non-operating nozzle is scheduled to be responsible for recording in subsequent passes. "Additional supplemental processing" as used here means supplemental processing executed by means of a pass added especially for supplementation, rather than a pass in a normal printing operation. "Prior supplemental processing" means supplemental processing performed in a pass of a normal printing operation prior to the actual occurrence of missing dots.

Figure 33A:
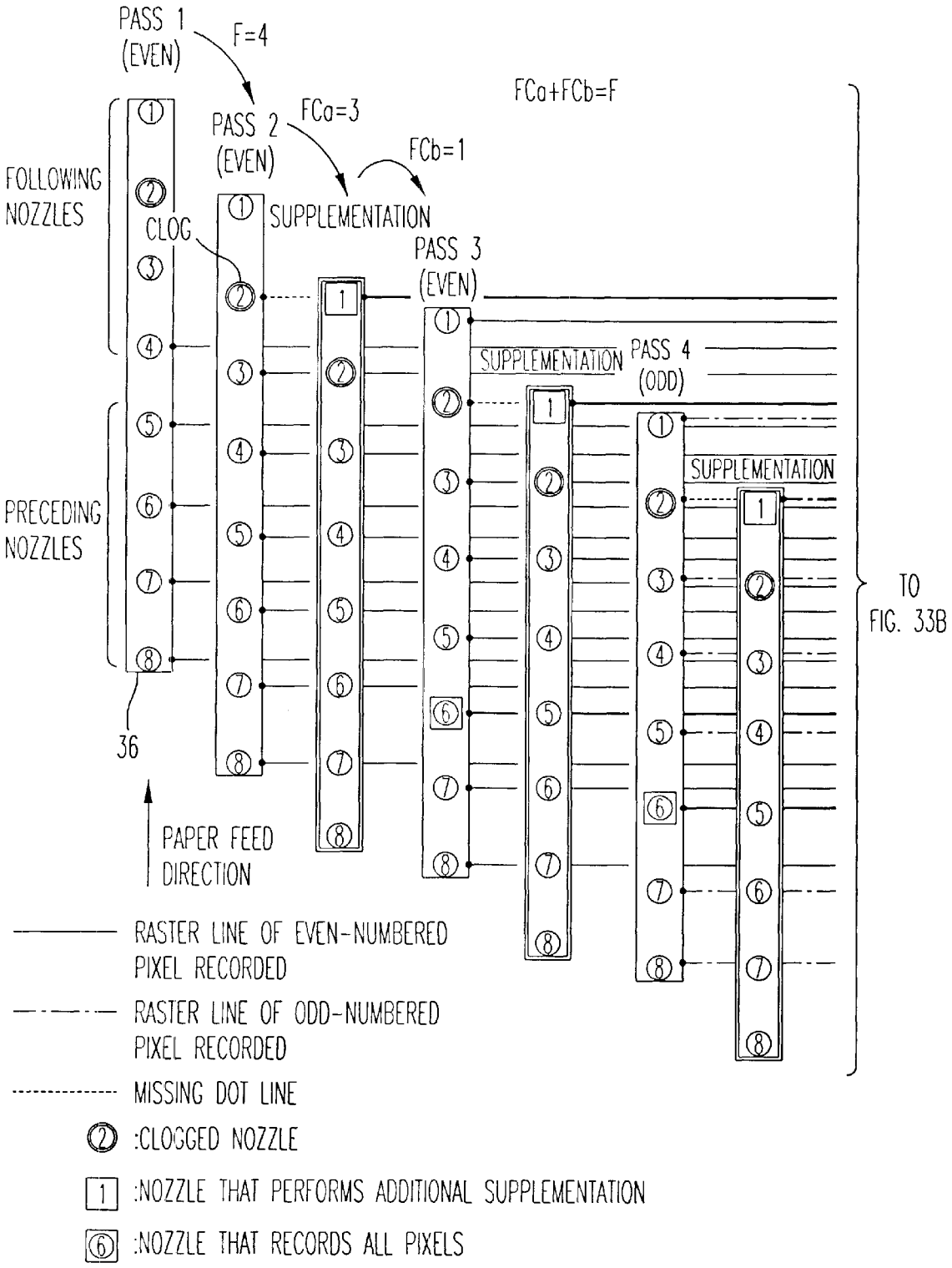
FIG. 33 is a diagram of the supplemental operation when the following nozzles are non-operating nozzles in overlap print mode.
Figure 33B:
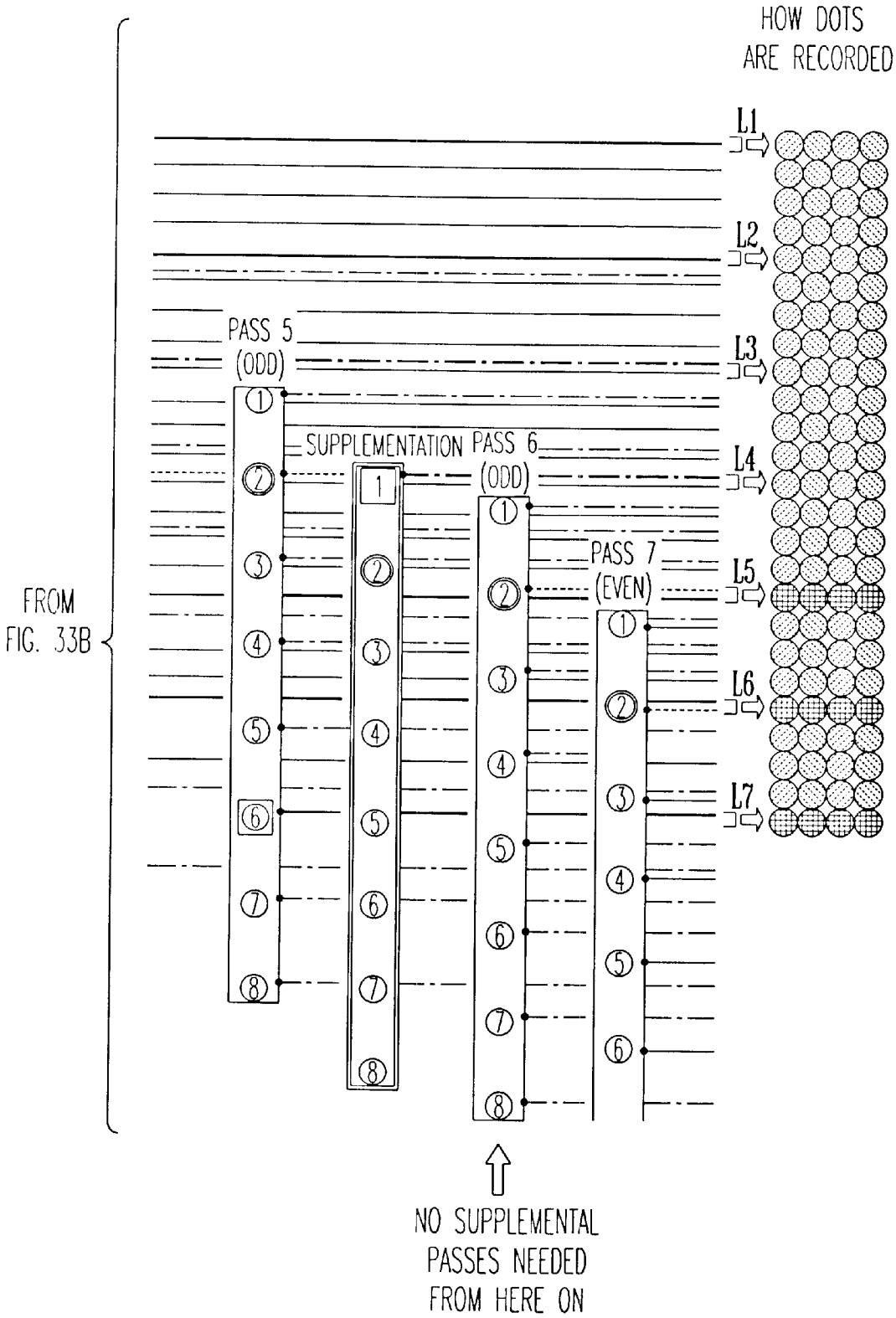

FIG. 33 is a diagram of the supplemental operation when a following nozzle is a non-operating nozzle in overlap print mode. In this example, the second nozzle is not operating. Also, it is assumed that only the fourth to eighth nozzles are used in pass 1. Therefore, no missing dots are caused by the second nozzle in pass 1.

In the processing of step S424 after pass 2, in which missing dots occur, additional supplemental processing is executed using the first nozzle, which is an operating nozzle next to the second nozzle. Specifically, as shown in FIG. 33, sub-scanning feed is performed at a transient first feed amount FCa (=3 dots) after pass 2, and the first nozzle, which is an adjacent operating nozzle, is positioned over the raster line L1 on which missing dots occurred in pass 2. Recording related to the supplemented pixel positions on the raster line L1 (that is, the odd-numbered pixel positions) is then executed by the first nozzle. This additional supplemental processing is intended to record only the intermittent supplemented pixel positions (the even-numbered pixel position on the raster line L1), and is therefore also called "intermittent supplemental processing." A raster line to be subjected to additional supplemental processing is called an "additionally supplemented line" or just a "supplemented line," and a pixel position to be subjected to additional supplemental processing is called an "additionally supplemented pixel position" or just a "supplemented pixel position."

The transient sub-scanning feed can also be "back feed," in which the feed amount FCa is a negative value, but usually the error in the sub-scanning feed amount is less with "forward feed," in which the feed amount FCa is a positive value. Therefore, it is preferable for a nozzle further to the rear of a non-operating nozzle (to the rear in the paper feed direction) to be selected as the adjacent operating nozzle responsible for the additional supplemental processing so that forward feed can be performed.

When this supplemental pass is finished, sub-scanning feed is performed at a second transient feed amount FCb (=1 dot) to move the printing head 36 so that the nozzle position of the next pass during a normal printing operation will be achieved. For instance, the printing head 36 is positioned in pass 3 upon completion of the supplemental pass after pass 2.

As can be seen from FIG. 33, the two sub-scanning feeds in the transient feed amounts FCa and FCb are executed in between two passes of normal printing operation (such as pass 2 and pass 3). If there are no missing dots, the sub-scanning feed amount F executed in between two normal passes is 4 dots. Therefore, the two feed amounts FCa and FCb of transient subscanning feed are set such that the total value thereof (FCa+FCb) will be equal to the feed amount F of sub-scanning feed executed in between two normal passes. This allows the printing head 36 to be positioned at a location suited to the next pass of normal printing operation even after additional supplemental processing. Therefore, the supplementation of missing dots can be easily accomplished merely by inserting an additional supplemental operation in between normal printing operations, without modifying the entire printing operation.

The details of the prior additional supplemental processing in step S424 of FIG. 30 are as follows. Since the clogged second nozzle is a following nozzle, the raster line on which the second nozzle is scheduled to execute recording subsequently should be recorded by a preceding nozzle in some pass prior to the execution of recording by the second nozzle. In the example in FIG. 33, the raster line L5 on which the second nozzle is scheduled to execute recording in pass 6 is to be recorded by the sixth nozzle in the previous pass 3.

In view of this, with the processing of step S424 immediately after pass 2, the raster line on which the second nozzle is scheduled to execute recording in each pass from pass 3 and beyond is scheduled as the supplemented line. In specific terms, the raster lines L2, L3, L4, L5, . . . are scheduled as supplemented lines. This means that the raster line L5 will be scheduled as the supplemented line when processing is executed according to the procedure of FIG. 31 in pass 3, so the processing of steps S433 and 434 is executed on this raster line L5. In specific terms, the sixth nozzle executes recording for all the pixel positions on the raster line L5. Thus, supplemental processing performed prior to the occurrence of missing dots is called "prior supplemental processing." A raster line to be subjected to prior supplemental processing is called a "prior supplemented line" or just a "supplemented line," and a pixel position to be subjected to prior supplemental processing is called a "prior supplemented pixel position" or just a "supplemented pixel position."

The supplemental information registered for prior supplemental processing includes at least information indicating the position of the supplemented line and information indicating the supplemented pixel position. However, it is possible that the print data used in prior supplemental processing (such as print data about the even-numbered pixel positions on the raster line L5) will not have been supplied from the host computer 100 to the printer by the time pass 3 is executed in a normal printing operation. In a case such as this, the prior supplemental processing of steps S433 and S434 (that is, the print processing of pass 3) is executed after the print data to be used in prior supplemental processing has been supplied from the host computer 100.

Of the supplemented lines L1 to L7 shown in FIG. 33, raster lines L2, L3, and L4 cannot be subjected to the prior supplemental processing performed in pass 3 and beyond because the preceding nozzle has already finished its recording in a pass prior to pass 2 (partially omitted in FIG. 33). For these supplemented lines L2, L3, and L4, additional supplemental processing using an adjacent operating nozzle is executed in step S405. In specific terms, as shown in FIG. 33, additional supplemental processing is executed for each of the raster lines L2, L3, and L4 in which missing dots occurred in passes 3, 4, and 5, respectively, immediately after passes 3, 4, and 5.

Meanwhile, additional supplemental processing is not needed for supplemented lines L5, L6, L7, . . . for which prior supplemental processing is executed. Therefore, there is no need for additional supplemental processing in the pass 6 and subsequent passes in which the non-operating nozzle (second nozzle) is positioned on a raster line in which prior supplemental processing has been completed. Thus, in the example of FIG. 33, all the supplemental processing can be performed merely by adding four supplemental passes to the normal printing operation, so the advantage is that there is no excessive increase in the overall printing time due to supplemental processing.

The various supplemental operations discussed above are controlled by the system controller 54.

As above, in overlap print mode, when a raster line on which recording is to be performed by a non-operating nozzle is to be assigned to another operating nozzle in some pass of a normal overlap printing operation, the operating nozzle is used to execute supplemental processing. Therefore, an advantage is that missing dots can be supplemented without adding very many special supplemental passes.

L. Processing Procedure in the Eighth Example

Figure 34:
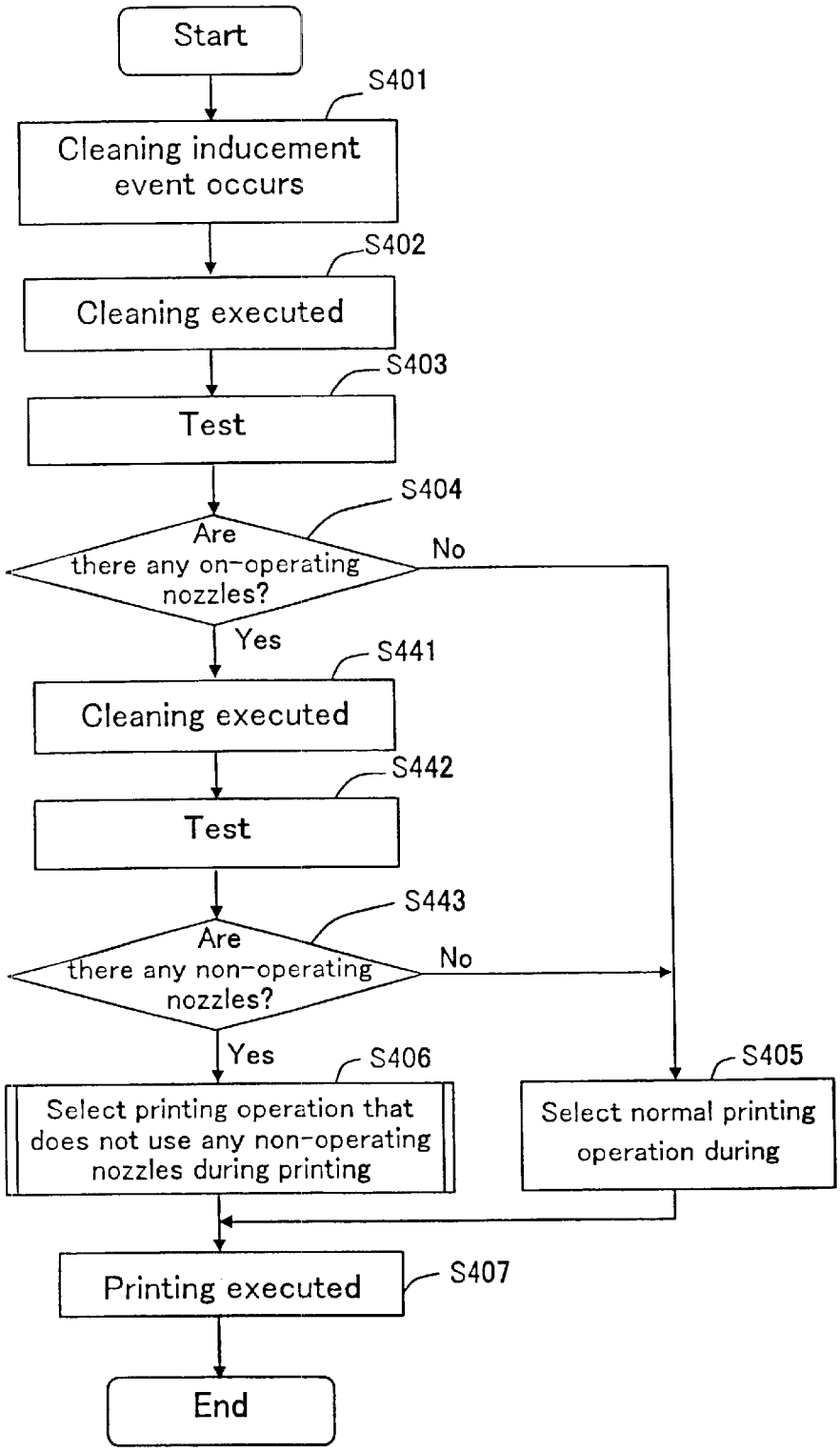
FIG. 34 is a flow chart of the procedure for print processing in an eighth example.

FIG. 34 is a flow chart of the procedure for print processing in an eighth example. This procedure adds steps S441 to S443 after step S404 in the procedure of FIG. 23 discussed above.

In the eighth example, when a non-operating nozzle is detected in the nozzle test after cleaning (steps S403 and S404), cleaning and nozzle testing are executed once more (steps S441 and S442). If the operation of the non-operating nozzle is restored by this second cleaning, then a normal printing operation is selected in step S405. Meanwhile, if there is still a non-operating nozzle even after the second cleaning, then a printing operation that does not make use of the non-operating nozzle is selected in step S406. The advantage of this is a greater likelihood that the operation of the non-operating nozzle will be restored, so there is less need to perform supplemental processing.

With this eighth example, step S404 is executed if the clogging of the nozzle is not cleared by the second cleaning, but step S404 may instead be executed for the first time when the nozzle clogging is not cleared by a third or further cleaning. Specifically, a normal printing operation is generally selected if the nozzle clogging is not cleared by a specific number of cleanings, and only when the nozzle clogging is still not cleared after this specific number of cleanings is a printing operation selected that will not make use of the non-operating nozzle.

M. Other

This invention is not limited to the examples and embodiments given above, and can be implemented in various forms without deviating from the essence thereof. For example, the following variations are also possible.

(1) In the above examples, part of the structure consisting of hardware may be replaced with software, and conversely, part of the structure consisting of software may be replaced with hardware.

(2) The present invention is generally applicable to a printer of the type that ejects ink droplets, and is applicable to a variety of printers other than color ink jet printers. For instance, it is also applicable to ink jet facsimile machines or copiers.

(3) Missing dots are more noticeable on some printing media than on others. For instance, missing dots stand out on printing paper specially designed for use in ink jet printing, but are less noticeable on ordinary copy paper. In view of this, a "mode in which a printing medium on which missing dots stand out is primarily used" and "mode in which a printing medium on which missing dots do not stand out is primarily used" may be provided, and in the "mode in which a printing medium on which missing dots do not stand out is primarily used," cleaning may not be performed until a specific number of nozzles have become clogged during standby mode. This lowers the probability that new non-operating nozzles will be created by cleaning.

Also, when a printing medium on which missing dots stand out is used, a supplemental operation may not be performed until a specific number of nozzles have become clogged. This prevents a decrease in image quality without drastically lowering the printing speed.

(4) Similarly, missing dots are more noticeable with some types of printed images than with others. For instance, missing dots are pronounced in photographic images, but do not stand out in text images including characters, in graphic images made up of characters and figures such as graphs, and so forth. A printed image containing no photographic image, such as a text image or graphic image, is called a "non-photographic image" in this Specification.

In view of this, a "mode in which photographic images are printed" and a "mode in which non-photographic images are printed" may be provided, and in the "mode in which non-photographic images are printed," cleaning may not be performed until a specific number of nozzles have become clogged during standby mode. This lowers the probability that new non-operating nozzles will be created by cleaning.

Also, when non-photographic images are printed, a supplemental operation may not be performed until a specific number of nozzles have become clogged. In this adjustment of the supplemental operation according to the type of printed image, information indicating the type of printed image should be registered in the header of the print data sent from the computer to the printer, for example.

What is claimed is:

1. In a printer comprising a printing head having a plurality of nozzles for ejecting ink droplets, a cleaning mechanism for cleaning the plurality of nozzles, and a test unit for testing whether each of the plurality of nozzles can eject ink droplets, a method of controlling the printer, comprising the steps of:

when the cleaning mechanism performs cleaning for a specific inducement other than the detection by the test unit of at least a specific number of non-operating nozzles unable to eject ink droplets, automatically carrying out the testing of the nozzles by the test unit before this cleaning; and canceling the execution of the cleaning if the number of non-operating nozzles detected by the testing of the nozzles before the cleaning is less than a first threshold.

2. The method for controlling a printer according to claim 1, wherein the cleaning for the specific inducement includes timer cleaning carried out automatically by the printer when at least a specific amount of time has elapsed since a specified event.

3. The method for controlling a printer according to claim 1, wherein the plurality of nozzles are divided into a plurality of nozzle sets each including one or more nozzles, the cleaning mechanism is able to carry out the cleaning independently for each of the nozzle sets, and the method further comprises the step of deciding whether to cancel the execution of the cleaning for each nozzle set.

4. The method for controlling a printer according to claim 1, further comprising the step of:

requiring a user to reconfirm a cleaning directive if the execution of the cleaning for the specific inducement is a result of the cleaning directive from the user.

5. The method for controlling a printer according to claim 1, wherein the cleaning includes an operation in which ink is drawn out of the plurality of nozzles by suction.

6. The method for controlling a printer according to claim 1, wherein the cleaning includes a plurality of cleaning sequences each comprising a plurality of cleaning operations, and the method further comprises the step of selecting one of the cleaning sequences according to the number of non-operating nozzles detected by the testing of the nozzles before the cleaning.

7. The method for controlling a printer according to claim 6, wherein the step of selecting includes:

(a) when the number of non-operating nozzles detected by the testing of the nozzles before the cleaning is less than a second threshold, selecting a first cleaning sequence having a plurality of cleaning operations, including:

a first cleaning operation whose ability to clear nozzle clogging is relatively low and which is carried out relatively early in the cleaning sequence, and a second cleaning operation whose ability to clear nozzle clogging is relatively high and which is carried out relatively late in the cleaning sequence; and (b) when the number of non-operating nozzles detected by the testing of the nozzles before the cleaning is at least the second threshold, selecting a second cleaning sequence including the cleaning operations beginning with the second cleaning operation out of the first cleaning sequence.

8. The method for controlling a printer according to claim 6, wherein the plurality of nozzles include:

a first nozzle group consisting of nozzles that eject ink with which nozzle clogging is relatively easy to clear; and a second nozzle group consisting of nozzles that eject ink with which nozzle clogging is relatively difficult to clear, and the step of selecting includes:

(a) when the all of the non-operating nozzles detected by the testing of the nozzles before the cleaning are included in the first nozzle group, selecting a first cleaning sequence having a plurality of cleaning operations, including:

a first cleaning operation whose ability to clear nozzle clogging is relatively low and which is carried out relatively early in the cleaning sequence, and a second cleaning operation whose ability to clear nozzle clogging is relatively high and which is carried out relatively late in the cleaning sequence; and (b) when the non-operating nozzles detected by the testing of the nozzles before the cleaning include the nozzle of the second nozzle group, selecting a second cleaning sequence including the cleaning operations beginning with the second cleaning operation out of the first cleaning sequence.

9. The method for controlling a printer according to claim 6, wherein the plurality of nozzles are divided into a plurality of nozzle sets each including one or more nozzles, the cleaning mechanism is able to carry out each of the plurality of cleaning operations independently for each of the nozzle sets, and the step of selecting includes a step of determining the cleaning sequence carried out for each nozzle set.

10. A printer that performs printing by ejecting ink droplets from a plurality of nozzles, comprising:

a printing head having a plurality of nozzles;

a cleaning mechanism that cleans the plurality of nozzles;

a test unit that determines whether each nozzle is an operating nozzle capable of ejecting ink droplets or a non-operating nozzle incapable of ejecting ink droplets, by testing whether ink droplets are ejected from the plurality of nozzles;

a main scanning drive section that performs main scanning by driving the printing head and/or a recording medium;

a head drive section that records dots by driving the nozzles in the middle of the main scanning;

a sub-scanning drive section that performs sub-scanning by driving the printing head and/or the recording medium every time the main scanning is finished; and a controller that controls the various components, wherein the controller automatically carries out a nozzle test by the test unit before the cleaning when the cleaning mechanism performs cleaning for a specific inducement other than the detection by the test unit of at least a specific number of non-operating nozzles, and wherein the controller cancels the execution of the cleaning if the number of non-operating nozzles detected by the testing of the nozzles before the cleaning is less than a first threshold.

11. The printer according to claim 10, wherein the cleaning for the specific inducement includes timer cleaning carried out automatically by the printer when at least a specific amount of time has elapsed since a specified event.

12. The printer according to claim 10, wherein the plurality of nozzles are divided into a plurality of nozzle sets each including one or more nozzles, the cleaning mechanism is able to carry out independently the cleaning for each of the nozzle sets, and the controller decides whether to cancel the execution of the cleaning for each nozzle set.

13. The printer according to claim 10, wherein the controller outputs information for the reconfirmation of a cleaning directive when the execution of the cleaning for the specific inducement is a result of the cleaning directive from the user.

14. The printer according to claim 10, wherein the cleaning includes an operation in which ink is drawn out of the plurality of nozzles by suction.

15. The printer according to claim 10, wherein the cleaning includes a plurality of cleaning sequences each comprising a plurality of cleaning operations, and the controller selects one of the cleaning sequences according to the number of non-operating nozzles detected by the testing of the nozzles before the cleaning.

16. The printer according to claim 15, wherein, the controller selects a first cleaning sequence having a plurality of cleaning operations, including:

a first cleaning operation whose ability to clear nozzle clogging is relatively low and which is carried out relatively early in the cleaning sequence, and a second cleaning operation whose ability to clear nozzle clogging is relatively high and which is carried out relatively late in the cleaning sequence when the number of non-operating nozzles detected by the testing of the nozzles before the cleaning is less than a second threshold, and selects a second cleaning sequence including the cleaning operations beginning with the second cleaning operation out of the first cleaning sequence when the number of non-operating nozzles detected by the testing of the nozzles before the cleaning is at least the second threshold.

17. The printer according to claim 15, wherein the plurality of nozzles include:

a first nozzle group consisting of nozzles that eject ink with which nozzle clogging is relatively easy to clear; and a second nozzle group consisting of nozzles that eject ink with which nozzle clogging is relatively difficult to clear, and the controller selects a first cleaning sequence having a plurality of cleaning operations, including:

a first cleaning operation whose ability to clear nozzle clogging is relatively low and which is carried out relatively early in the cleaning sequence, and a second cleaning operation whose ability to clear nozzle clogging is relatively high and which is carried out relatively late in the cleaning sequence when all of the non-operating nozzles detected by the testing of the nozzles before the cleaning are included in the first nozzle group, and selects a second cleaning sequence including the cleaning operations beginning with the second cleaning operation out of the first cleaning sequence when the non-operating nozzles detected by the testing of the nozzles before the cleaning include the nozzle of the second nozzle group.

18. The printer according to claim 15, wherein the plurality of nozzles are divided into a plurality of nozzle sets each including one or more nozzles, the cleaning mechanism is able to carry out each of the plurality of cleaning operations independently for each of the nozzle sets, and the controller determines the cleaning sequence carried out for each nozzle set.

19. A computer program product for use in a computer including a printer, the printer having a printing head having a plurality of nozzles, a cleaning mechanism for cleaning the plurality of nozzles, and a test unit for testing whether each of the plurality of nozzles can eject ink droplets, the computer program product comprising:

a computer readable medium; and a computer program stored on the computer readable medium, the computer program comprising:

a program for causing the computer, when the cleaning mechanism performs the cleaning for a specific inducement other than the detection by the test unit of at least a specific number of non-operating nozzles unable to eject ink droplets, to automatically carry out the testing of the nozzles by the test unit before this cleaning and to cancel the execution of the cleaning if the number of non-operating nozzles detected by the testing of the nozzles before the cleaning is less than a first threshold.

* * * * *